US010377452B2

(12) United States Patent
Norrie et al.

(10) Patent No.: US 10,377,452 B2
(45) **Date of Patent: *Aug. 13, 2019**

(54) FIN PLUG FOR WATER CRAFT

(71) Applicant: Fin Control Systems Pty Limited, Mona Vale, New South Wales (AU)

(72) Inventors: Scott Norrie, Mona Vale (AU); Michael Durante, Mona Vale (AU); Gregory Scott, Mona Vale (AU); Linden Evans, Mona Vale (AU)

(73) Assignee: Fin Control Systems PTY Limited, Mona Vale, New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/598,948

(22) Filed: May 18, 2017

(65) Prior Publication Data

US 2017/0334529 A1 Nov. 23, 2017

Related U.S. Application Data

(63) Continuation of application No. 14/411,667, filed as application No. PCT/AU2013/000738 on Jul. 5, 2013, now Pat. No. 9,688,365.

(30) Foreign Application Priority Data

Jul. 9, 2012 (AU) ..... 2012902939

(51) Int. Cl.
*B63B 35/79* (2006.01)

(52) U.S. Cl.
CPC ..... *B63B 35/793* (2013.01); *B63B 35/7926* (2013.01)

(58) Field of Classification Search
CPC ..... B63B 35/793; B63B 35/7926
USPC ..... 441/74, 79
See application file for complete search history.

(56) References Cited

U.S. PATENT DOCUMENTS

| | | | |
|---|---|---|---|
| 3,516,099 | A | 6/1970 | Morey et al. |
| 3,564,632 | A | 2/1971 | Bahne, Jr. |
| 3,579,681 | A | 5/1971 | Pope, III et al. |
| 3,585,663 | A | 6/1971 | Johnson |
| 3,659,300 | A | 5/1972 | Johnson |
| 3,879,782 | A | 4/1975 | Oliver |

(Continued)

FOREIGN PATENT DOCUMENTS

| | | |
|---|---|---|
| AU | 8599282 | 7/1982 |
| AU | 8599982 | 7/1982 |

(Continued)

OTHER PUBLICATIONS

Seabase, "The New Universal Surfinz F3", Seabase Installation Instruction Sheet, www.seabase.eu, Whole Document.

(Continued)

*Primary Examiner* — Anthony D Wiest
(74) *Attorney, Agent, or Firm* — W&C IP

(57) ABSTRACT

A fin plug (10) for installation in a water craft, said fin plug (10) including: a first open cavity (20) adapted to receive a base portion (15) of a water craft fin (50); and, a resilient biasing rod (30) and a protruding member (35) cooperating with the biasing rod, said protruding member being adapted to abut the base portion (15) of said fin (50) when received in said first open cavity (20); wherein said biasing rod and protruding member are adapted to apply a force to the base portion of said fin to inhibit removal of said fin from said first open cavity.

26 Claims, 86 Drawing Sheets

(56) References Cited

U.S. PATENT DOCUMENTS 3,890,661 A 6/1975 Johnson
3,965,514 A 6/1976 Shafer et al.
4,044,416 A 8/1977 Brewer et al.
4,325,154 A 4/1982 Collum, Jr.
4,320,546 A 5/1982 Knox
4,379,703 A 4/1983 Mizell
4,398,485 A 8/1983 Diziere
4,421,492 A 12/1983 Leva
4,493,655 A 1/1985 Groff
4,493,665 A 1/1985 Liddle
4,537,143 A 8/1985 Gaide
4,701,144 A 10/1987 DeWitt, III
4,710,144 A 12/1987 Hunt
4,733,496 A 3/1988 Wallner
4,789,368 A 12/1988 D'Onofrio
4,804,347 A 2/1989 Ross
4,846,745 A 7/1989 Lobe
4,850,917 A 7/1989 Wilson et al.
4,854,904 A 8/1989 Wahl
4,904,215 A 2/1990 Sherwood
4,964,826 A 10/1990 Lobe
5,030,151 A 7/1991 Beacham
5,032,096 A 7/1991 Scott et al.
5,112,091 A 5/1992 Kluting
5,133,681 A 7/1992 Lobe
5,148,761 A 9/1992 Winner
5,176,096 A 1/1993 Molnar et al.
5,176,553 A 1/1993 Tuttle
5,215,488 A 6/1993 Bailey
5,224,435 A 9/1993 Billett
5,242,322 A 9/1993 Chellemi et al.
5,273,472 A 12/1993 Skedeleski et al.
5,306,188 A 4/1994 Skedeleski et al.
5,328,397 A 7/1994 Whitty
5,356,324 A 10/1994 Cunningham
5,464,359 A 11/1995 Whitty
5,480,331 A 1/1996 Lewis
5,493,989 A 2/1996 Anderson
5,503,581 A 4/1996 McCullough
5,567,190 A 10/1996 Oates
5,597,337 A 1/1997 Nedderman, Jr.
5,649,846 A 7/1997 Harper et al.
5,672,081 A 9/1997 Whitty
5,830,025 A 11/1998 Fleming
5,934,962 A 8/1999 Daum et al.
5,934,963 A 8/1999 Frizzell
5,951,347 A 9/1999 Hudson et al.
5,975,974 A 11/1999 McCausland
5,997,376 A 12/1999 Block et al.
6,053,789 A 4/2000 Miyashiro
6,068,531 A 5/2000 Patterson
6,106,346 A 8/2000 Bolen
6,139,383 A 10/2000 Jolly et al.
6,213,004 B1 4/2001 Rodgers et al.
6,217,402 B1 4/2001 Bolen
6,244,921 B1 6/2001 Pope
6,247,985 B1 6/2001 Block et al.
6,322,413 B1 11/2001 Webber
6,379,204 B2 4/2002 Bolen
6,386,933 B1 5/2002 Rewald et al.
6,439,940 B1 8/2002 Pouchkarev
6,551,157 B1 4/2003 Bishop
6,595,817 B1 7/2003 Chang
6,695,662 B2 2/2004 Kelley
6,739,925 B2 5/2004 Burns et al.
6,746,292 B2 6/2004 Panzer
6,752,674 B2 6/2004 Jolly
6,764,364 B1 7/2004 Hickman et al.
6,767,266 B2 7/2004 Bolen
6,793,548 B2 9/2004 Jolly et al.
6,821,173 B2 11/2004 McCausland et al.
6,837,763 B1 1/2005 Masteller
D502,522 S 3/2005 Sperafico
6,896,570 B1 5/2005 O'Keefe et al.
6,916,220 B2 7/2005 Davey et al.
6,918,806 B2 7/2005 Skedeleski
6,935,910 B2 8/2005 Laine
RE38,840 E 10/2005 Patterson
6,986,570 B2 1/2006 Jones et al.
6,991,503 B2 1/2006 Garcia
6,991,504 B1 1/2006 English et al.
7,025,645 B1 4/2006 Hsieh
7,029,352 B1 4/2006 Suzuki
7,037,154 B1 5/2006 Suzuki
7,108,571 B2 9/2006 Geraghty
7,117,699 B2 10/2006 Bistline
7,121,911 B1 10/2006 Hickman
7,182,661 B2 2/2007 Sams et al.
7,198,532 B2 4/2007 Field
7,244,157 B2 7/2007 Simpson
7,264,524 B2 9/2007 Batt
7,285,031 B2 10/2007 Mair et al.
7,311,576 B2 12/2007 Pope
7,393,256 B2 7/2008 Clutton et al.
7,497,752 B2 3/2009 Field
7,524,225 B1 4/2009 Richenberg et al.
7,654,168 B2 2/2010 O'Brien et al.
7,896,718 B2 3/2011 Jones
8,393,928 B2 3/2013 Kumano et al.
2001/0006864 A1 7/2001 Bolen
2002/0039866 A1 4/2002 Jolly et al.
2002/0102890 A1 8/2002 Bolen
2002/0155769 A1 10/2002 Herbert et al.
2003/0040236 A1 2/2003 Burns et al.
2003/0087564 A1 5/2003 Kelley
2003/0092333 A1 5/2003 McCausland et al.
2003/0092334 A1 5/2003 McCausland et al.
2003/0124924 A1 7/2003 McCausland et al.
2003/0159475 A1 8/2003 Tan
2003/0220030 A1 11/2003 Jolly
2003/0236039 A1 12/2003 Banys, Jr.
2004/0035346 A1 2/2004 Davey et al.
2004/0043681 A1 3/2004 Jolly et al.
2004/0072483 A1 4/2004 Panzer
2004/0092180 A1 5/2004 Turkington
2004/0214486 A1 10/2004 McCausland et al.
2004/0235374 A1 11/2004 Garcia
2004/0242093 A1 12/2004 Geraghty
2004/0248482 A1 12/2004 Larkin
2005/0059304 A1 3/2005 Laine
2005/0064775 A1 3/2005 White
2005/0075017 A1 4/2005 Bistline
2005/0124238 A1 6/2005 Clutton et al.
2005/0142961 A1 6/2005 Tan
2005/0211423 A1 9/2005 Blake, Jr.
2005/0260903 A1 11/2005 Batt
2005/0272326 A1 12/2005 Hopper
2005/0287888 A1 12/2005 Balester
2006/0019559 A1 1/2006 Mair et al.
2006/0019599 A1 1/2006 Kahlman et al.
2006/0035543 A1 2/2006 English et al.
2006/0166576 A1 7/2006 Pope
2006/0178061 A1 8/2006 Caldwell
2006/0189230 A1 8/2006 Sams et al.
2007/0218788 A1 9/2007 Field
2008/0191423 A1 8/2008 Cohen
2008/0207070 A1 8/2008 Van Gelder
2008/0220672 A1 9/2008 Koelling
2008/0261470 A1 10/2008 Jones
2008/0268730 A1 10/2008 Heesterman
2009/0199375 A1 8/2009 Koelling et al.
2009/0253319 A1 10/2009 Ferru
2010/0120305 A1 5/2010 Posner et al.
2010/0136860 A1 6/2010 Jolly
2010/0159759 A1 6/2010 Graden
2010/0173546 A1 7/2010 Yeh
2010/0178820 A1 7/2010 Kumano et al.
2010/0233921 A1 9/2010 Kumano et al.
2010/0273373 A1 10/2010 Field
2010/0279563 A1 11/2010 Heard et al.
2010/0311294 A1 12/2010 Foulke
2011/0028058 A1 2/2011 Kumano
2011/0039463 A1 2/2011 Hort et al.
2011/0039464 A1 2/2011 McTavish

(56) References Cited

U.S. PATENT DOCUMENTS

| | | | |
|---|---|---|---|
| 2011/0053443 | A1 | 3/2011 | McTavish |
| 2011/0061579 | A1 | 3/2011 | Van Gelder |
| 2011/0070787 | A1 | 3/2011 | Lausman |
| 2012/0071048 | A1 | 3/2012 | Foulke |

FOREIGN PATENT DOCUMENTS

| | | | |
|---|---|---|---|
| AU | 1982084153 | | 12/1982 |
| AU | 1982084471 | | 1/1983 |
| AU | 8118387 | A | 2/1987 |
| AU | 3408893 | B | 9/1993 |
| AU | 5937394 | B | 3/1995 |
| AU | 8150294 | A | 6/1995 |
| AU | 199521660 | A1 | 6/1995 |
| AU | 4079996 | B | 4/1996 |
| AU | 2166095 | B | 5/1996 |
| AU | 21660955 | B | 5/1996 |
| AU | 1997039334 | | 4/1998 |
| AU | 199884218 | B3 | 7/1999 |
| AU | 199889534 | B3 | 7/1999 |
| AU | 2006101078 | A5 | 1/2001 |
| AU | 200197113 | A1 | 6/2002 |
| AU | 2002339239 | | 7/2003 |
| AU | 2004203516 | A1 | 2/2005 |
| AU | 2005100116 | B4 | 3/2005 |
| AU | 2004240183 | A1 | 7/2006 |
| AU | 2004240184 | A1 | 7/2006 |
| AU | 2004242515 | B2 | 7/2006 |
| AU | 2006308493 | B2 | 5/2007 |
| AU | 2009100060 | A4 | 2/2009 |
| AU | 2009203058 | A1 | 8/2009 |
| AU | 2009249940 | | 11/2009 |
| AU | 2011200169 | A1 | 3/2011 |
| AU | 2011201840 | A1 | 5/2011 |
| AU | 2013204078 | A1 | 12/2012 |
| AU | 2013204078 | | 12/2013 |
| BG | 707370 | | 11/1967 |
| BG | 888703 | | 5/1981 |
| CH | 508565 | | 11/1967 |
| CH | 674826 | A5 | 7/1990 |
| CH | 675567 | A5 | 10/1990 |
| DE | 2722547 | A1 | 11/1978 |
| DE | 3045412 | A1 | 7/1980 |
| DE | 2932750 | A1 | 3/1981 |
| DE | 2933802 | A1 | 3/1981 |
| DE | 3016927 | A1 | 11/1981 |
| DE | 3043496 | A1 | 6/1982 |
| DE | 30416927 | A1 | 6/1982 |
| DE | 3043734 | A1 | 7/1982 |
| DE | 3107896 | A1 | 9/1982 |
| DE | 3149288 | A1 | 8/1983 |
| DE | 3206057 | A1 | 9/1983 |
| DE | 3239441 | A1 | 5/1984 |
| DE | 3246126 | A1 | 6/1984 |
| DE | 3307412 | A1 | 9/1984 |
| DE | 3326894 | A1 | 2/1985 |
| DE | 3440553 | A1 | 3/1985 |
| DE | 3339686 | A1 | 5/1985 |
| DE | 3425233 | A1 | 1/1986 |
| DE | 3442921 | A1 | 6/1986 |
| DE | 34942921 | A1 | 6/1986 |
| DE | 3621933 | A1 | 1/1988 |
| DE | 3634445 | A1 | 4/1988 |
| DE | 258710 | A3 | 8/1988 |
| DE | 3729065 | A1 | 3/1989 |
| DE | 3801747 | A1 | 8/1989 |
| DE | 3922815 | A1 | 2/1990 |
| DE | 3907876 | A1 | 9/1990 |
| DE | 4038517 | A1 | 6/1991 |
| DE | 4121541 | A1 | 2/1992 |
| DE | 4122000 | C1 | 10/1992 |
| DE | 4219213 | A1 | 3/1993 |
| DE | 4332216 | A1 | 6/1994 |
| DE | 102005022015 | A1 | 11/2006 |
| DE | 102009051964 | B3 | 6/2011 |
| EP | 0310686 | A1 | 9/1987 |
| EP | 03100686 | A1 | 9/1987 |
| EP | 0476435 | A1 | 9/1991 |
| EP | 1004874 | A2 | 10/2000 |
| EP | 1044874 | A2 | 10/2000 |
| FR | 2510968 | | 2/1983 |
| FR | 2539377 | A1 | 7/1984 |
| FR | 2546243 | A1 | 11/1984 |
| FR | 2576867 | A1 | 8/1986 |
| FR | 2594785 | A1 | 11/1987 |
| FR | 2698673 | A1 | 11/1987 |
| FR | 2613312 | A1 | 10/1988 |
| FR | 2639897 | A1 | 6/1990 |
| FR | 2659931 | A1 | 9/1991 |
| FR | 2667292 | A1 | 4/1992 |
| FR | 2718705 | A1 | 10/1995 |
| FR | 2744981 | A1 | 8/1997 |
| FR | 279280 | A1 | 10/2000 |
| FR | 2792280 | A1 | 10/2000 |
| FR | 2823117 | A1 | 10/2002 |
| FR | 2882338 | A1 | 8/2006 |
| FR | 2885875 | A1 | 11/2006 |
| GB | 2010189 | A | 6/1979 |
| GB | 2227461 | A | 8/1990 |
| JP | 2003306195 | | 10/2003 |
| JP | 2005074026 | | 3/2005 |
| JP | 2005112206 | | 4/2005 |
| JP | 2006280839 | | 10/2006 |
| WO | 8201694 | A1 | 5/1982 |
| WO | 8503237 | A1 | 8/1985 |
| WO | 8504141 | A1 | 9/1985 |
| WO | 8807883 | A1 | 10/1988 |
| WO | 8809286 | A1 | 12/1988 |
| WO | 9002589 | A1 | 3/1990 |
| WO | 9013472 | A1 | 11/1990 |
| WO | 9115395 | A1 | 10/1991 |
| WO | 9117080 | A1 | 11/1991 |
| WO | 9308074 | A1 | 4/1993 |
| WO | 9531366 | A1 | 11/1995 |
| WO | 9738895 | A1 | 10/1997 |
| WO | 9746444 | A1 | 12/1997 |
| WO | 9921755 | A1 | 5/1999 |
| WO | 9944884 | A1 | 9/1999 |
| WO | 0030725 | A1 | 6/2000 |
| WO | 0030925 | A1 | 6/2000 |
| WO | 0032466 | A1 | 6/2000 |
| WO | 0132499 | A2 | 5/2001 |
| WO | 2001/070565 | | 9/2001 |
| WO | 0170565 | A1 | 9/2001 |
| WO | 0032466 | A1 | 6/2002 |
| WO | 0247971 | A1 | 6/2002 |
| WO | 03002405 | A1 | 1/2003 |
| WO | 0304203 | A1 | 5/2003 |
| WO | 03042031 | A1 | 5/2003 |
| WO | 03057559 | A1 | 7/2003 |
| WO | 03095301 | A1 | 11/2003 |
| WO | 03099650 | A1 | 12/2003 |
| WO | 2004035377 | A1 | 4/2004 |
| WO | 0132499 | A2 | 5/2004 |
| WO | 200505058 | A1 | 9/2005 |
| WO | 2005085058 | A1 | 9/2005 |
| WO | 2005105566 | A1 | 11/2005 |
| WO | 2006021029 | A1 | 3/2006 |
| WO | 2006077470 | | 7/2006 |
| WO | 2006077470 | A2 | 7/2006 |
| WO | 2006112871 | A2 | 10/2006 |
| WO | 2006123054 | A1 | 11/2006 |
| WO | 2006135256 | A1 | 12/2006 |
| WO | 2007045059 | A1 | 4/2007 |
| WO | 2007048172 | A1 | 5/2007 |
| WO | 2008006144 | A1 | 1/2008 |
| WO | 2009021267 | | 2/2009 |
| WO | 2009021267 | A1 | 2/2009 |
| WO | 2009023933 | A2 | 2/2009 |
| WO | 2009070852 | A1 | 6/2009 |
| WO | 2009076706 | A1 | 6/2009 |
| WO | 2009100479 | A1 | 8/2009 |
| WO | 2009142479 | | 11/2009 |
| WO | 2009142479 | A1 | 11/2009 |

(56) References Cited

FOREIGN PATENT DOCUMENTS

| | | | |
|---|---|---|---|
| WO | 2010022904 | A2 | 3/2010 |
| WO | 2010115242 | A1 | 10/2010 |
| WO | 2010128870 | A1 | 11/2010 |
| WO | 2011050378 | A2 | 5/2011 |

OTHER PUBLICATIONS

Speeedsurf, "MultiPlug Fitting Instructions", www.speeedsurf.com.au, Whole Document.

Declaration of Shane Partington (Dec. 15, 2016): i). Exhibit SP-1 (pp. 9-12) dated at 2008 as per statement 12 of the Declaration. ii). Futures Fin: Exhibit SP-5 (pp. 22 & 23) dated at 2003 as per statement 17 of the Declaration. iii). Speeed Fin: Exhibit SP-6 (pp. 24 & 25) dated at 2007 as per statement 19 of the Declaration. Additional photograph at statement 20.

Declaration of Jodie Cooper (Dec. 15, 2016): A number of other fins are shown in her declaration. The date of each fin is given in the accompanying statement to the respective fin photograph. Note: i). Speeed Fins at statements 12 and 13 with photographs at statement 13. ii). O'Fish'l fin at statement 14 with photograph. iii). Futures fin at statement 17 with photograph. iv). Shapers and Kinetic Fins at statement 18 with photograph.

Declaration of Bam Rae (Dec. 15, 2016): A number of other fins are shown in his declaration. The date of each fin is given in the accompanying statement to the respective fin photograph. Note: i). Futures fin at statement 10 with photograph. ii). RedX and Speeed fin shown in annexed Exhibit BR-1 and described at statements 12, 16 and 17. iii). OFish'l fin at statements 13 to 15 with a photographs at statement 14.

Boardsport Source, 2011.

Futures Fins Australia 2008 catalogue.

Future Fins Advertisement Sep. 2002.

Future Fins Advertisement Nov. 2002.

Zak Surfboards Blog Oct. 29, 2010 (accessed at http://zaksurfboards.com/future-fins/).

Hawaiian Southshore Surf News, Dec. 2010.

Video on Vimeo.com (https://vimeo.com/21305764) published Mar. 2010—screenshot from 0:20-0:22.

Pullen, Mark. "Statement of Grounds and Particulars." Sep. 17, 2016. Australia.

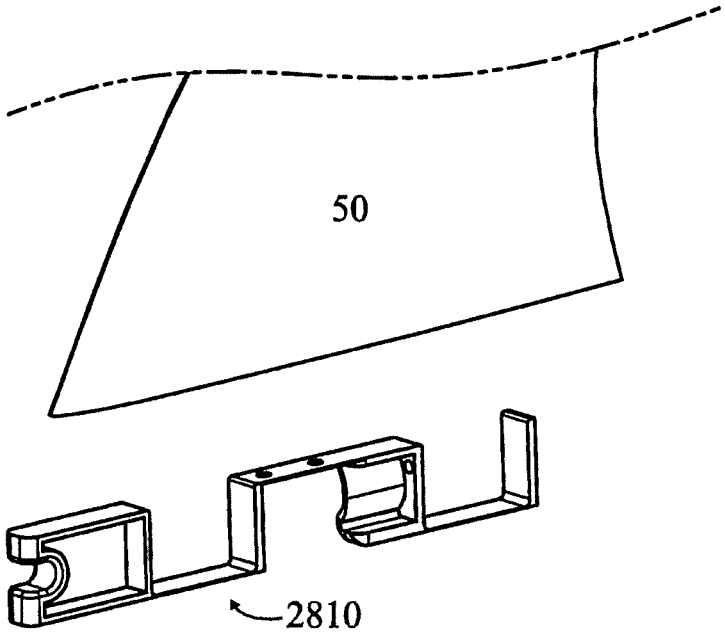
Fig 28A1
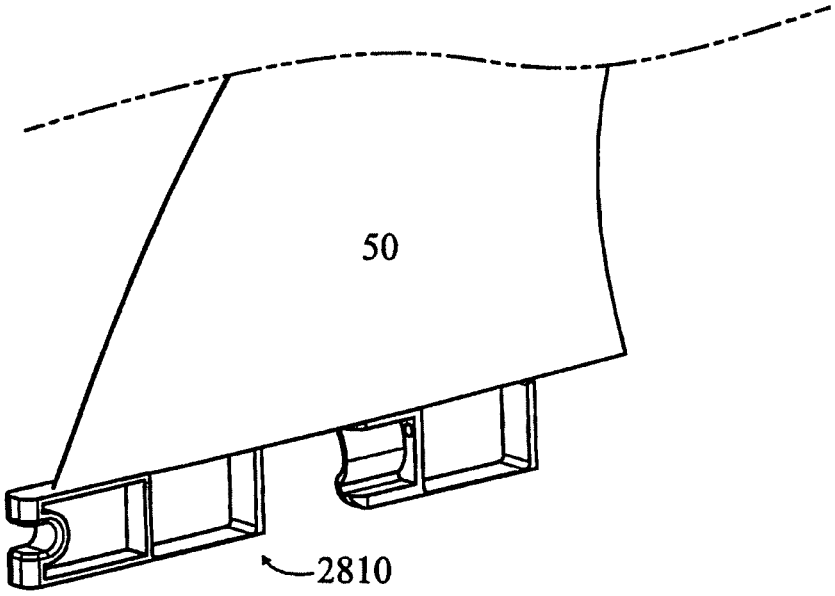
Fig 28A2

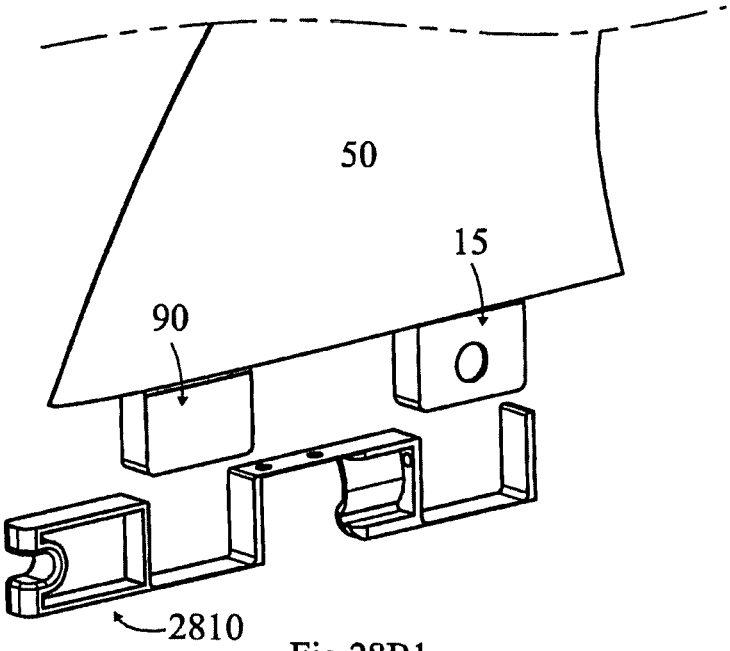
Fig 28B1
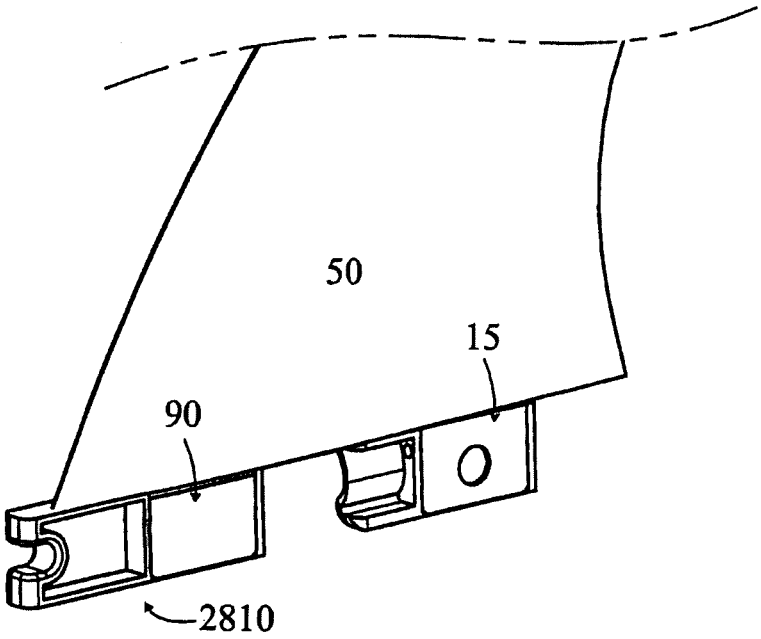
Fig 28B2

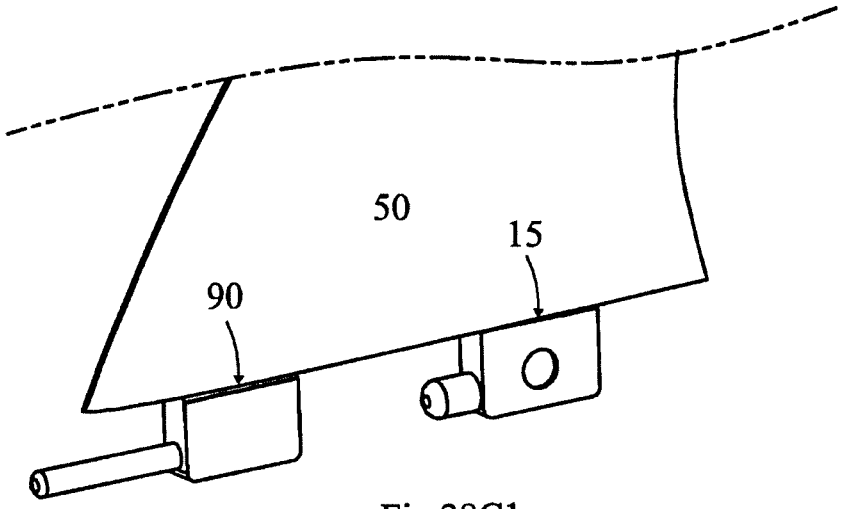
Fig 28C1
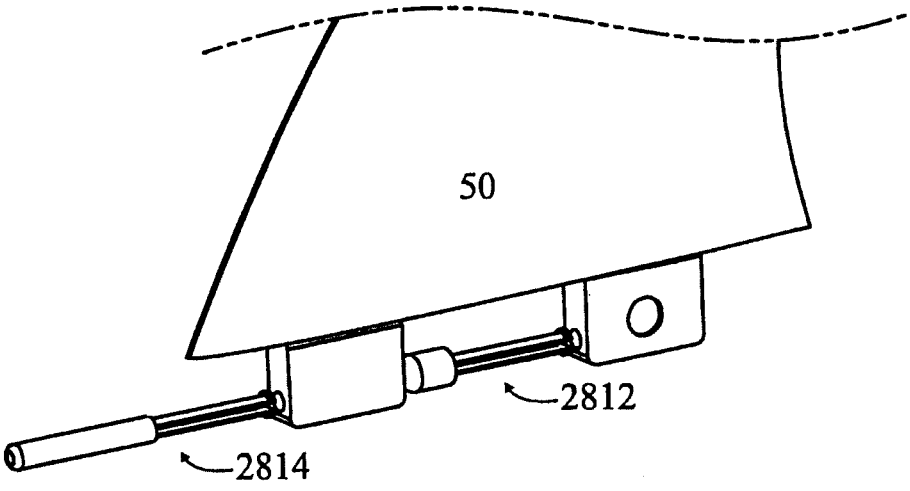
Fig 28C2

3010
3012
3014
3016

3016

3020

3110
3112
3014
3116

3118

3020

3310
3312
3314
3316
3322

3322
3318

3324
3318

3324
3322

3320

3312

3410
3412
3414
3322
3416

3322
3420

3418
3424
3426

3426
3424
3322

3420

FIN PLUG FOR WATER CRAFT

FIELD OF THE INVENTION

The present invention relates to a fin plug, for installation in a water craft, such as a surfboard or the like, adapted to enable fins to be removably attached to the water craft.

The present invention also relates to fins or other items which are adapted to be removably attached to the abovementioned fin plug.

BACKGROUND OF THE INVENTION

A water craft, such as a surfboard, particularly one on which a person stands, kneels or sits, when traversing water or riding a wave, generally has at least one fin in an underside of the water craft, generally near the tail end of the water craft. Such fins have a number of functions, including: enabling the craft to travel in a desired direction; facilitating the turning of the craft; preventing the craft from slipping sideways; and providing greater control over the movement of the craft, such as when riding a wave.

The following discussion is directed mainly to surfboards but it is to be understood that the discussion applies equally to other water craft (and surf craft) which are adapted to include fins, such as sail boards, paddle boards, rescue boards, surf skis, kayaks, and the like.

Some surfboards have fins integrally formed in the underside of the surfboard and, historically, most surfboards included such integrally formed fins. These integrally formed fins are generally 'glassed in', meaning that they are formed as part of the surfboard by means of fiber-reinforced resin. The formation of such 'glassed in' fins is quite labour intensive and it makes the subsequent sanding and finishing of the board more difficult.

In the last twenty years or so, it has become more common for surfboards to incorporate fin systems which include removable fins. Such fin systems have numerous benefits, including: enabling the fins to be removed whilst travelling; allowing damaged fins to be easily replaced; and enabling fins of different shapes or styles to be selectively used. These fin systems typically include at least one fin plug embedded in the underside of the surfboard, adapted to receive at least one surfboard fin. Each such fin plug will generally include an open cavity adapted to receive a base portion (or base element) of a surfboard fin. The fin is then able to be removably attached to the surfboard by inserting the relevant base portion (or base element) of the fin into the cavity (or cavities) of the fin plug (or fin plugs). There are numerous known fin systems which incorporate such an arrangement.

One known and commonly used fin system is described in U.S. Pat. No. 5,464,369 in the name of Fin Control Systems Pty Ltd. This system includes fins, each having two projecting base elements (or tabs) and, for each fin, two fin plugs installed in the underside of the surfboard. Each of the fin plugs has a cavity for receiving one of the base elements. Each fin plug also includes a grub screw for securing the base element within the cavity of the fin plug.

The above fin system of U.S. Pat. No. 5,464,369 has become exceedingly popular and widely used as the system enables fins to be affixed to a surfboard in a highly secure manner whilst also enabling the fins to be easily removed from the surfboard when desired. However, one drawback of the abovementioned system is that the installation and removal of fins from the fin plugs is somewhat time-consuming and requires the use of a tool (e.g. an Allen key) as the grub screws need to be threaded into or out of each cavity in order to secure or release the base elements of each fin (as desired).

Another fin plug which functions in a similar way to that described above is the fin plug assembly described in PCT/AU/2008/001132, also in the name of Fin Control Systems Pty Ltd. The fin plug described in PCT/AU/2008/001132 includes two open cavities adapted to receive corresponding base elements of a surfboard fin. These base elements are adapted to be secured and released by means of grub screws (which can be threaded into or out of the cavities). Each such grub screw is adapted to press laterally against a side of a base element of the fin to secure it in position.

Other known fin systems include systems which incorporate a single fin plug, with a single cavity, for each surfboard fin. Typically, such a fin system has quite a large fin plug with an elongated fin cavity for receiving the base element(s) of a fin. In such fin systems it is again usual for each fin to be secured to the surfboard (that is, the base element of the fin to be secured within the cavity of the fin plug) by means of a grub screw arrangement, such as that mentioned above.

There is a present need for a surfboard fin plug adapted to enable surfboard fins to be removably secured to the underside of a surfboard in a quick, easy and secure manner and preferably without the need for using a tool.

The present invention is directed towards ameliorating at least some of the above described problems associated with prior art fin plugs. More particularly, the present invention is directed towards a fin plug adapted to receive a surfboard fin which enables the fin to be easily and quickly secured to or removed from a surfboard. Even more particularly, the present invention is directed towards a fin plug, adapted to receive a surfboard fin, which enables the fin to be easily and quickly secured to or removed from a surfboard without the use of a tool.

Further, the present invention is directed towards fins or other items which are adapted to be easily and quickly secured to or removed from the abovementioned fin plugs without the use of a tool.

In this specification, where a document, act or item of knowledge is referred to or discussed, this reference or discussion is not an admission that the document, act or item of knowledge or any combination thereof was at the priority date:

a) part of the common general knowledge; or
b) known to be relevant to an attempt to solve any problem with which this specification is concerned.

Any reference herein to known prior art does not, unless the contrary indication appears, constitute an admission that such prior art is commonly known by those skilled in the art to which the invention relates, at the priority date of this application.

SUMMARY OF THE INVENTION

According to a first aspect of the present invention, there is provided a fin plug for installation in a water craft, said fin plug including:

- a first open cavity adapted to receive a base portion of a water craft fin;
- a resilient biasing rod and a protruding member cooperating with the biasing rod, said protruding member being adapted to abut the base portion of said fin when received in said first open cavity;

wherein said biasing rod and protruding member are adapted to apply a force to the base portion of said fin to inhibit removal of said fin from said first open cavity.

The biasing rod is preferably located adjacent the first open cavity. The biasing rod generally extends substantially parallel to a side surface of the base portion of said fin. It is preferred that the orientation of the biasing rod is also substantially parallel to the plane of the water craft.

The biasing rod may be formed of any suitable material, such as titanium, steel (e.g. marine grade steel), fiberglass, carbon fibre or plastic (including reinforced engineering plastic). It is particularly preferred that the biasing rod is formed of titanium.

The protruding member is preferably adapted to abut the side surface of the base portion of said fin.

It is preferred that the fin plug further includes a lateral cavity and said biasing rod is located within said lateral cavity. The lateral cavity typically includes a lateral opening positioned in a side of said fin plug. It is preferred that this lateral opening is sealed (at least prior to installation in the water craft).

Preferably, the lateral cavity and the first open cavity are separated by an internal wall. It is preferred that the internal wall is an apertured wall and a portion of said protruding member protrudes through an aperture in said wall into said first open cavity.

In an alternative embodiment, the protruding member may be formed on the internal wall and said protruding member cooperates with the biasing rod and is adapted to abut the base portion of said fin when received in said first cavity.

In a particularly preferred embodiment, the side surface of the base portion of said fin includes an inclined surface section, said inclined surface section being adapted to co-operate with the protruding member so as to cause a force, inwardly into said first open cavity, to be applied to said base portion under the influence of said biasing rod.

The fin plug will typically have a forward region and a rearward region and it will preferably include additional fin removal inhibiting means located in said forward region. Preferably, the protruding member is located in the rearward region.

The additional fin removal inhibiting means preferably includes fin engagement means. The fin engagement means preferably includes a ledge portion adapted to overlie a fin section of said fin and to inhibit movement of said fin when the base portion of said fin is received within the first open cavity.

It is particularly preferred that the fin plug includes a second open cavity, wherein the first open cavity is adapted to receive a first tab of the base portion of said fin and the second open cavity is adapted to receive a second tab of the base portion of said fin.

Preferably, the first open cavity is located in the rearward region and the second open cavity is located in the forward region of said fin plug.

The inclined surface section of the base portion is preferably located on the first tab.

The ledge portion is preferably located within said second open cavity. Preferably, this ledge portion includes a ledge extending from one end of said second open cavity and defining a recess between said ledge and a base surface of said second open cavity, said recess being adapted to receive the fin section.

Accordingly, it is preferred that the fin section of the water craft fin is located on the second tab of the base portion of said fin.

In a particularly preferred embodiment, the protruding member is a ring-shaped member located about said biasing rod. Preferably, this ring-shaped member is adapted to rotate about said biasing rod. The ring-shaped member preferably has a circumferential outer surface extending between two side surfaces, said circumferential outer surface having a convex profile between said side surfaces. This convex profile enables the load or force, which is applied to the ring-shaped member when it engages with the base portion or the first tab of the water craft fin, to be dispersed more evenly across the ring shaped member.

The ring-shaped member is typically formed of a durable, non corrosive polymer/plastic material (although a number of other suitable materials could be used). Acetal is a particularly preferred material for the ring-shaped member. Acetal is a common term for a comparatively hard engineering plastic with high tensile strength, suitable for machining and high rigidity in use.

The fin plug may also include a grub screw adapted to extend into said first open cavity and to further secure the base portion of said fin within said first open cavity. The fin plug may also include a further grub screw adapted to extend into said second open cavity and to further secure the second tab of the base portion of said fin within said second open cavity. A benefit of having one or more grub screws in the fin plug is so that some existing water craft fins, which are made to be received within existing fin plugs, may also be received and secured by the fin plug of the present invention.

It is preferred that the first open cavity and the second open cavity of the fin plug are separated by a bridge section having an upper surface which is adapted to abut a lower surface of the water craft fin. This bridge section enhances the rigidity and/or strength of the fin plug. Also, by abutting the lower surface of the water craft fin, this bridge section prevents the lower surface of the fin from being forced down against other surfaces of the fin plug and/or the water craft (which could over time cause some damage to the fin, the fin plug and/or the surfboard).

Typically, the fin plug of this invention will be installed within a surfboard, such as a stand-up surfboard.

According to a second aspect of the present invention, there is provided a water craft fin having a base portion adapted to be received within an open cavity of a fin plug according to the first aspect of this invention (as described above).

The base portion of the water craft fin preferably includes a side surface adapted to abut the protruding member of said fin plug. The side surface preferably includes an inclined surface section adapted to cooperate with the protruding member so as to cause a force, inwardly into said open cavity, to be applied to said base portion under the influence of the biasing rod of said fin plug.

Preferably, the base portion of the water craft fin further includes a fin section adapted to underlie the ledge portion of said fin plug and to inhibit movement of said fin when the base portion of said fin is received within the first open cavity.

The base portion of the water craft fin preferably includes a first tab and a second tab and the fin plug preferably includes a first open cavity and a second open cavity, wherein the first tab is adapted to be received within said first open cavity and the second tab is adapted to be received within said second open cavity.

It is preferred that the inclined surface section of the base portion of the water craft fin is located on the first tab.

It is further preferred that the fin section of the base portion of the water craft fin is located on the second tab.

The water craft fin preferably includes a lower surface adapted to abut an upper surface of the bridge section of the fin plug.

Typically, the water craft fin described above will be adapted for use in a surfboard.

According to a third aspect of this invention, there is provided fin plug and a water craft fin kit, for use in a surfboard, including a fin plug as described above and a water craft fin as described above.

According to a fourth aspect of the present invention, there is provided a water craft attachment device having a base portion adapted to be received within an open cavity of a fin plug according to the first aspect of this invention (as described above).

The base portion of the water craft attachment device preferably includes a side surface adapted to abut the protruding member of said fin plug. The side surface preferably includes an inclined surface section adapted to cooperate with the protruding member (of the fin plug) so as to cause a force, inwardly into said open cavity, to be applied to said base portion under the influence of the biasing rod of said fin plug.

Preferably, the base portion of the water craft attachment device further includes a nose section adapted to underlie the ledge portion of said fin plug and to inhibit movement of the water craft attachment device when the base portion of said attachment device is received within the first open cavity.

The base portion of the water craft attachment device preferably includes a first tab and a second tab and the fin plug preferably includes a first open cavity and a second open cavity, wherein the first tab is adapted to be received within said first open cavity and the second tab is adapted to be received within said second open cavity.

It is preferred that the inclined surface section of the base portion of the water craft attachment device is located on the first tab.

It is further preferred that the nose section of the base portion of the water craft attachment device is located on the second tab.

In a particularly preferred embodiment, the water craft attachment device includes a support connecting element for connecting the attachment device to a support structure. This support connecting element may include a hook element for connecting the water craft attachment device to a support rod (e.g. a horizontal support rod). The support connecting element, such as a hook element, is preferably separated from the base portion of the water craft attachment device by an intermediate section of the attachment device.

In a further, particularly preferred embodiment of this aspect of the invention, the hook element lies in a plane which is at right angles to the plane of the first and second tabs.

The water craft attachment device preferably includes a lower surface adapted to abut an upper surface of the bridge section of the fin plug.

Typically, the water craft attachment device described above will be adapted for use in a surfboard.

The above preferred embodiment of the fourth aspect of the present invention enables a water craft attachment device, which includes a hook element, to be attached to a surfboard (or other water craft), which then enables the surfboard (or other water craft) to be suspended from a supporting rod (e.g. a horizontal support rod). In the above-mentioned preferred embodiment, in which the hook element lies in a plane which is at right angles to the plane of the first and second tabs, this enables a multitude of surfboards to be suspended from the supporting rod in a sandwiched formation, thereby enabling a greater number of surfboards to be stored on the supporting rod.

As will be appreciated from the above discussion (and as further explained and illustrated later in this specification), a water craft fin or other water craft attachment device, according to the above relevant descriptions, can readily be attached to a fin plug, according to the above relevant description.

This attachment is effected, in the case of a water craft fin, by inserting the base portion of the fin into the first open cavity of the fin plug. This is typically achieved by engaging a forward portion of the fin (e.g. the fin section) with the fin engagement means of the fin plug and then rotating a rearward portion of the fin down towards the fin plug, so that the base portion of the fin extends into the relevant open cavity, thereby enabling this base portion to abut the protruding means which protrudes into said cavity.

In the case of another water craft attachment device, such as a hook element (as described above), the attachment is effected by inserting the base portion of the attachment device into the first open cavity of the fin plug. This is typically achieved by engaging a forward portion of the attachment device (e.g. the nose section of the base portion of the water craft attachment device) with the fin engagement means of the fin plug and then rotating a rearward portion of the attachment device down towards the fin plug, so that the base portion of the attachment device extends into the relevant open cavity, thereby enabling this base portion to abut the protruding means which protrudes into said cavity There is provided herein a device for holding a first fin portion in a water craft, the device including: a first cavity having a cavity wall; and, a resilient elongate member located at least partially along an elongate side of the cavity wall, the resilient elongate member having an extending portion, the extending portion extending from the resilient member through a recess in the elongate side of the cavity wall, wherein the first fin portion is configured to be inserted into the first cavity such that any one or a combination of the resilient elongate member and the extending portion apply a force to the first fin portion to hold the first fin portion within the first cavity.

The resilient elongate member can be a resilient rod and the extending portion includes a bulbous portion, the bulbous portion being configured to engage with the first fin portion.

The bulbous portion can be part of a wheel-like member formed around the elongate rod, the wheel-like member being configured to rotate about the rod when engaging with the first fin portion, during installation and/or removal of the fin/first fin portion, and to hold the first fin portion in the first cavity once the fin/first fin portion is installed.

The first fin portion can include a grooved portion (or an inclined portion) on a side fin surface, the grooved portion (or inclined portion) being configured to engage with the extending portion.

A surface of the wheel-like member can be is configured to sit within the grooved portion (or against the inclined portion).

The device can include a second cavity, the second cavity including a protrusion, the protrusion being configured to be received by a corresponding recess of a second fin portion, to thereby hold the second fin portion within the second cavity.

Any one or a combination of the protrusion and the recess and, the extending portion and the first fin portion can snap-lock together.

The first cavity and the second cavity can be part of one elongate cavity.

The first cavity and the second cavity can be two distinct cavities formed within the device.

The first fin portion and the second fin portion can be first and second tabs, respectively, the first and second tabs protruding from a base portion of the fin.

The device can be shaped so as to have a substantially figure-eight profile.

The first cavity can be formed within a first end of the figure-eight and the second cavity is formed within a second end of the figure-eight.

The device can be integral to the water craft. Alternatively, the device can be a stand-alone product which can be installed within a water craft during the manufacture of the craft.

Thus, the device can be insertable into the water craft as a separate device.

A device and fin assembly, the device being the device or fin plug described herein, and being configured to hold a fin.

- A compatibility infill adapted to be received within a cavity of a fin plug with a water craft fin as described herein.
- A full plug infill adapted to be received within a cavity of a fin plug as described herein.
- A compatibility infill for installation in a fin plug of a water craft, the compatibility infill including: a front surface profile adapted to a fin engagement means of the fin plug, a rear surface profile adapted to engage with a front tab of a fin, an exterior surface, and a material being in part at least deformable.
- A full plug infill for installation in a fin plug of a water craft, the full plug infill including: an exterior surface, at least one vertical member, and a material being in part at least deformable.
- A compatibility infill substantially as hereinbefore described with reference to any one of FIGS. 30A to 32E.
- A full plug infill substantially as hereinbefore described with reference to any one of FIGS. 33A to 35C.

It will be appreciated that the features described herein can be provided in the device described herein either independently or in different combinations.

BRIEF DESCRIPTION OF THE DRAWINGS

A detailed description of a preferred embodiment of a device/fin plug according to the first aspect of this invention is given hereinafter, while referring to the following figures:

FIG. 1B shows the tangent edges with dashed lines.

FIGS. 28A1 to 28A2 are an example adaptor for use with the device/fin plug discussed herein.

FIGS. 28B1 to 28B2 are an example adaptor for use with the device/fin plug discussed herein.

FIGS. 28C1 to 28C2 are an example adaptor for use with the device/fin plug discussed herein.

DETAILED DESCRIPTION OF THE EMBODIMENT OR EMBODIMENTS

Figure 1A:
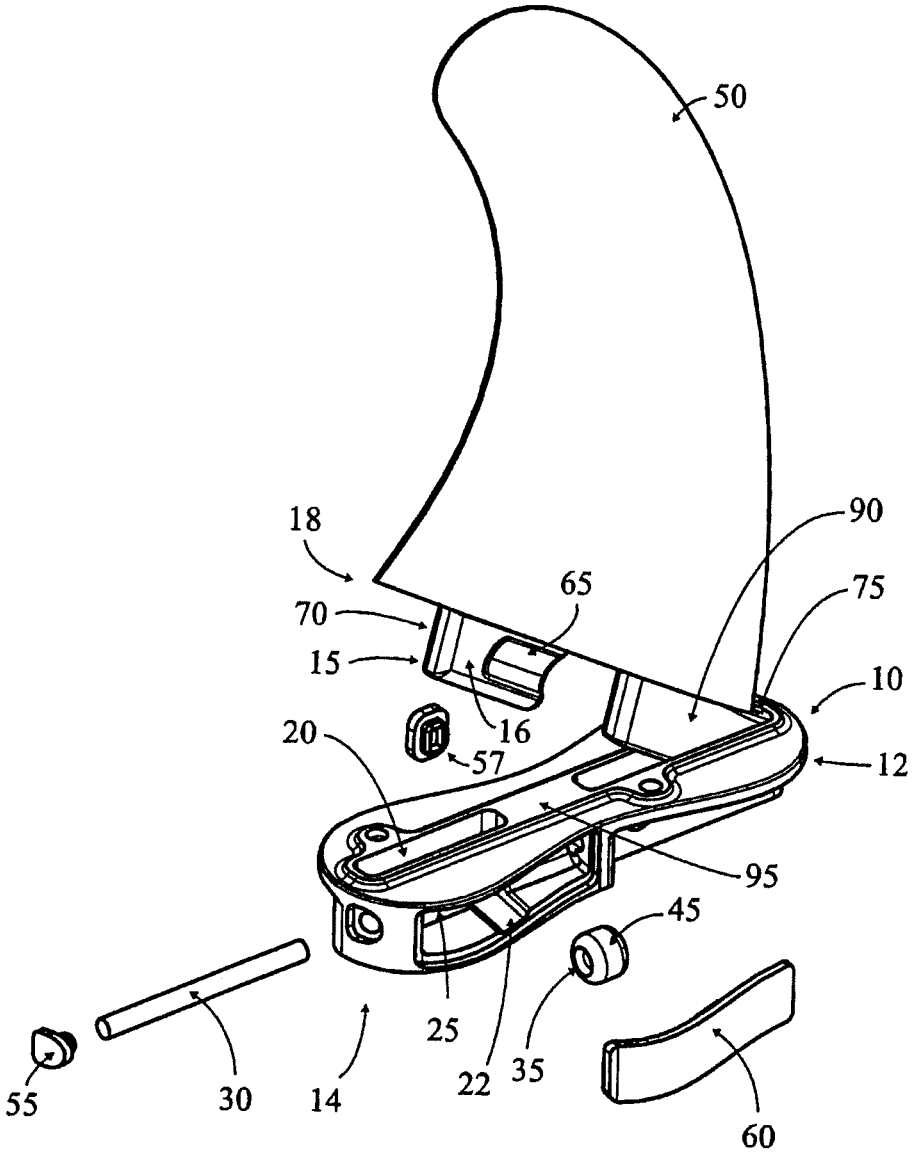
FIGS. 1A and 1B are perspective (exploded) views of an example fin and fin plug assembly.
Figure 1B:
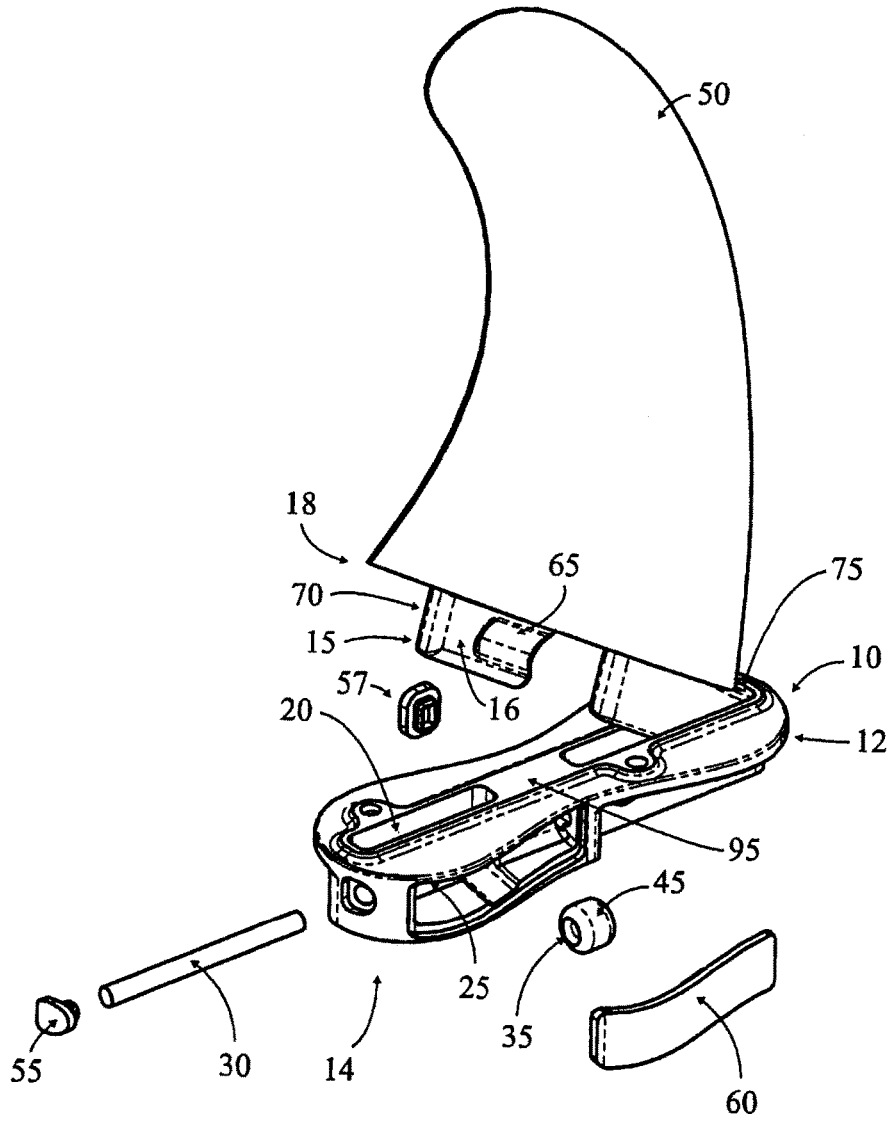

An example of a device or fin plug 10 is shown in FIGS. 1A and 1B.

In this particular example, the device 10 is used for holding a first fin portion 15 in a water craft, such as a surfboard or the like (not shown). The device 10 can be formed such that it is integral or insertable into the water craft.

As shown in FIGS. 1A and 1B, the device 10 can include a first cavity 20, having a cavity wall 25 (and further described below). The device 10 also includes a resilient elongate member 30, which can be located at least partially along an elongate side of the cavity wall 25. FIG. 1 also shows that the resilient elongate member 30 can have an extending portion 35, where the extending portion 35 extends from the resilient member 30 through a recess 40 or aperture in the elongate side of the cavity wall 25, Accordingly, when the first fin portion 15 is inserted into the first cavity 20, any one or a combination of the resilient elongate member 30 and the extending portion 35 can apply a force to the first fin portion 15 to hold the first fin portion 15 within the first cavity 20.

Thus, in one particular example, the resilient elongate member 30 is a resilient rod or pin, and the extending portion 35 can includes a bulbous portion 45, where the bulbous portion 45 is configured to engage with the first fin portion 15. In yet a further example, the bulbous portion 45 can be a part of a wheel-like member formed around the elongate rod 30, where the wheel-like member 35 is configured to move around the rod 30 when engaging with the first fin portion 15, to hold the first fin portion 15 in the first cavity 20.

FIGS. 1A and 1B, for example, show that the rod 30 is a pin, or the like, which can act as a spring to allow the wheel-like member 35, to act as a barrel, which can hold the fin 50 in place. Thus the device 10 can be in the form of a box which can hold the fin and hold the pin in place. FIG. 1 also shows that once the rod 30 is inserted into the device 10, the insertion can be sealed by a end plug 55, or the like. The plug 55 can prevent the rod 30 moving out of the device 10.

Additionally, FIGS. 1A and 1B also show that the device 10 can include one or more caps 55, 57, 60, which can be used to seal the extending portion 35 into the device 10. In one particular example, the end cap 55 is typically water tight and can hold both the rod 30 and the extending portion 35 therein. The side cap 57 can be optional, the rod 30 and the extending portion 35 can be installed without the use of an aperture that side cap 57 seals.

According to yet a further example, the first fin portion 15 can also include a grooved portion 65 on a side fin surface 70. The grooved portion 65 is typically configured to engage with the extending portion 35. Thus, in one example, a surface of the wheel-like member 35, which is typically a curved surface, is configured to site within the grooved portion 65.

It will be appreciated that although the grooved portion 65 can be formed or shaped such that it substantially conforms or mates with the curved surface of the extending portion 35, strict conformance or mating is not necessary. In these examples, the grooved portion 65 is configured to roll over the extending portion 35 and the extending portion 35 can then lock the first fin portion 15 into the first cavity 20. It will also be appreciated that when the locking action occurs and the first fin portion 15 is pushed into the cavity, the rod 30 may bend and may remain slightly bent when applying the force to the extending portion 35, which subsequently applies a force to the grooved portion 65, in order to maintain the first fin portion 15 within the first cavity 20. In one particular example, either a lateral or a downward force, or a combination thereof can be applied to maintain the first fin portion 15 within the device 10.

According to one particular example, when inserting the fin 50 into the device 10, a second fin portion 90 is inserted initially, where the recess 85 on the second fin portion 90 engages with the protrusion 80 on the device 10 (within the second cavity 75). Once the second fin portion 90 is in place, the first fin portion 15 is locked into the first cavity 20 by pushing down on the fin 50 such that the groove 65 engages with the extending portion 35, which is at least partially within the first cavity 20.

Thus, in a further example, referring to FIGS. 1A and 1B, there is provided herein a fin plug 10 for installation in a water craft (not shown), said fin plug 10 including a first open cavity 20 adapted to receive a base portion 18 of a water craft fin 50; and, a resilient biasing rod 30 and a protruding member (otherwise referred to herein as an extending portion) 35 cooperating with the biasing rod 30. The protruding member 35 is adapted/configured to abut the base portion 18 of said fin 50 when received in said first open cavity 20. Accordingly, the biasing rod 30 and protruding member 35 are adapted to apply a force to the base portion 18 of said fin 50 to inhibit removal of said fin 50 from said first open cavity 20.

As shown in FIGS. 1A and 1B, the biasing rod 30, when inserted into the fin plug 10 is located adjacent the first open cavity 20. According to one particular example, the biasing rod 30 extends substantially parallel to a side surface 16 of the base portion 18 of the fin 50. Thus, the protruding member 35 can abut the side surface 16.

It will further be appreciated that the fin plug 10 can also include a lateral cavity 22 where the biasing rod 30 is located within the lateral cavity 22. Thus, the lateral cavity 22 and the first open cavity 20 are separated by an apertured wall (herein referred to as the cavity wall) and at a portion of the protruding member 35 protrudes through an aperture (or recess) 40 in the wall 25 into the first open cavity 20.

The side surface 16 can include an inclined surface section (otherwise described herein as a grooved portion) 65. The inclined surface section 65 is adapted to cooperate with the protruding member 35 so as to cause a force, inwardly into the first open cavity 20 to be applied to the base portion 18 under the influence of the biasing rod 30.

According to one particular example, the fin plug 10 can have a forward region 12 and a rearward region 14. The protruding member 35 is typically located in the rearward region 14.

The fin plug 10 can include an additional fin removal inhibiting means located in the forward region 12. The fin removal inhibiting means can include a fin engagement means which includes a ledge portion (referred to herein as the protrusion) 80 which is adapted to overlie a fin section (referred to herein as the recess) 85 and to inhibit movement of the fin 50 when the base portion 18 is received within the first open cavity 20.

As described herein, the fin plug 10 can include a second open cavity 75. Accordingly, the first open cavity 20 can receive a first tab of the base portion 18 of the fin 50 and the second open cavity 75 can receive a second tab of the base portion 18 of the fin 50. In this particular example, the first open cavity 20 is located in the rearward region 14 and the second open cavity is located in the forward region 12. And further, the inclined surface section 65 of the base portion of said fin is located on the first tab. Additionally, the ledge portion 80 can be located within said second open cavity, and the fin section can be located on the second tab of the base portion of the fin 50.

As shown in FIGS. 12A to 12H, the ledge portion can include a ledge extending from one end of said second open cavity and defining a recess between said ledge and a base surface of said second open cavity, said recess being adapted to receive the fin section.

As discussed herein, the extending portion/protruding member 35 can be wheel-like or a ring-shaped member located about the biasing rod 30. In one particular example, the ring-shaped member can rotate about said biasing rod. In yet a further example, the ring-shaped member does not necessarily have to be cylindrical in shape and may have a circumferential outer surface extending between two side surfaces, where the circumferential outer surface has a convex profile between said side surfaces.

In yet a further example, as particularly shown in FIGS. 2A, 3A, 4A, 4F, 5A, and 5F, the device 10 can also include a second cavity 75. The second cavity 75 can include a protrusion 80, where the protrusion 80 is configured to be inserted into and mate with a respective recess 85 of a second fin portion 90, to thereby hold the second fin portion 90 within the second cavity 75.

Thus, for example, any one or a combination of the protrusion 80 and the recess 85; and, the extending portion 35 and the first fin portion 15 can snap-lock together, and the fin 50 can be held robustly within the device 10.

Notably, it will be appreciated by persons skilled in the art that the second fin portion 90 can be held within the second cavity 75 by a number of different mechanical elements/fixing means. Further examples of fixing means for fixing/holding the second fin portion 90 into a second cavity 75 are described below.

In the examples shown in the Figures, the first cavity 15 and the second cavity 75 are two distinct cavities within the device 10. However, it will be appreciated that they may in some instances form a part of one elongate cavity (not shown). Notably, certain advantages may be provided by maintaining the two distinct cavities. That is, the bridge 95 between the two cavities can be configured to more robustly hold the first and second fin portions 15, 90 in respective first and second cavities 20, 75. Furthermore, the bridge can include a bridge section which has an upper surface which is adapted to abut a lower surface of a water craft fin.

It will be appreciated by persons skilled in the art that many water crafts such as surfboards or the like can include one or more fins. In one particular example, a surfboard may include a central fin and two side fins (referred to herein as left and right fins, when viewing the underside of the surfboard with tail of the surfboard lowermost). Thus, although the features described herein may be applicable to any fin, the water craft may include slight variations depending on the location of the fin (whether a central fin, right fin, or left fin).

Figure 2A:
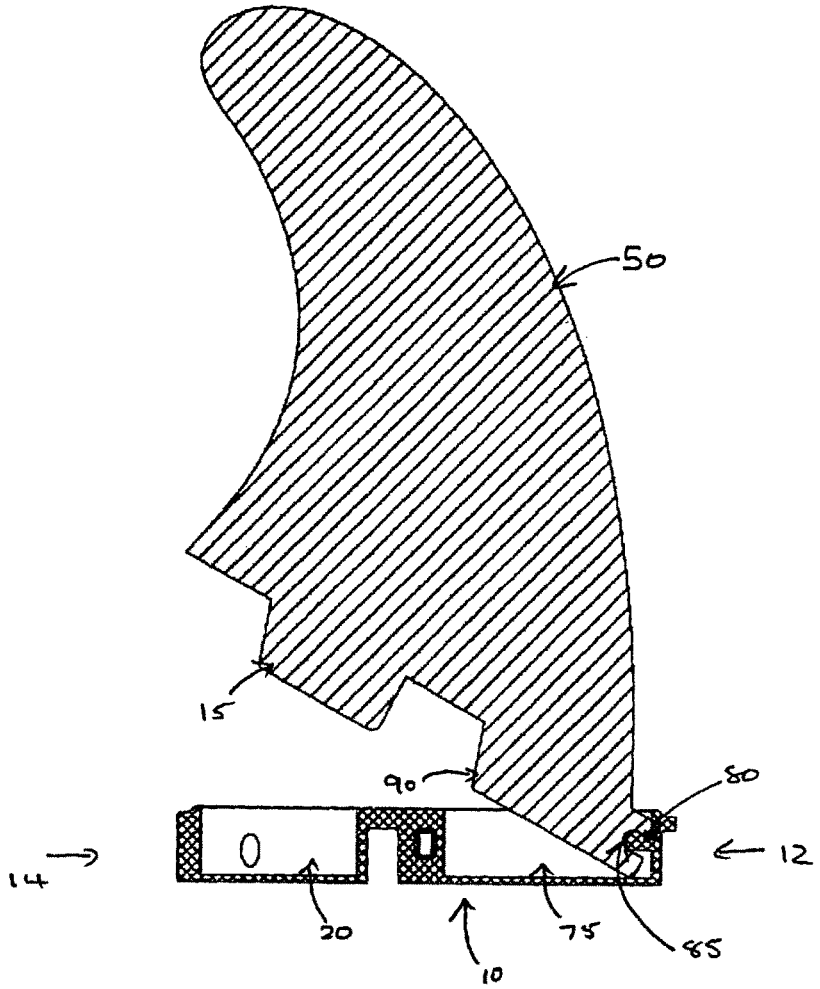
FIG. 2A is a side cross-sectional view of an example centre fin and fin plug assembly.
Figure 2B:
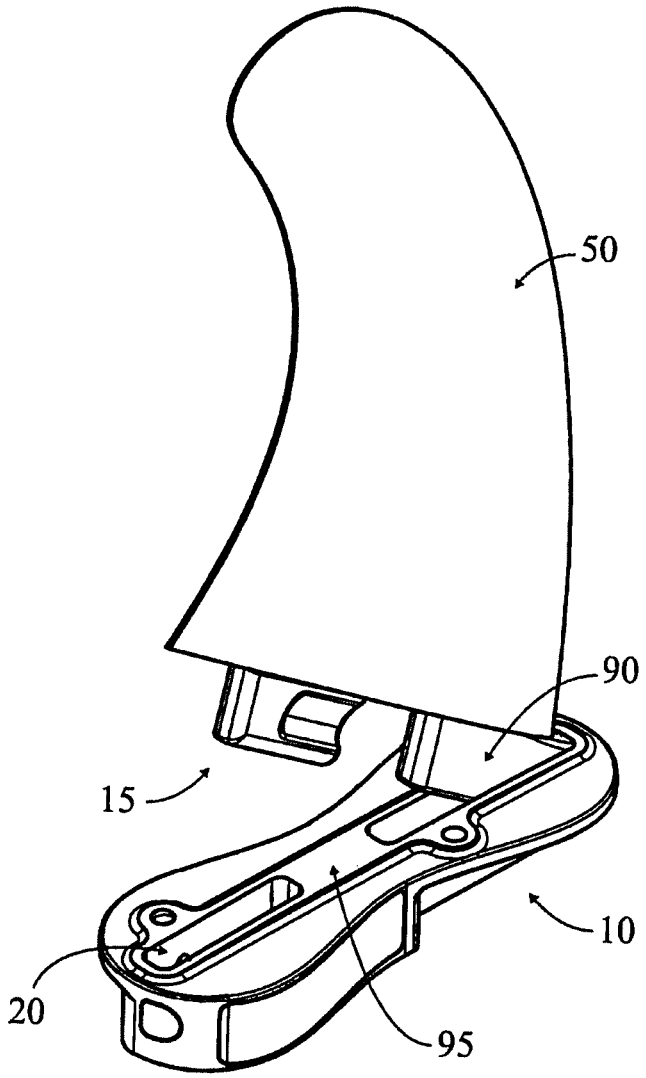
FIG. 2B is a perspective view of the fin and fin plug assembly of FIG. 2A.
Figure 2C:
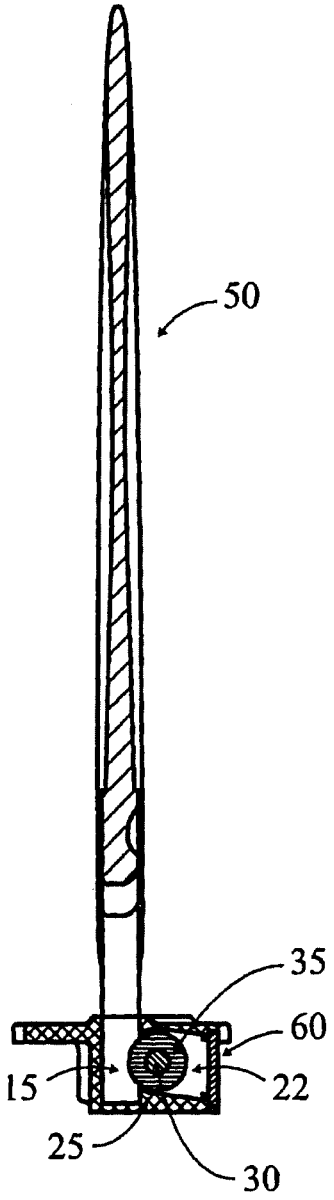
FIG. 2C is a cross-sectional front view of the fin and fin plug assembly of FIG. 2A.
Figure 2D:
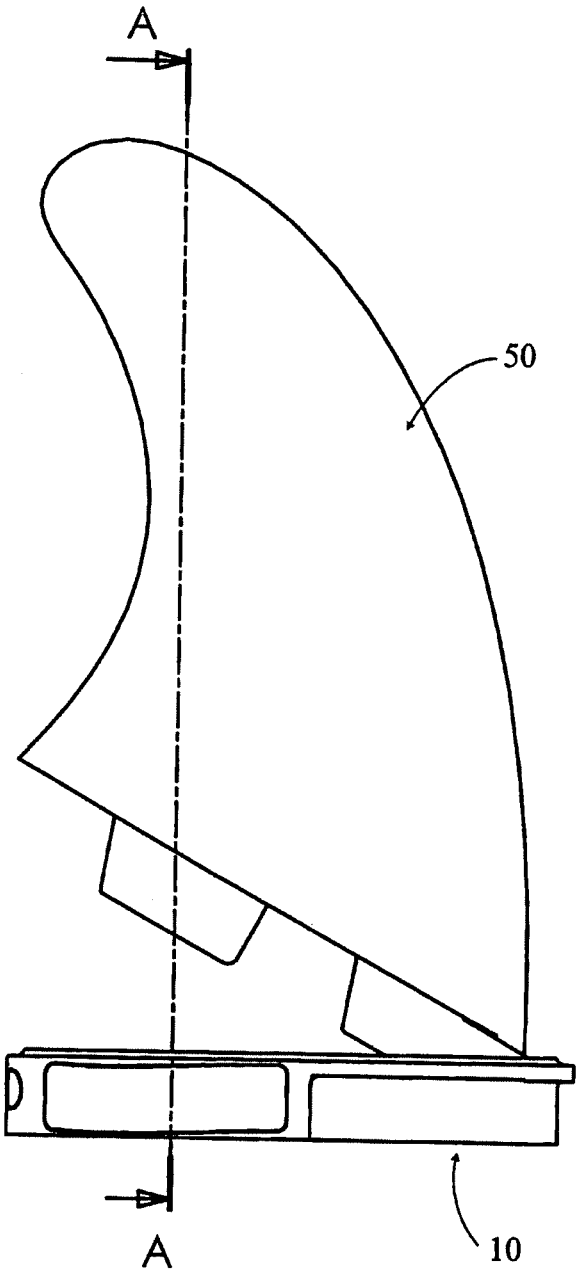
FIG. 2D is a side view of the fin and fin plug assembly of FIG. 2A.
Figure 2E:
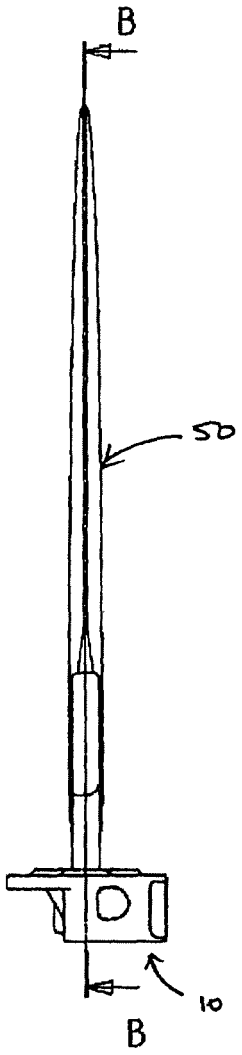
FIG. 2E is front view of the fin and fin plug assembly of FIG. 2A.
Figure 2F:
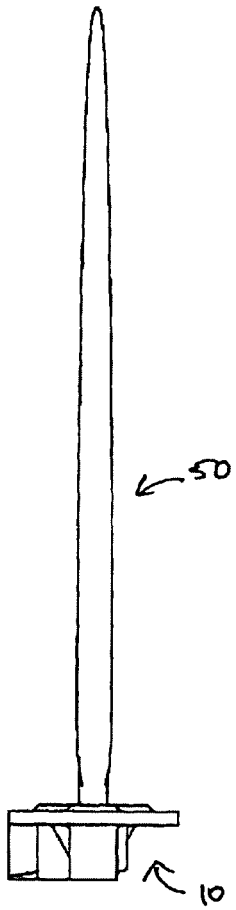
FIG. 2F is a back view of the fin and fin plug assembly of FIG. 2A.
Figure 2G:
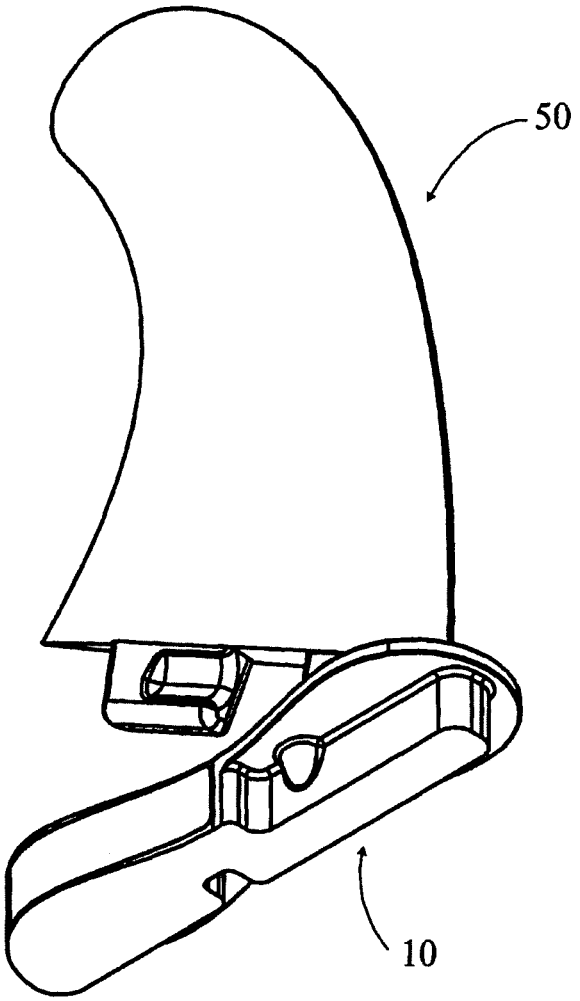
FIG. 2G is an underneath perspective view of the fin and fin plug assembly of FIG. 2A.
Figure 2H:
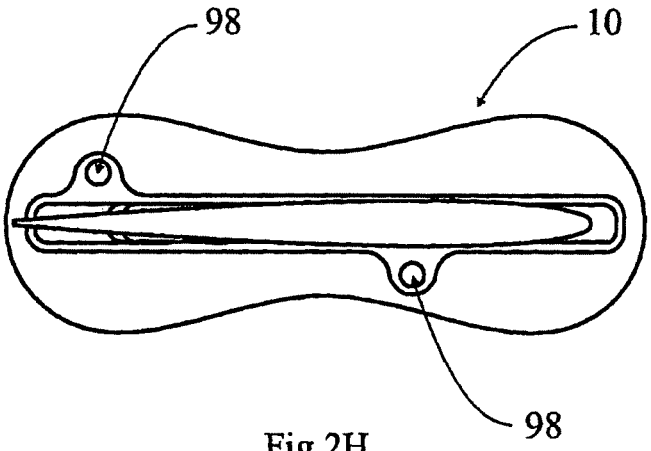
FIG. 2H is a top view of the fin and fin plug assembly of FIG. 2A.
Figure 2I:
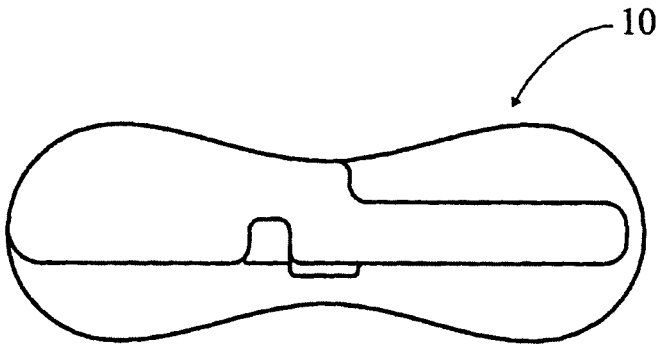
FIG. 2I is a bottom view of the fin and fin plug assembly of FIG. 2A.
Figure 3A:
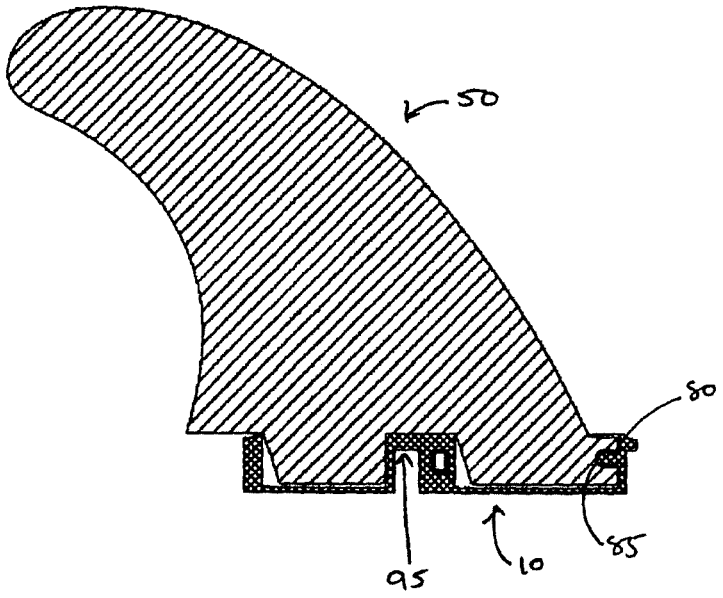
FIG. 3A is a side cross-sectional view of the fin and fin plug assembly of FIG. 2A, when the fin has been inserted into the device.
Figure 3B:
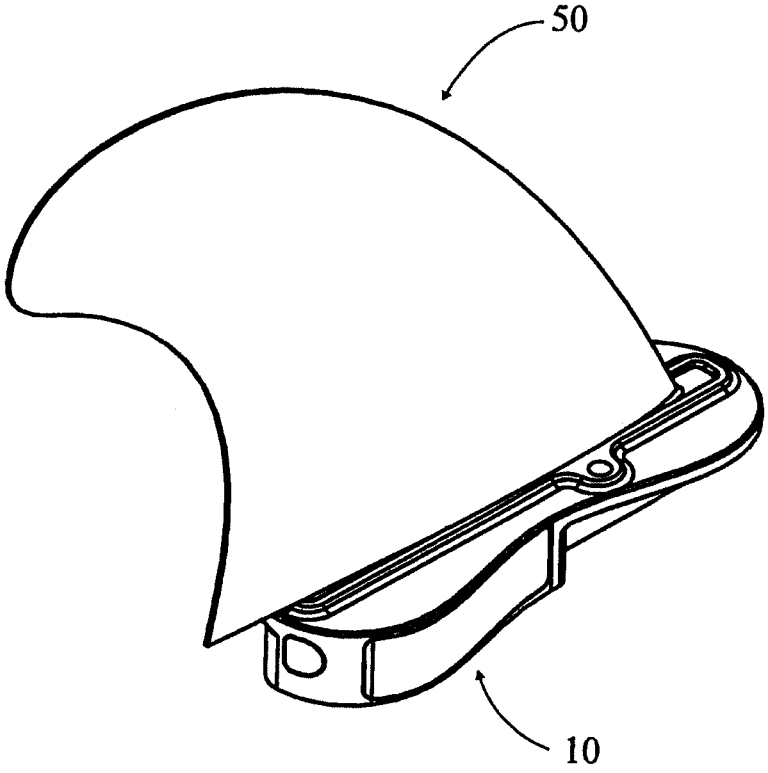
FIG. 3B is a top perspective view of the fin and fin plug assembly of FIG. 3A.
Figure 3C:
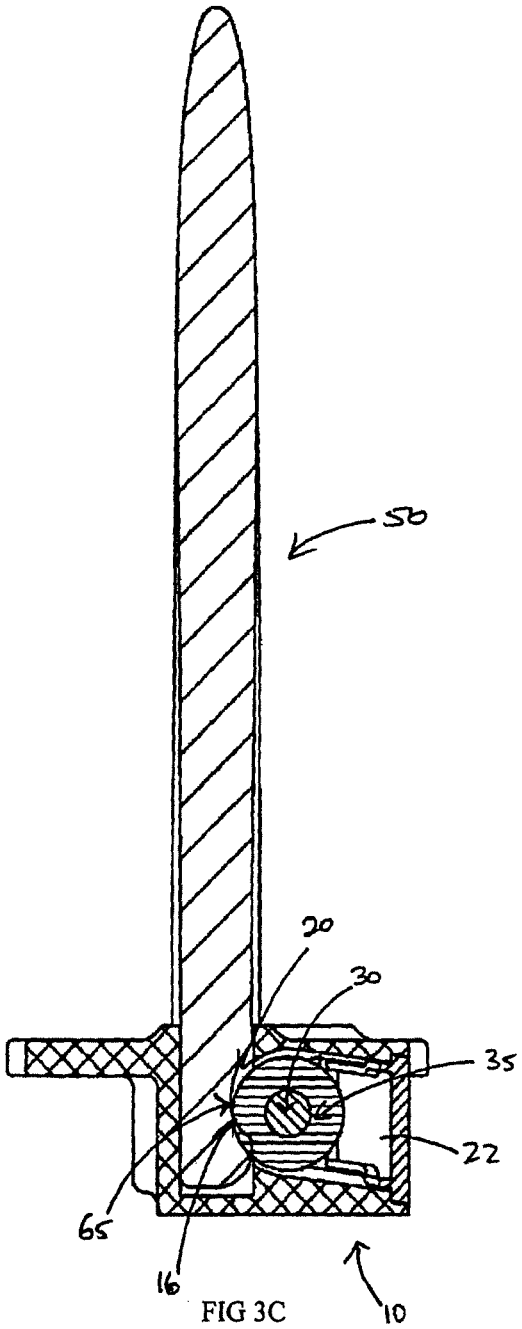
FIG. 3C is a front cross-sectional view of the fin and fin plug assembly of FIG. 3A.
Figure 4A:
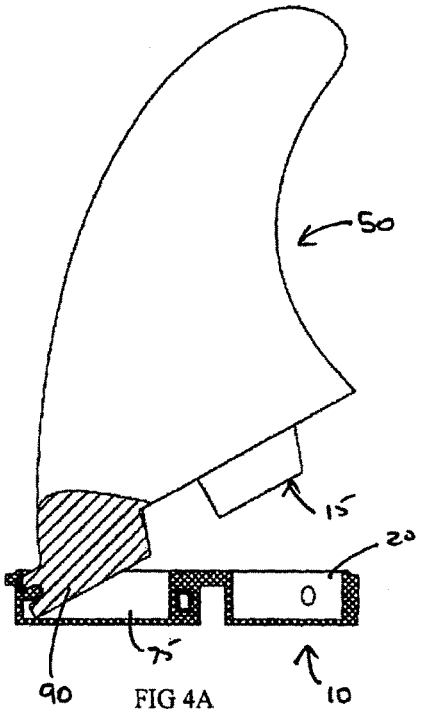
FIG. 4A is a side cross-sectional view of an example right-side the fin and fin plug assembly.
Figure 4B:
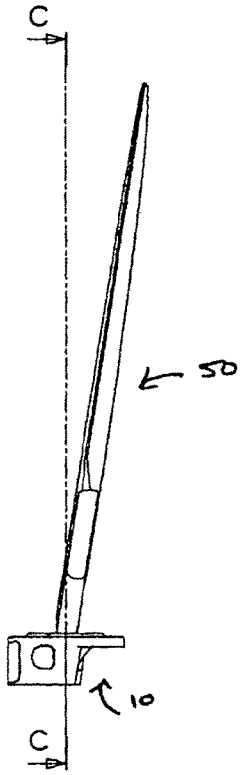
FIG. 4B is a back view of the fin and fin plug assembly of FIG. 4A.
Figure 4C:
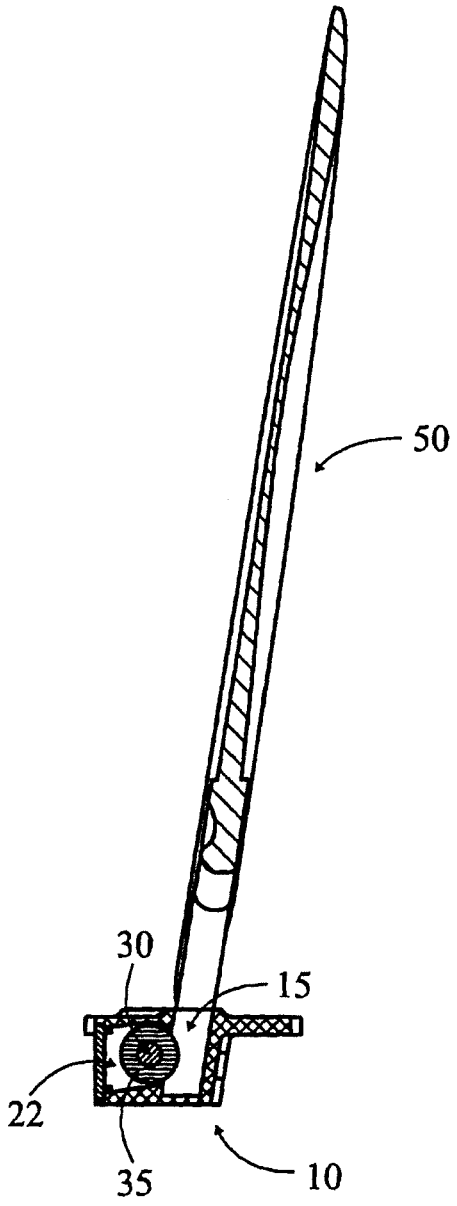
FIG. 4C is a cross-sectional front view of the fin and fin plug assembly of FIG. 4B along the line C-C.
Figure 4D:
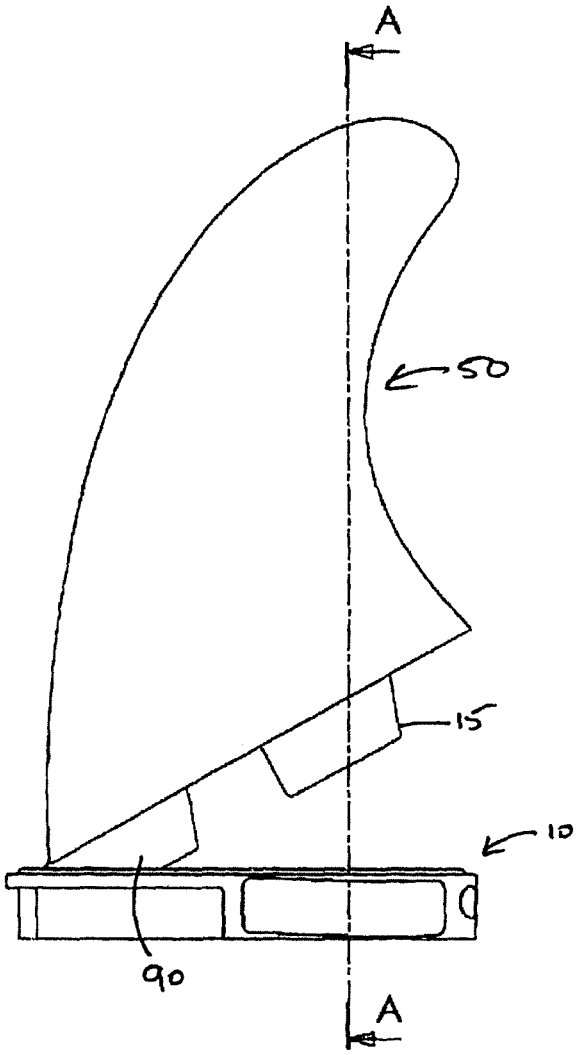
FIG. 4D is a side view of the fin and fin plug assembly of FIG. 4A.
Figure 4E:
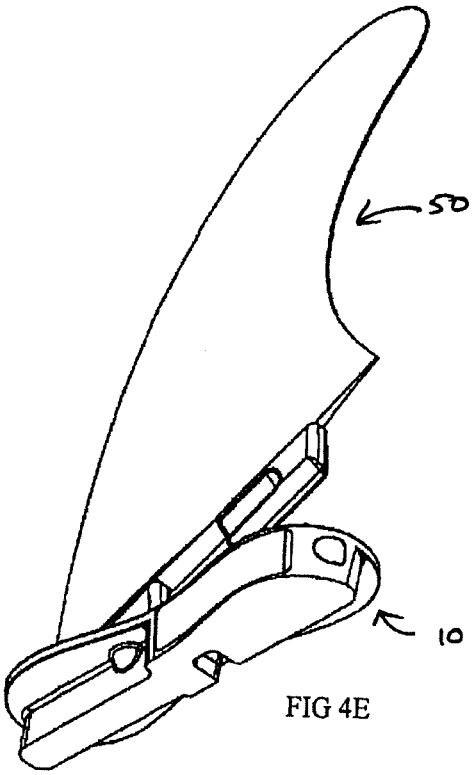
FIG. 4E is a bottom perspective view of the fin and fin plug assembly of FIG. 4A.
Figure 4F:
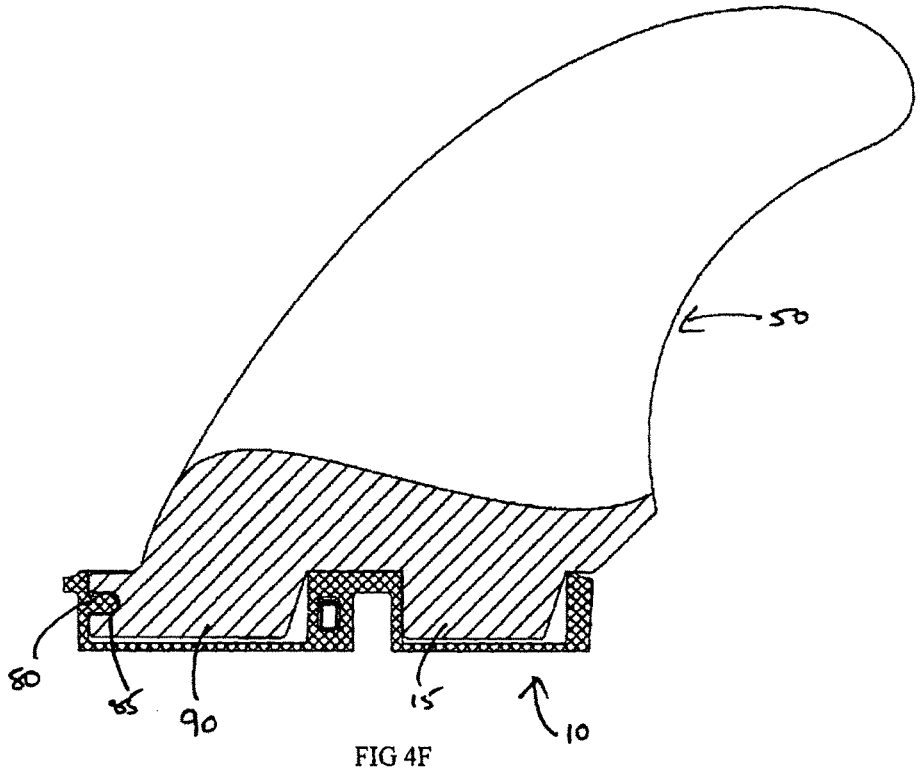
FIG. 4F is a cross-sectional side view of the fin and fin plug assembly of the FIG. 4A, the fin being received by the device.
Figure 4G:
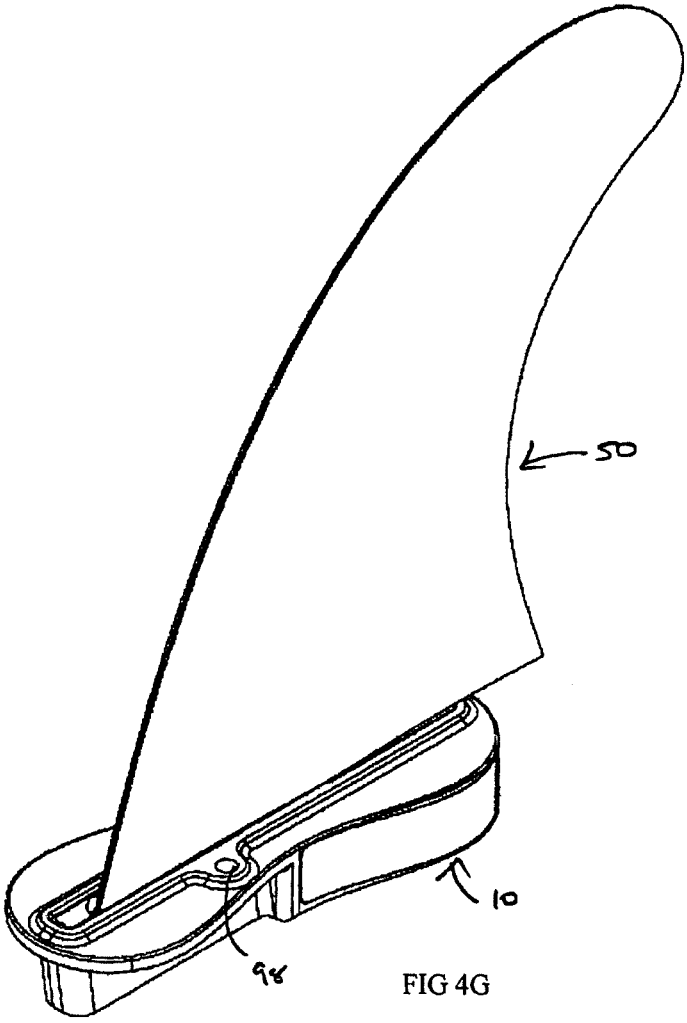
FIG. 4G is a top perspective view of the fin and fin plug assembly of FIG. 4F.
Figure 5A:
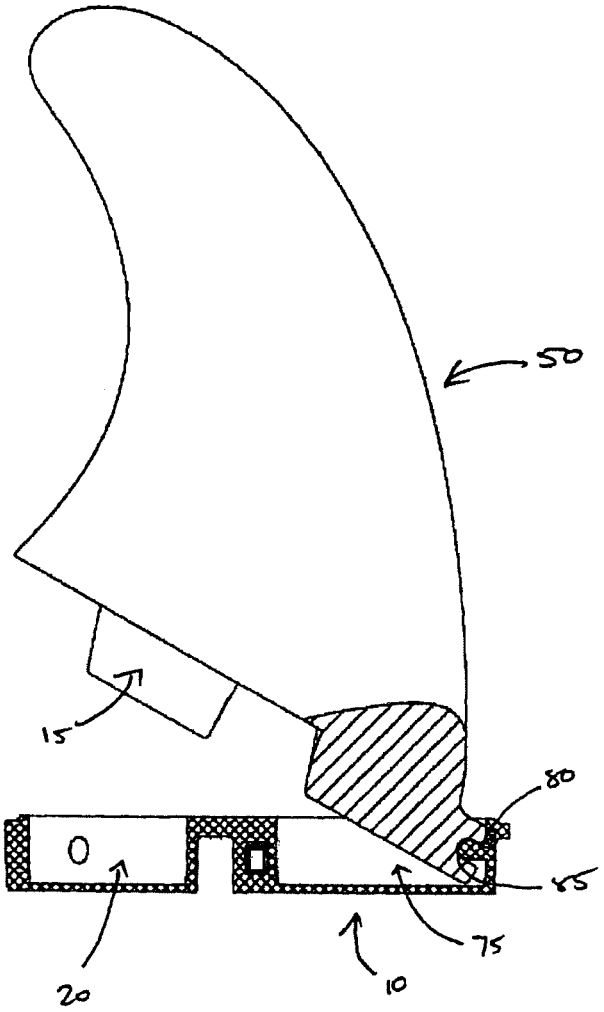
FIG. 5A is a side cross-sectional view of an example left-side of the fin and fin plug assembly.
Figure 5B:
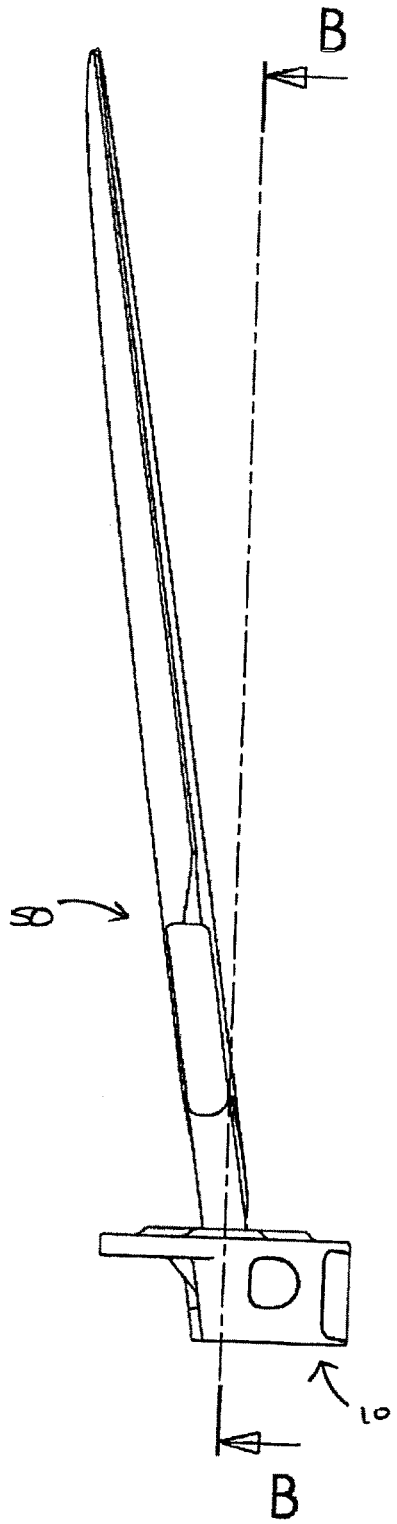
FIG. 5B is a back view of the fin and fin plug assembly of FIG. 5A.
Figure 5C:
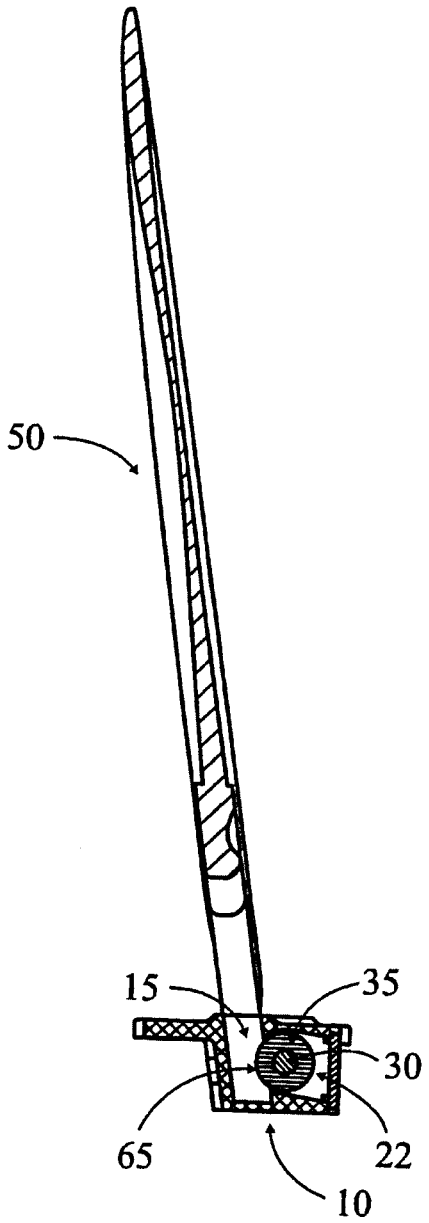
FIG. 5C is a cross-sectional front view of the fin and fin plug assembly of FIG. 5C.
Figure 5D:
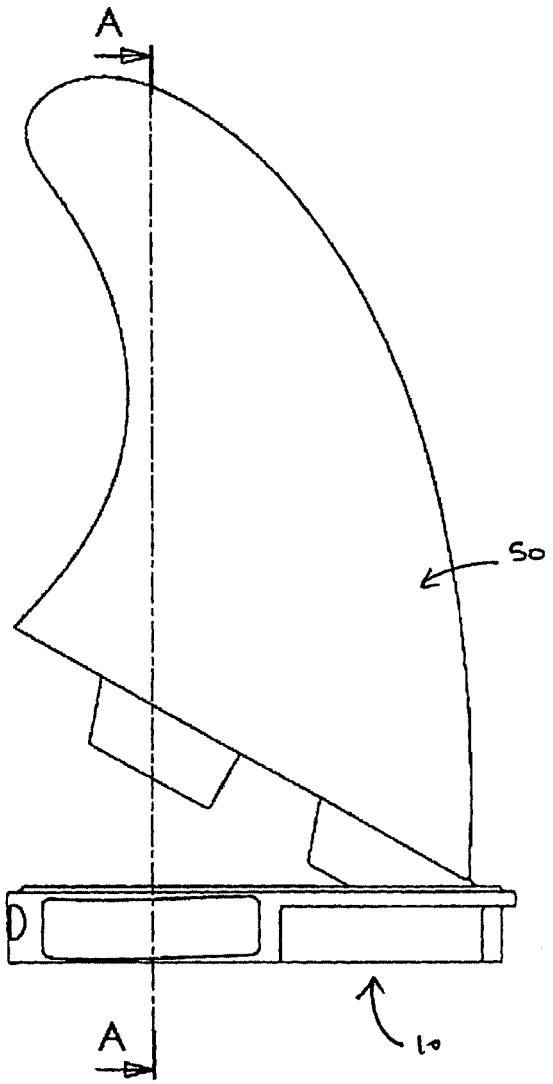
FIG. 5D is a side view of the fin and fin plug assembly of FIG. 5A.
Figure 5E:
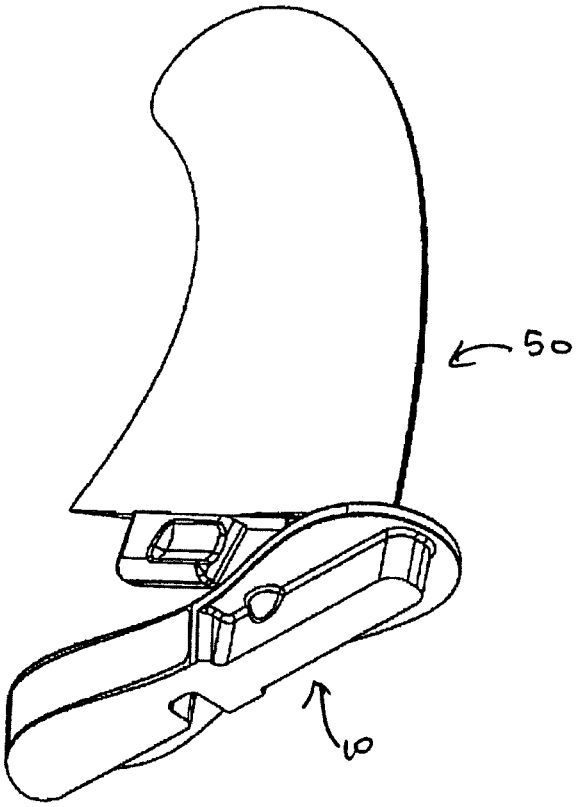
FIG. 5E is a bottom perspective view of the fin and fin plug assembly of FIG. 5A.
Figure 5F:
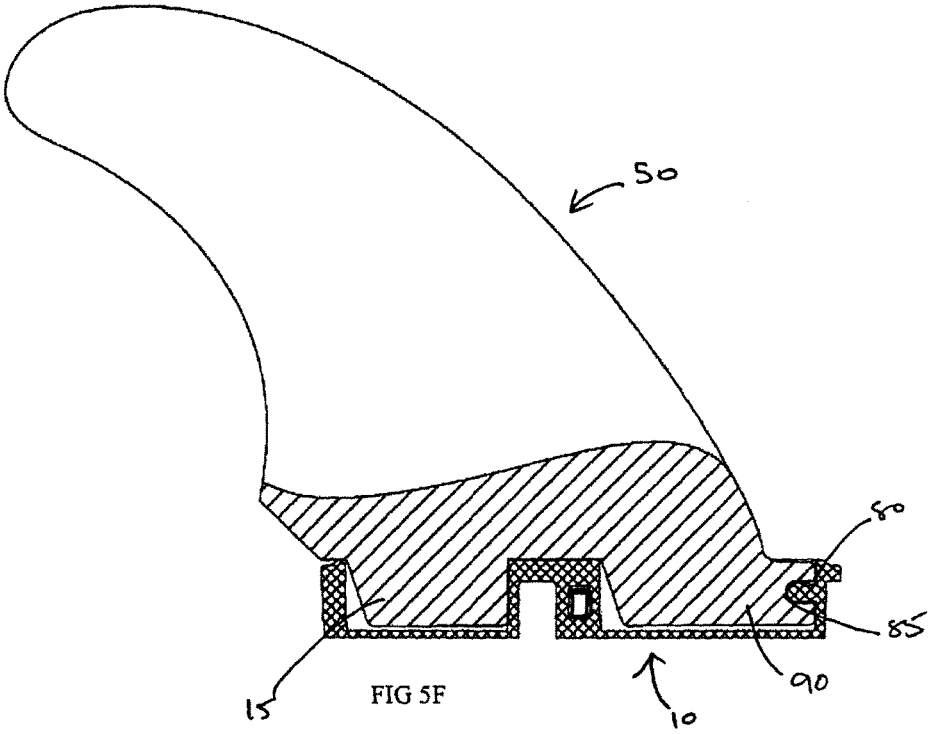
FIG. 5F is a cross-sectional side view of the fin and fin plug assembly of the FIG. 5A, the fin being received by the device.
Figure 5G:
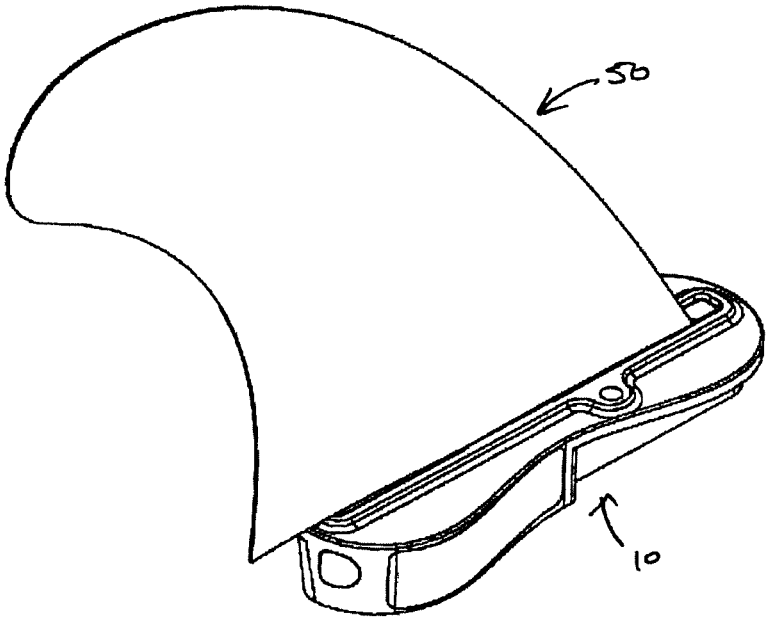
FIG. 5G is a top perspective view of the fin and fin plug assembly of FIG. 5F.

An example of a variation can be seen when comparing FIGS. 2C, 4C, and 5C. In these examples, FIGS. 2A to 3C represent an example of a central fin 50, where, as shown in FIG. 2C, the fin 50 is substantially perpendicular to the device 10. However, in contrast, the fins 50 of FIGS. 4C and 5C, are at an angle to the vertical of the device 10. FIG. 4C is an example of a right-side fin, and FIG. 5C is an example of a left side fin. Although the fins described are configured to be inserted at any angle to the vertical, in one particular example, the angle is 7 to 9 degrees from the vertical.

Accordingly, the device 10 may also be varied to accommodate for the varying angle of insertion. As shown in FIGS. 4C and 5C, the first cavity 15 may include an angled opposing wall 28, opposite to the cavity wall 25 (which is typically cavity wall where the extending portion 35 protrudes there through).

Figure 6A:
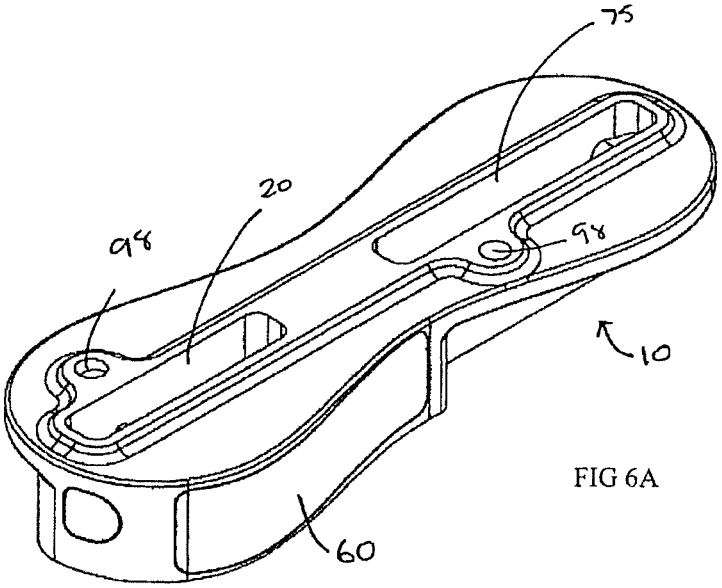
FIG. 6A is a top perspective view of an example device or fin plug.
Figure 6J:
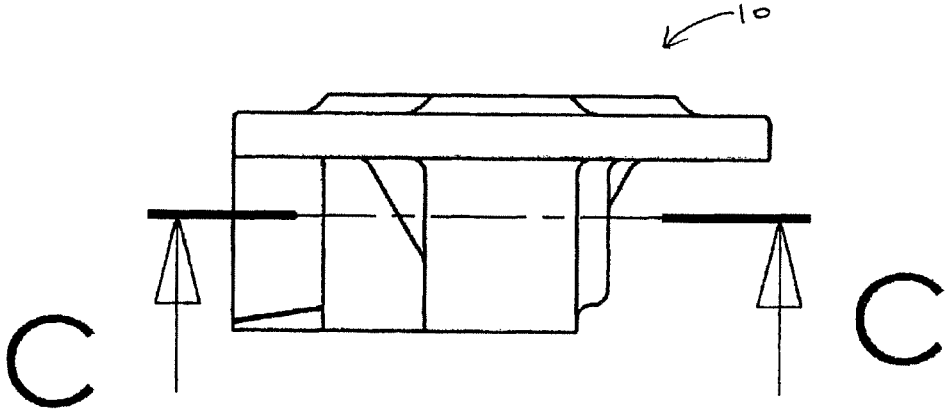
FIG. 6J is a front end elevational view of the device or fin plug of FIG. 6A.
Figure 6I:
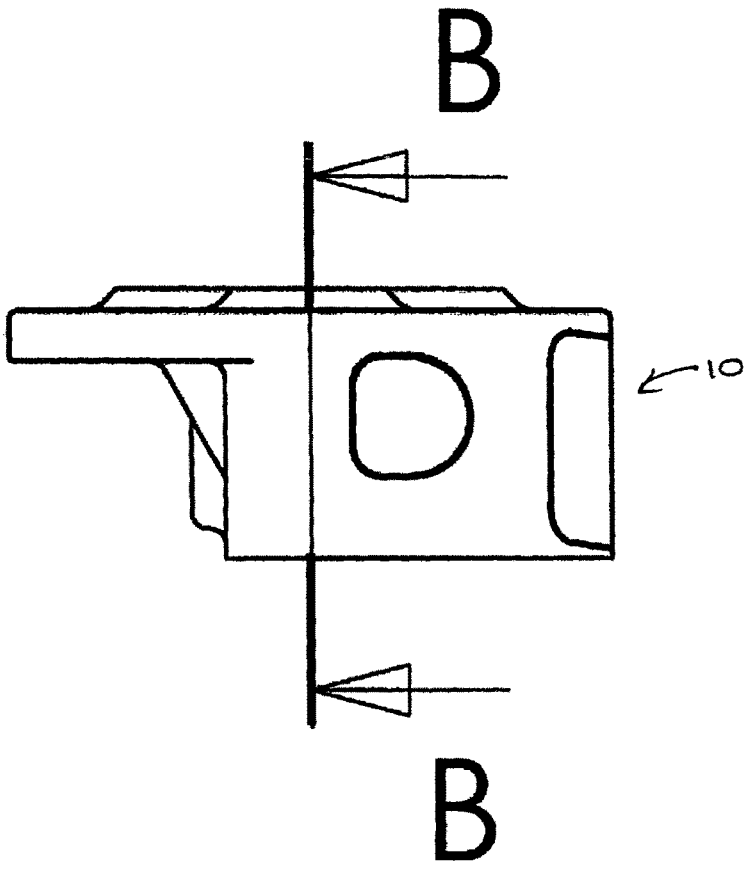
FIG. 6I is a back end elevational view of the device or fin plug of FIG. 6A.
Figure 6B:
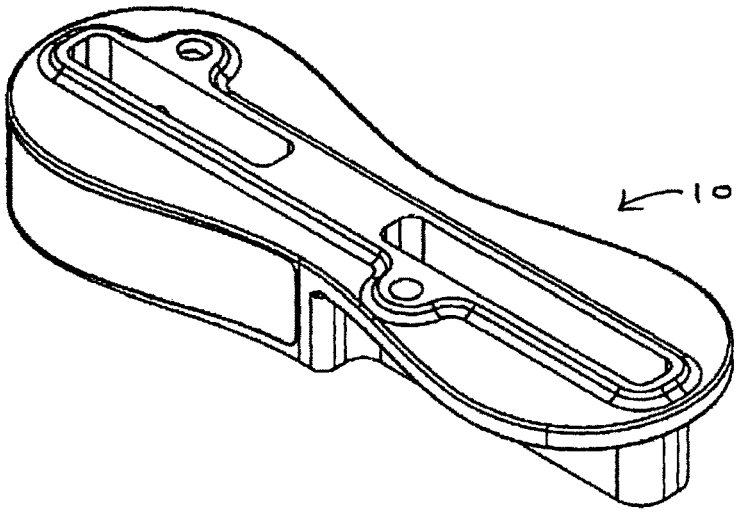
FIG. 6B is another top perspective view of the device or fin plug of FIG. 6A.
Figure 6D:
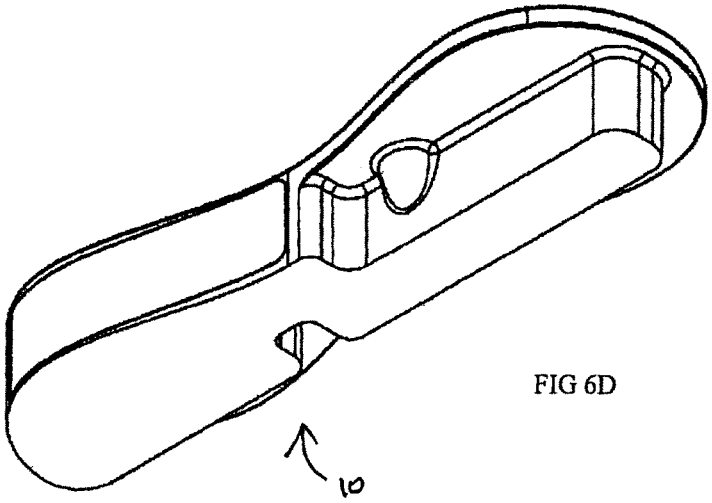
FIG. 6D is another underneath perspective view of the device or fin plug of FIG. 6A.
Figure 6C:
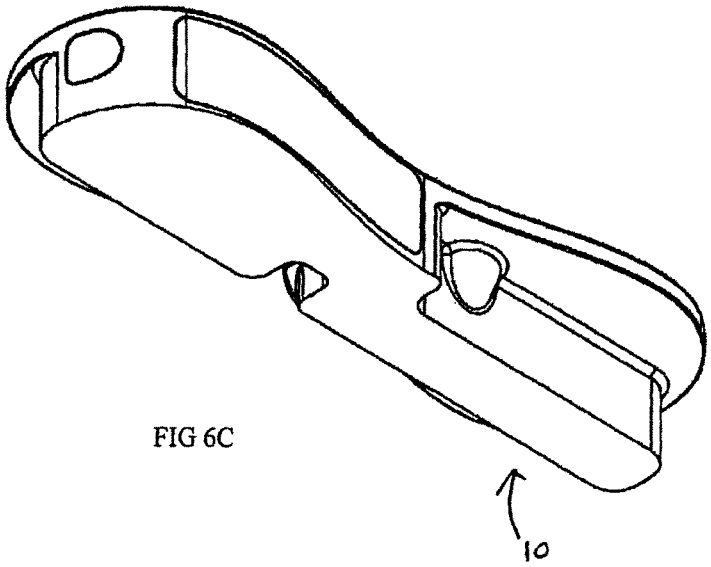
FIG. 6C is an underneath perspective view of the device or fin plug of FIG. 6A.
Figure 6F:
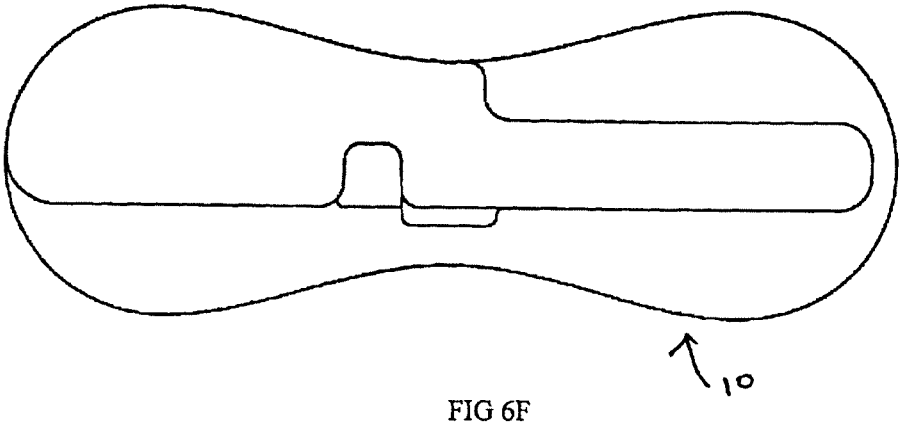
FIG. 6F is an underneath elevational view of the device or fin plug of FIG. 6A.
Figure 6E:
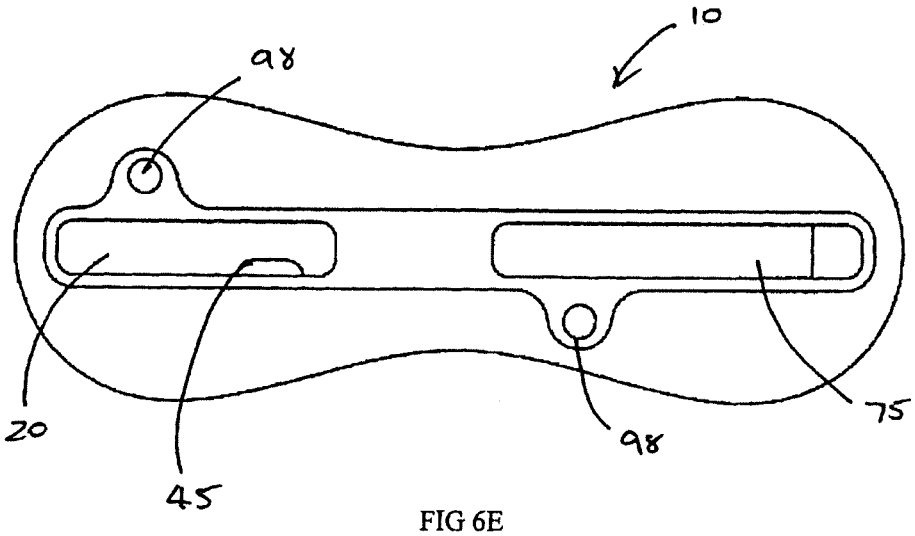
FIG. 6E is a top elevational view of the device or fin plug of FIG. 6A.
Figure 6G:
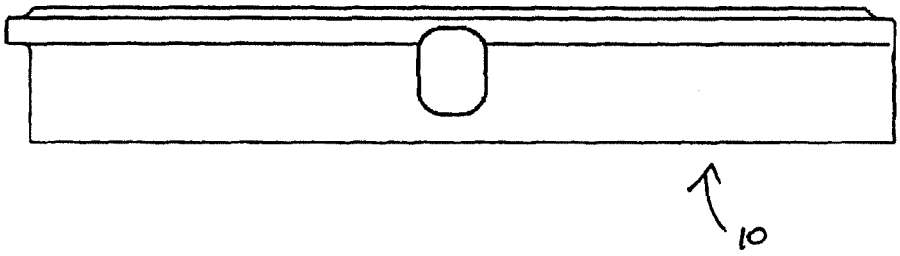
FIG. 6G is a side elevational view of the device or fin plug of FIG. 6A.
Figure 6H:
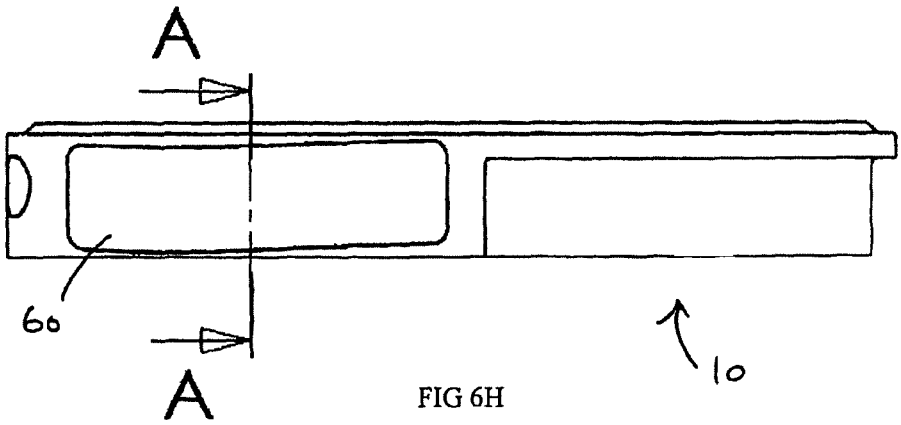
FIG. 6H is another side elevational view of the device or fin plug of FIG. 6A.
Figure 6L:
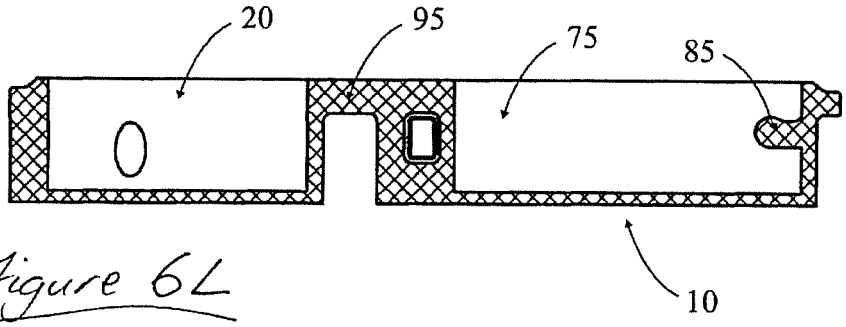
FIG. 6L is a cross-sectional view of the device or fin plug of FIG. 6I along the section line B-B.
Figure 6K:
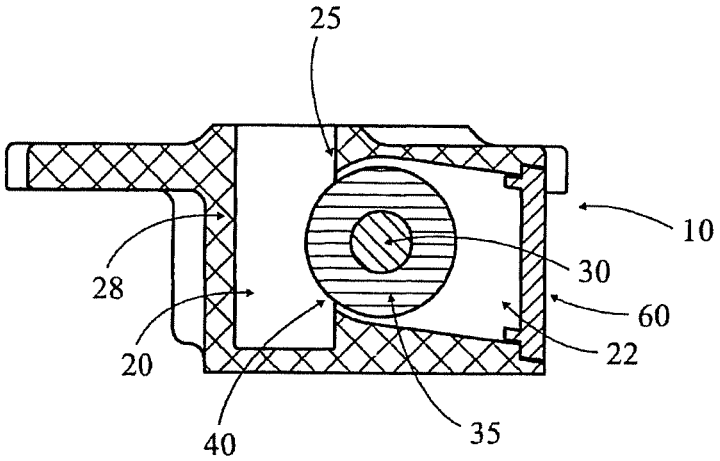
FIG. 6K is a cross-sectional view of the device or fin plug of FIG. 6H along the section line A-A.
Figure 6M:
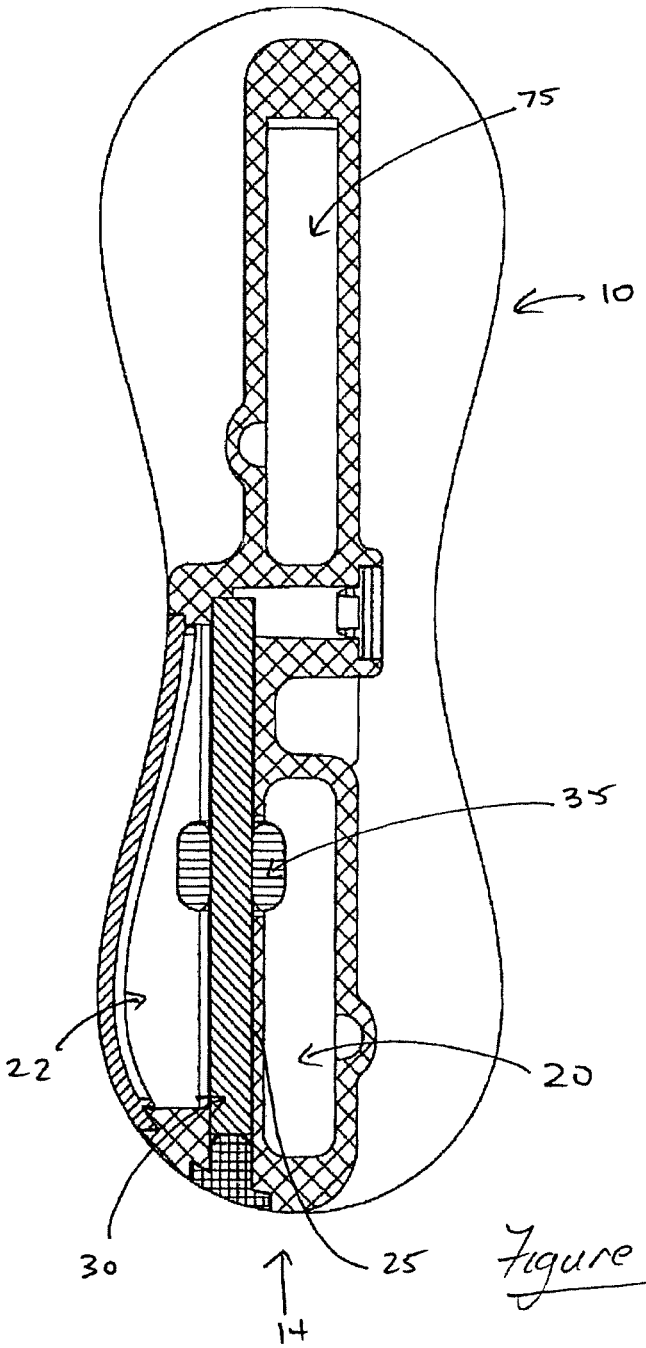
FIG. 6M is a cross-sectional view of the device or fin plug of FIG. 6J along the section line C-C.
Figure 6N:
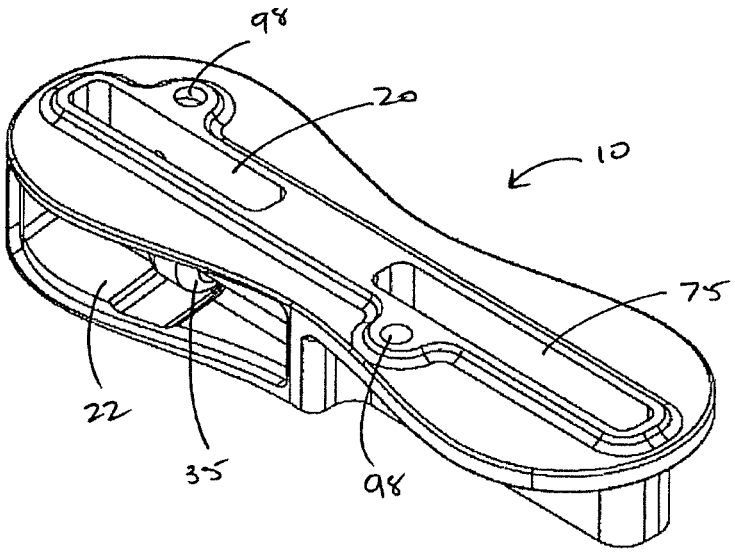
FIG. 6N is a top perspective view of the device or fin plug of FIG. 6A, without a cap 60 to the lateral cavity.
Figure 6O:
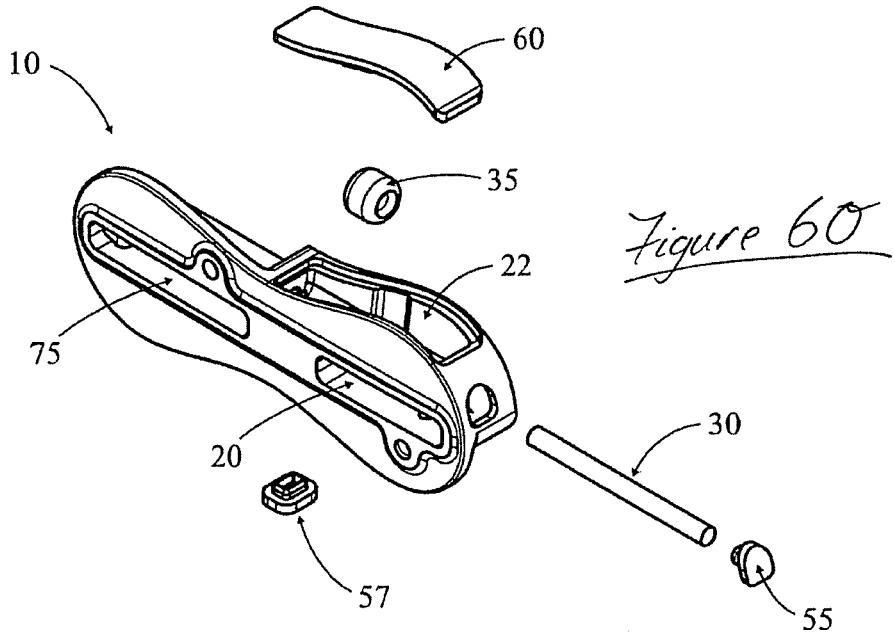
FIG. 6O is an exploded view of the device or fin plug of FIG. 6A.
Figure 6P:
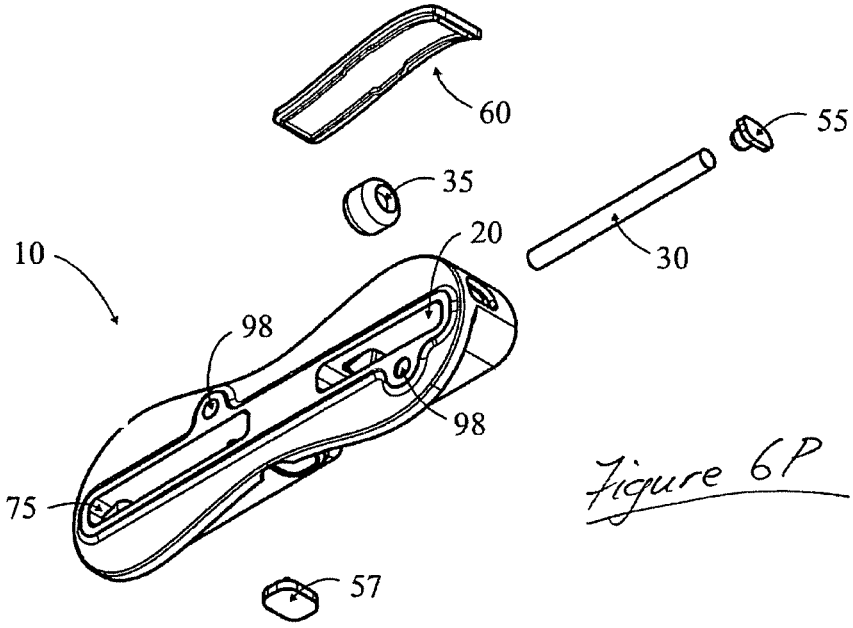
FIG. 6P is another exploded view of the device or fin plug of FIG. 6A.

In further examples, FIGS. 6A to 6P show example of a device or fin plug 10, where in these examples, the device 10 would typically be used for a centre fin. It will be appreciated by persons skilled in the art that, as shown in FIG. 6M, the extending portion 35 protrudes through the cavity wall 25 at a position where it can easily mate with the corresponding grooved portion 65 of the fin 50. Thus, the extending portion 35 need not necessarily protrude through at the centre of the cavity wall 25, and can, according to this particular example, be offset from the centre.

Additionally, the device 10 shows fixation points 98 for fixing of grub screws or any other suitable fixing means, or the like, for further fixing the fin 50 to the device 10. It will be appreciated that the use of the grub screws or other suitable fixing means can allow for different types of fins to be fixed to the device 10. Thus in this particular example, the grub screw can be configured to extend into the first cavity 20 to further secure a base portion of the fin 50 within the first cavity 20. A similar grub screw can be used for the second cavity 75 where a grub screw is configured to extend into the second cavity 75 to further secure a tab, base portion, or the like of the fin 50 into the second cavity 75.

Figure 7A:
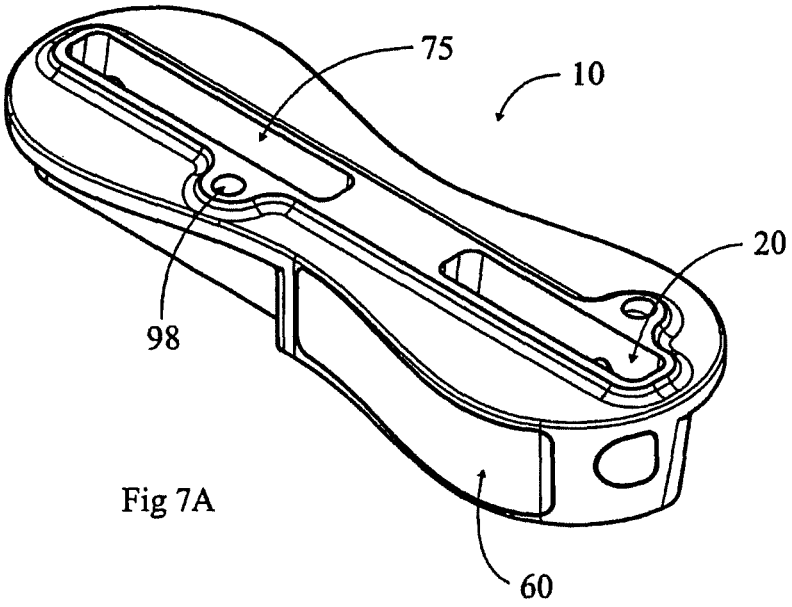
FIG. 7A is a top perspective view of an example right-side device or fin plug.
Figure 7B:
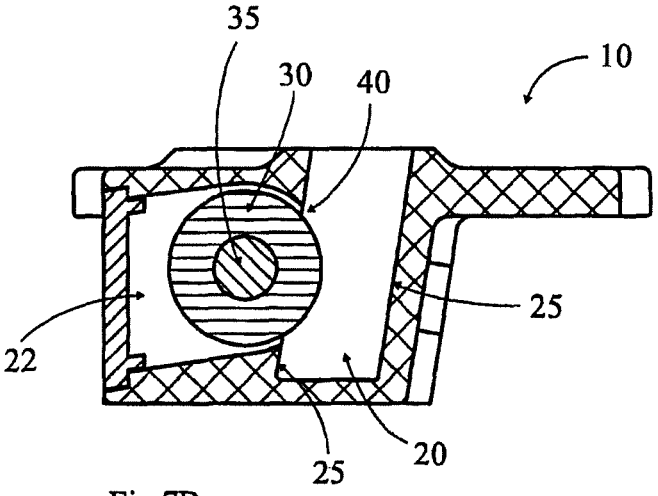
FIG. 7B is front cross-sectional view of the device or fin plug of FIG. 7A.
Figure 7C:
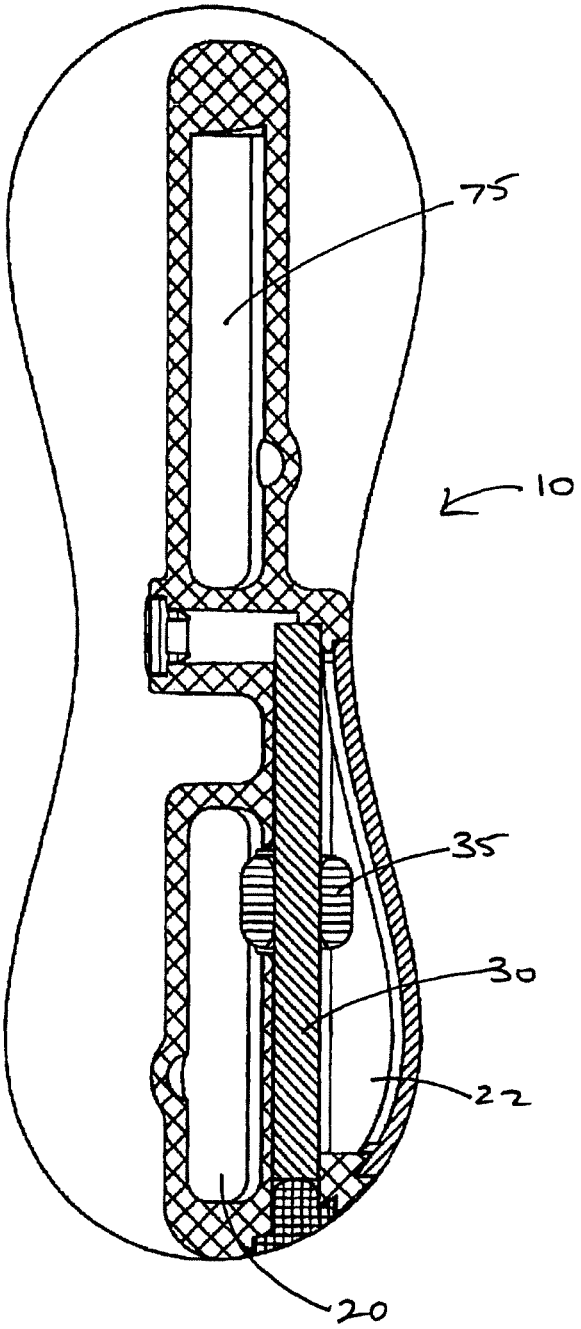
FIG. 7C is a top cross-sectional view of the device or fin plug of FIG. 7A.
Figure 7D:
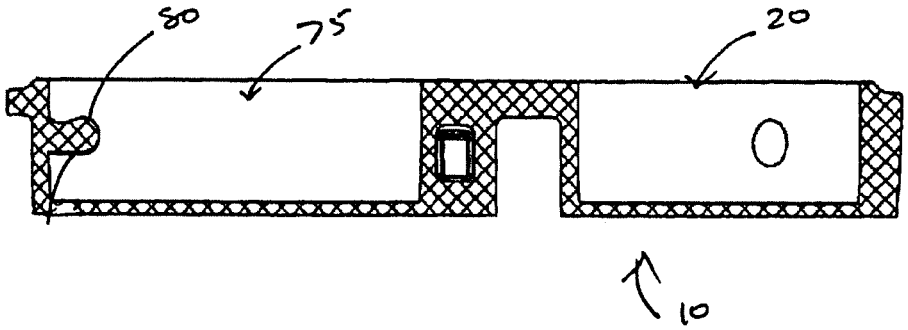
FIG. 7D is a side cross-sectional view of the device or fin plug of FIG. 7A.
Figure 8A:
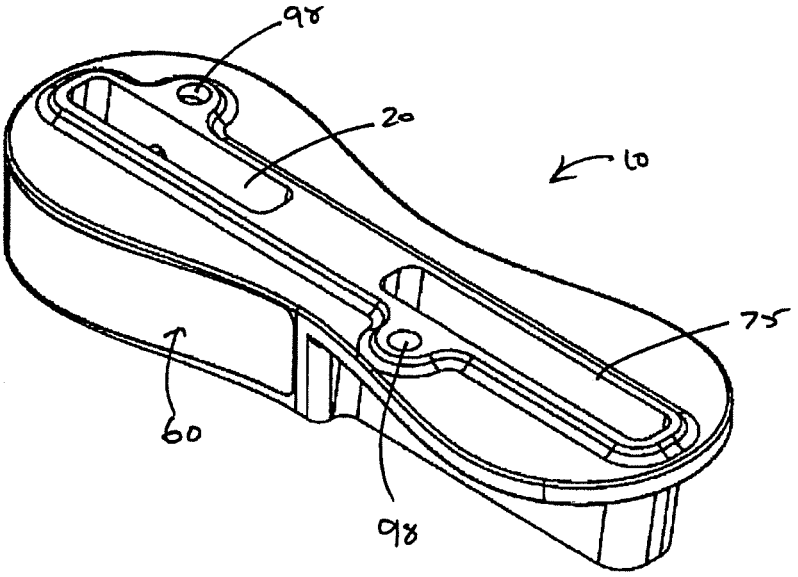
FIG. 8A is a top perspective view of an example left-side device or fin plug.
Figure 8D:
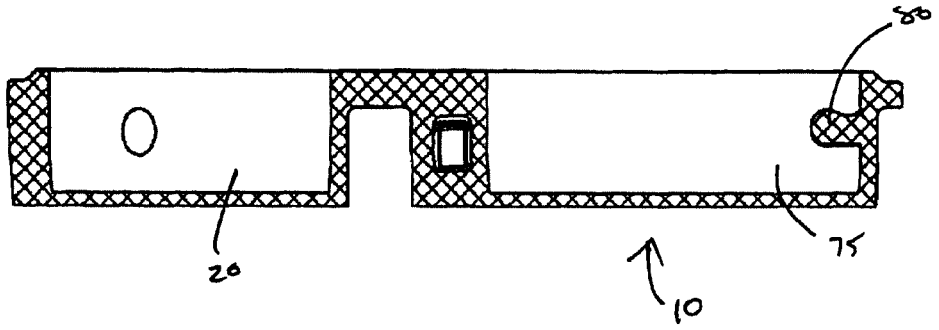
FIG. 8D is a side cross-sectional view of the device or fin plug of FIG. 8A.
Figure 8B:
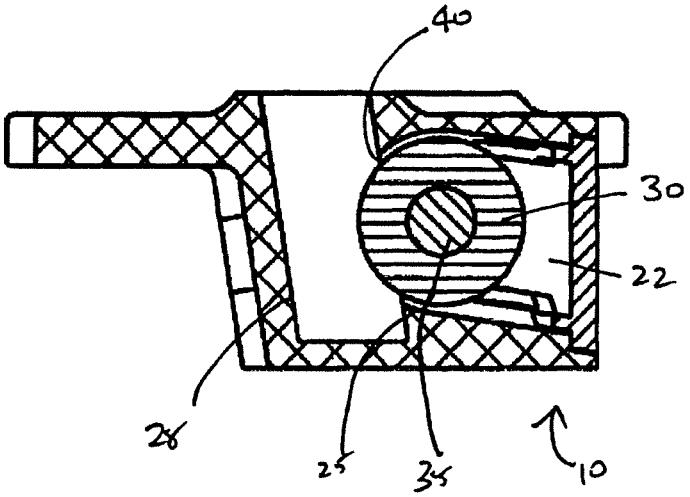
FIG. 8B is front cross-sectional view of the device or fin plug of FIG. 8A.
Figure 8C:
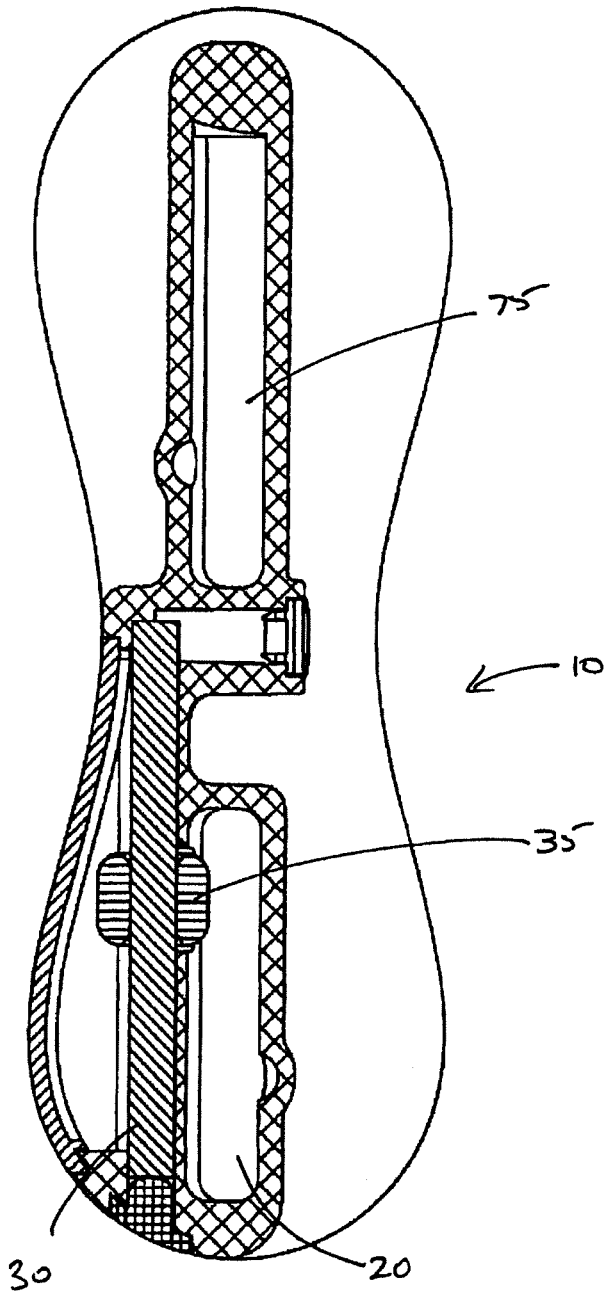
FIG. 8C is a top cross-sectional view of the device or fin plug of FIG. 8A.
Figure 9A:
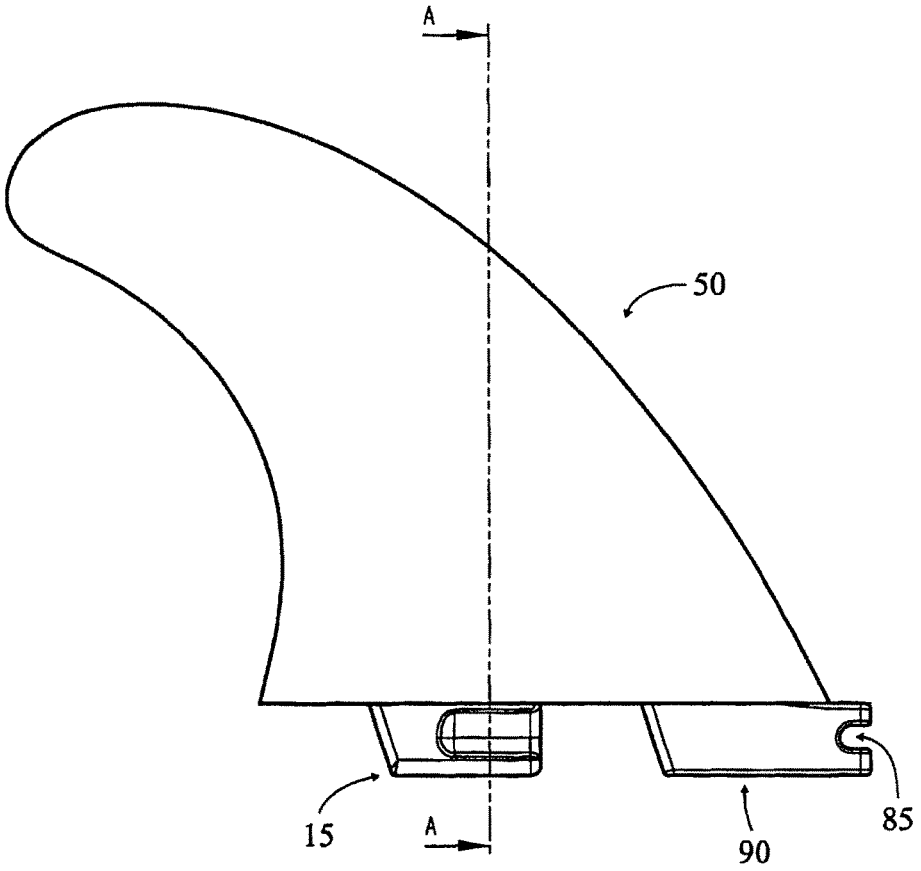
FIG. 9A is a side view of an example fin, which can be used with a device or fin plug described herein.
Figure 9B:
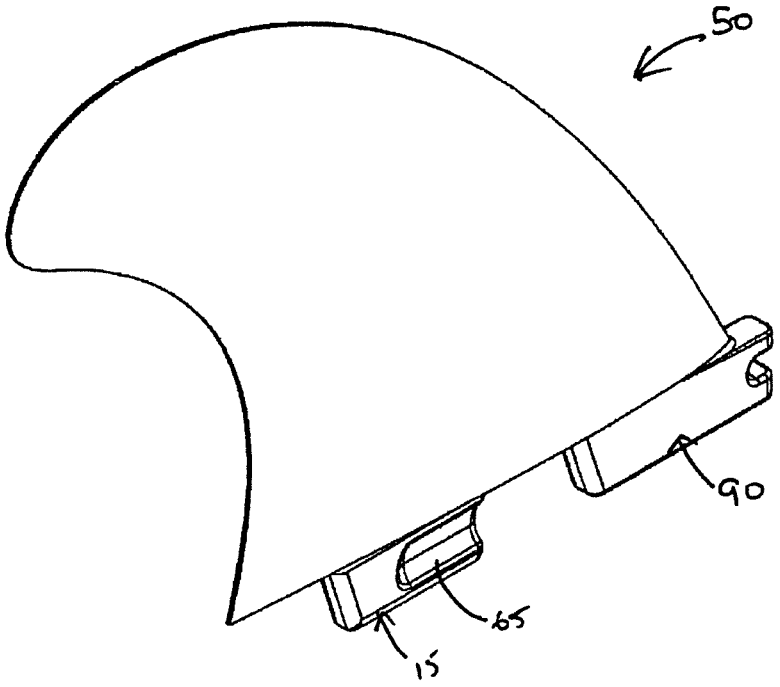
FIG. 9B is a top perspective view of the fin of FIG. 9A.
Figure 9C:
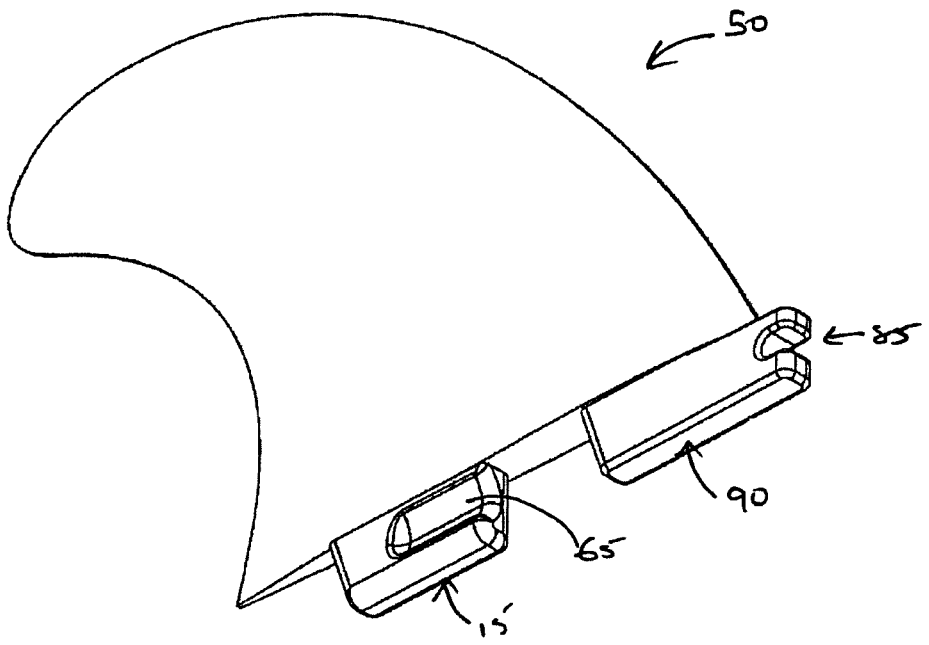
FIG. 9C is a bottom perspective view of the fin of FIG. 9A.
Figure 9D:
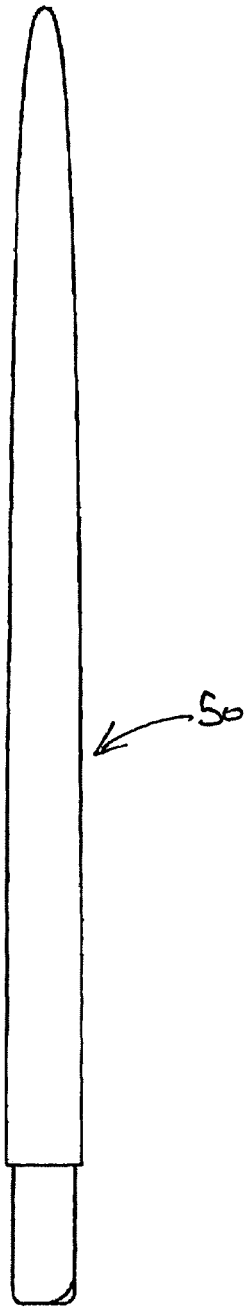
FIG. 9D is a front view of the fin of FIG. 9A.
Figure 9E:
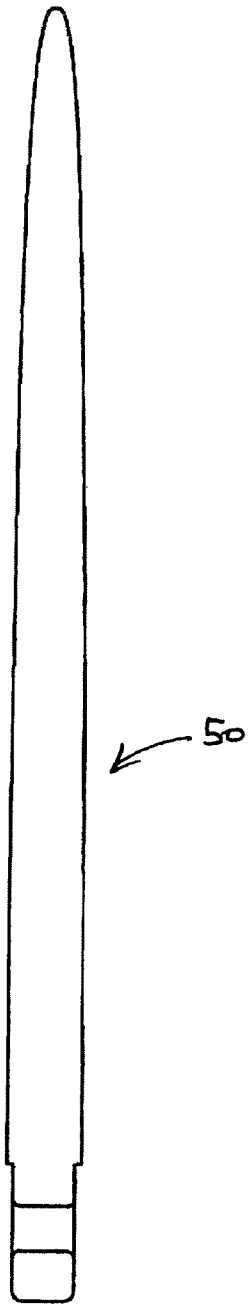
FIG. 9E is a back view of the fin of FIG. 9A.
Figure 9F:
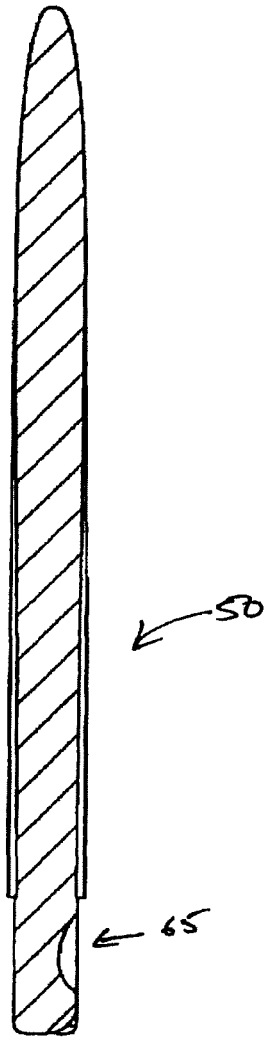
FIG. 9F is a cross-sectional view of the fin of FIG. 9A.
Figure 9G:
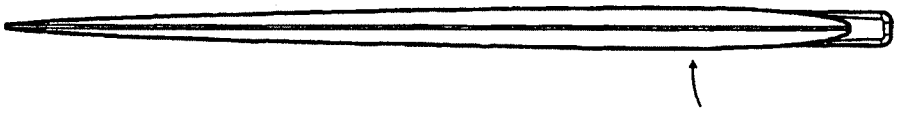
FIG. 9G is a top view of the fin of FIG. 9A.
Figure 9H:
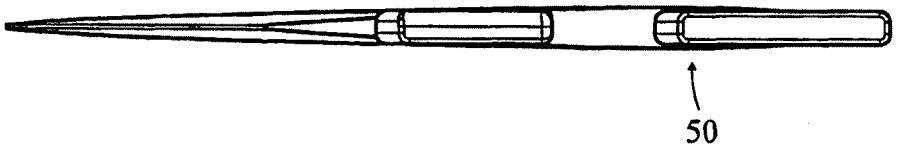
FIG. 9H is a bottom view of the fin of FIG. 9A.
Figure 10A:
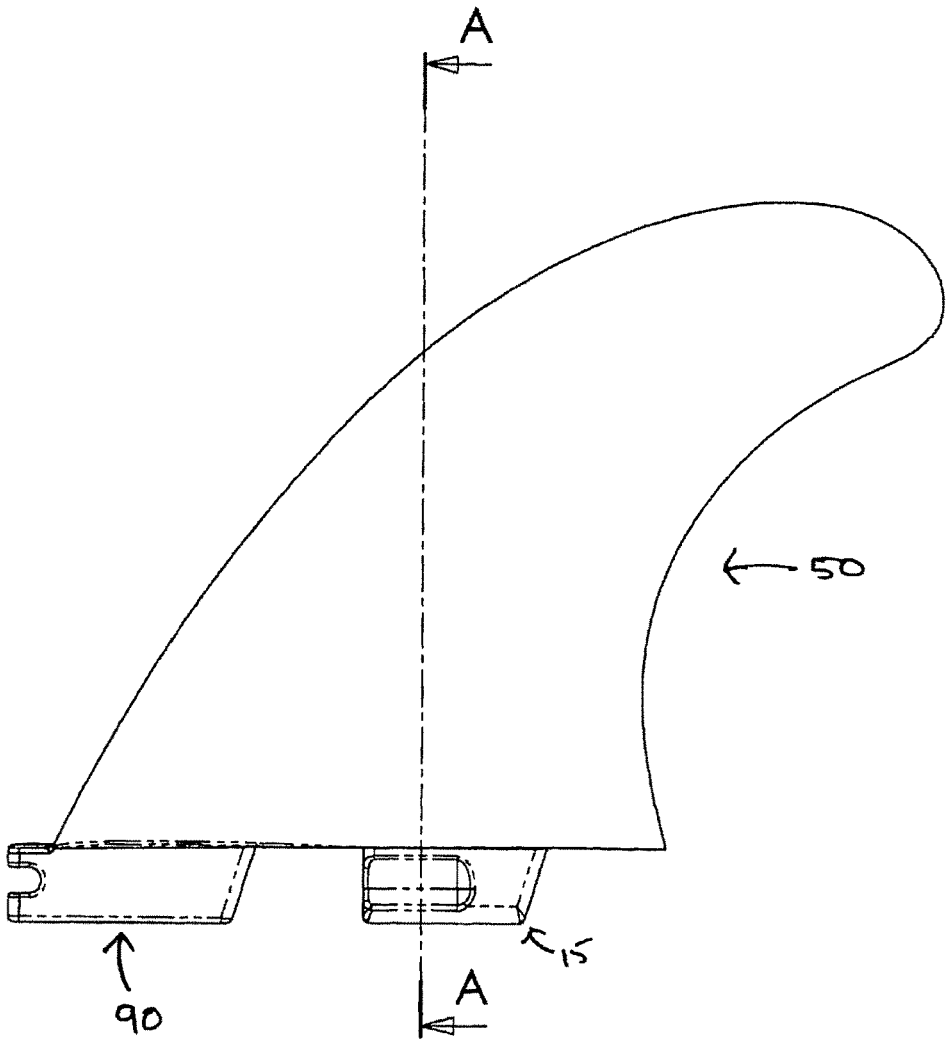
FIG. 10A is a side view of an example right-side fin, which can be used with a device or fin plug described herein.
Figure 10B:
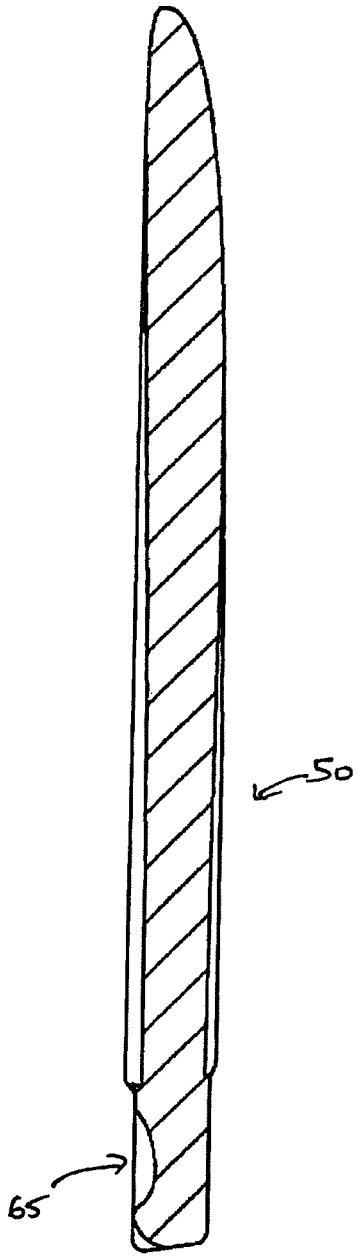
FIG. 10B is a cross-sectional view of the fin of FIG. 10A.
Figure 10C:
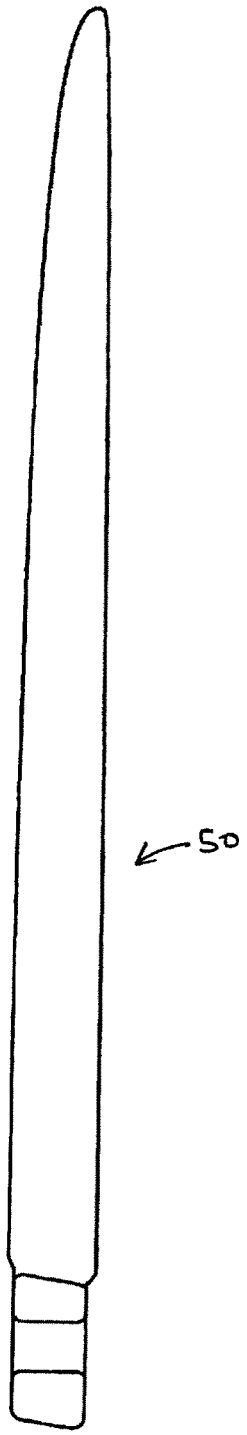
FIG. 10C is a back view of the fin of FIG. 10A.
Figure 10D:
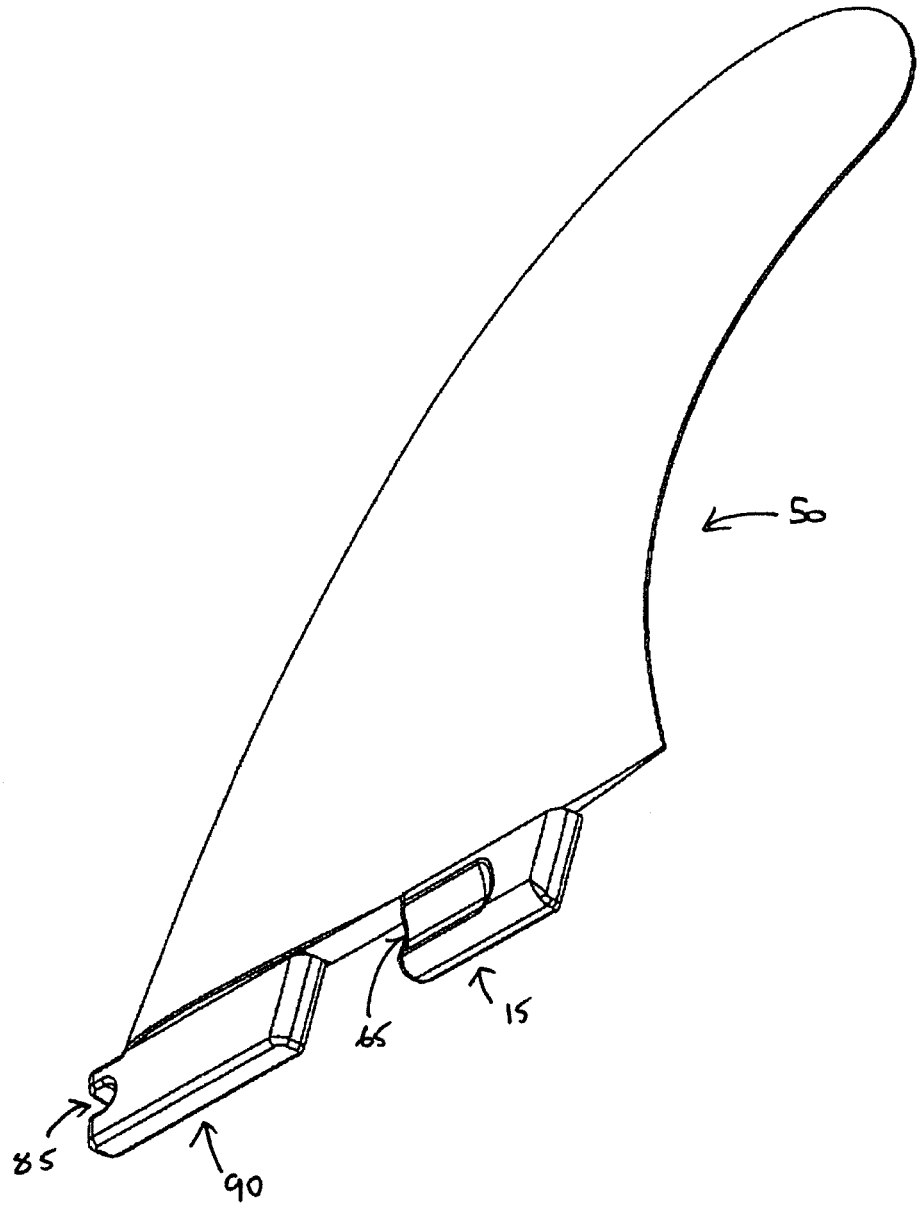
FIG. 10D is a top perspective view of the fin of FIG. 10A.
Figure 11A:
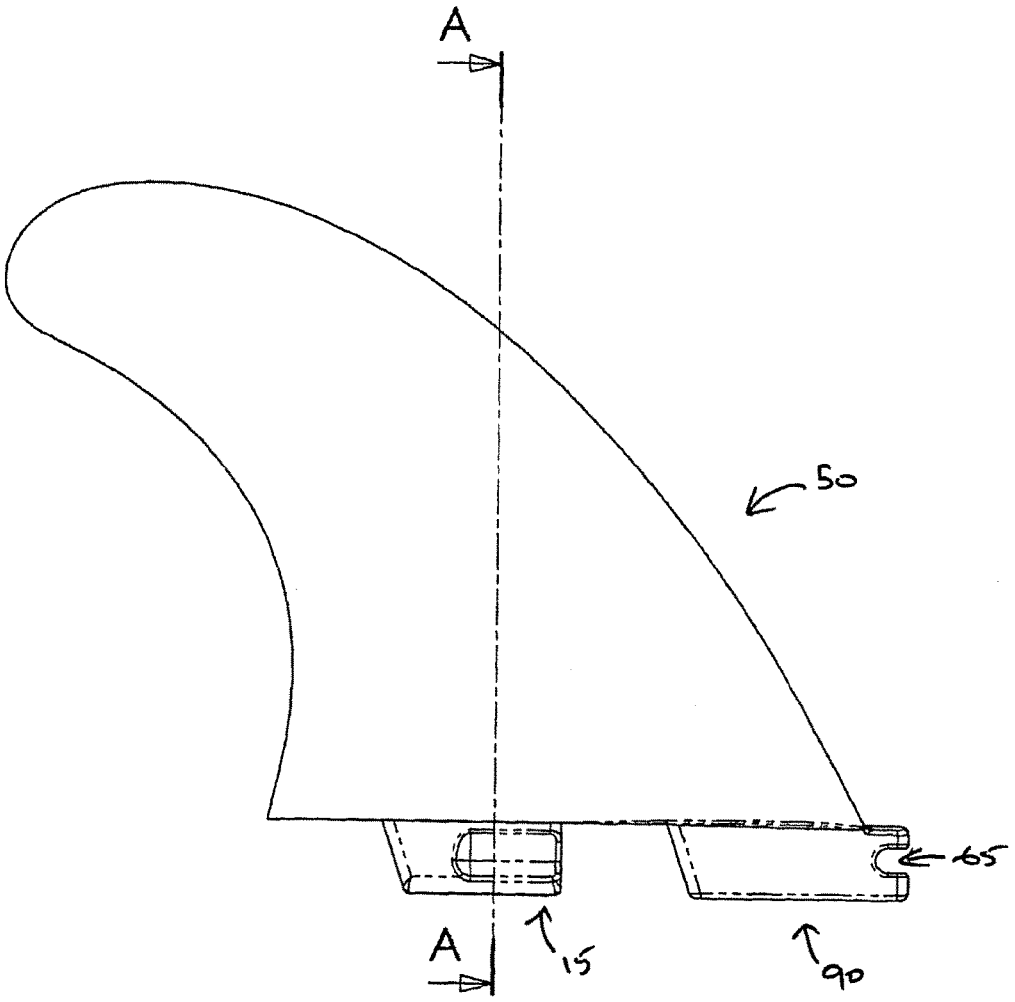
FIG. 11A is a side view of an example left-side fin, which can be used with a device or fin plug described herein.
Figure 11B:
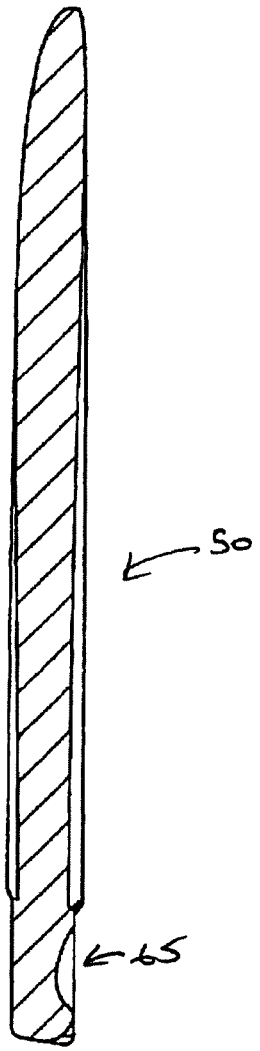
FIG. 11B is a cross-sectional view of the fin of FIG. 11A.
Figure 11C:
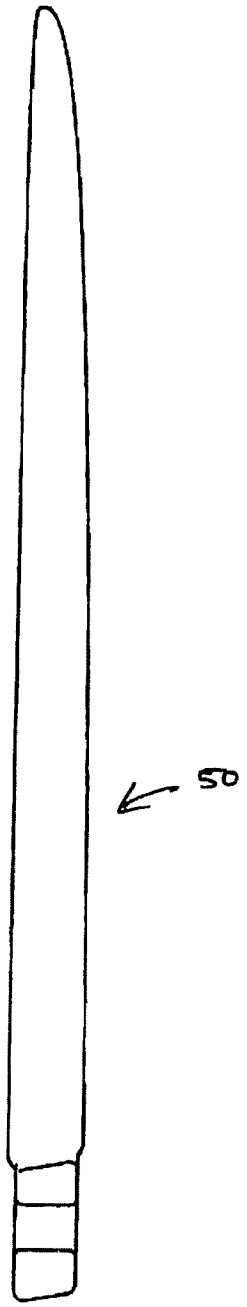
FIG. 11C is a back view of the fin of FIG. 11A.
Figure 11D:
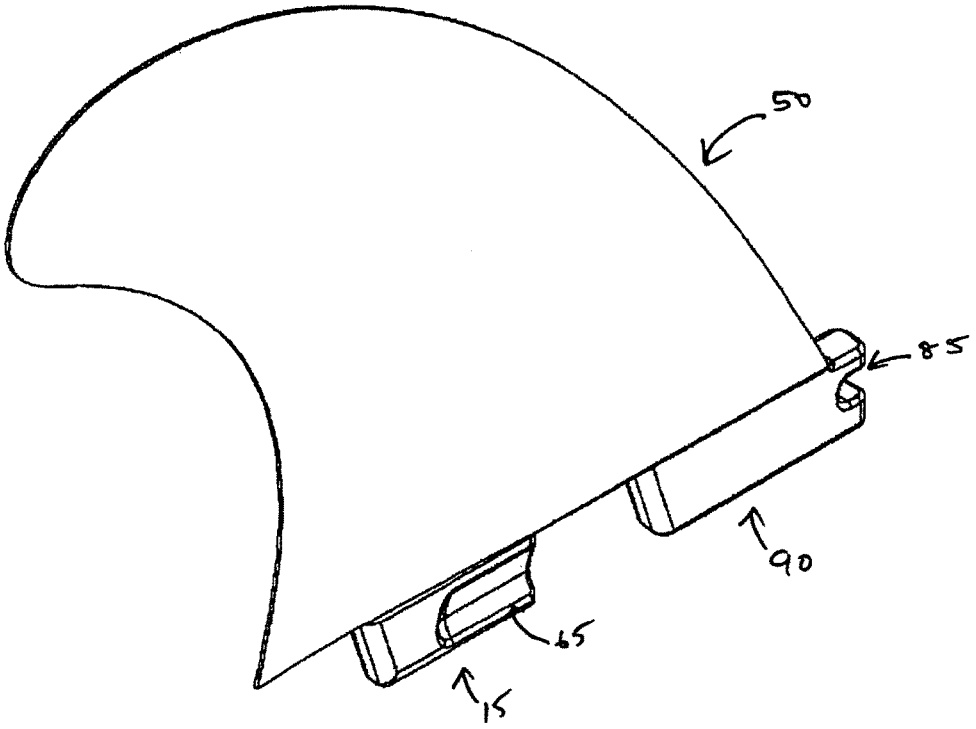
FIG. 11D is a top perspective view of the fin of FIG. 11A.

FIGS. 7A to 7D are examples of the device 10 for use with a right side fin. Furthermore, FIGS. 8A to 8D are examples of the device 10 for use with a left side fin. Of particular note from these figures, it will be appreciated that the examples show that the devices when used for the side fins (such as the left and right fins) can be formed such that they are mirror images of each other. Furthermore, FIGS. 7B and 8B show the angled opposing wall 28, to allow for an angled insertion of the respective fins.

In the examples shown herein, the device 10 is shaped substantially as a figure-eight, such that at least one profile of the device has substantially, a figure-eight shape. In these examples, the first cavity 15 is located or formed within a first end 12 of the figure-eight and the second cavity 75 is formed within the second end 14 of the figure-eight.

It will be appreciated by persons skilled in the art that the figure-eight shape of the device 10 can provide advantages such allowing for the device 10 to form part of the water craft and further allowing the fin portions to be locked therein. The smooth edges of the figure-eight shape can also provide for an easier manufacturing process. However, it will be appreciated that the device is not limited to this shape and other shapes which provide the functionality of the cavities, are incorporated herein.

FIGS. 9A to 9H show examples of a centre fin 50, for use with a centre device 10. FIGS. 10A to 10D show examples of a right fin 50, and FIGS. 11A to 11D show an example of a left fin 50. Notably, the left and right fins may be mirror images of each other.

Notably, referring to the fins 50, it will further be appreciated that although the first fin portion 15 and the second fin portion 90 can be or can include first and second tabs respectively, it will be appreciated that any base portion of the fin 50 may be configured to be insertable into the first and second cavities 20, 75.

Further examples of fixing means for the second fin portion 90 and the second cavity 75 are shown in FIGS. 12A to 27B. Thus, in these examples the following variations are shown in the following paragraphs.

Figure 12A:
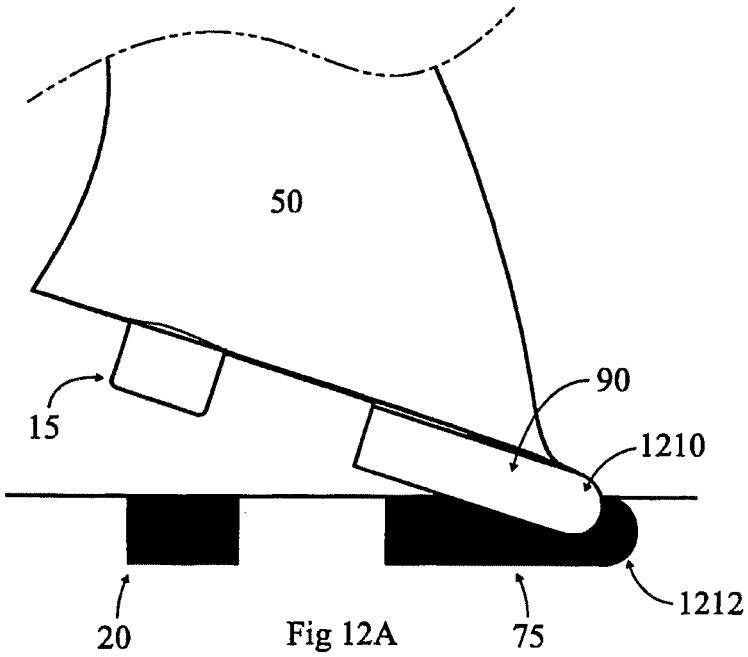
FIGS. 12A to 12H are example fixing/engagement means to fix a second fin portion within a second cavity of the device/fin plug discussed herein.

FIG. 12A shows the second fin portion 90 having a convex edge 1210, mating with a corresponding concave portion 1212 of the second cavity 75.

Figure 12B:
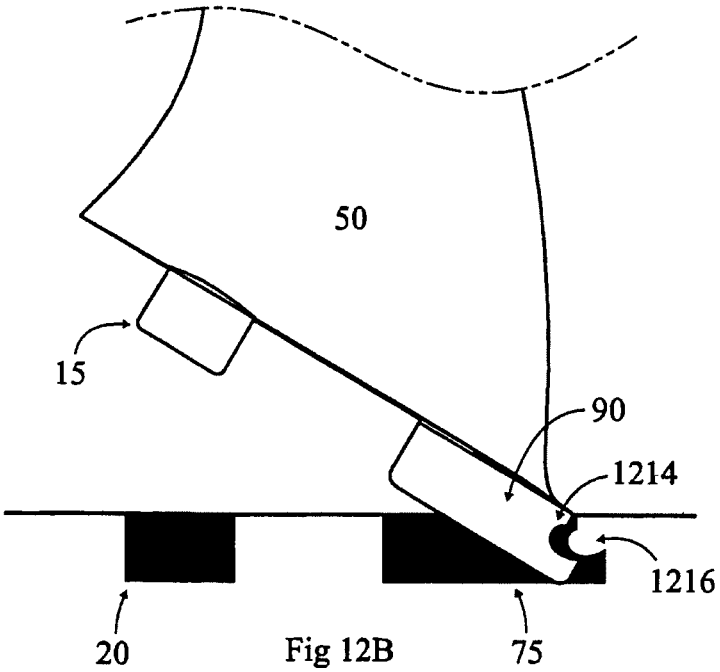

FIG. 12B shows the second fin portion 90 having a concave edge 1214, mating with a corresponding concave portion 1216 of the second cavity 75.

Figure 12C:
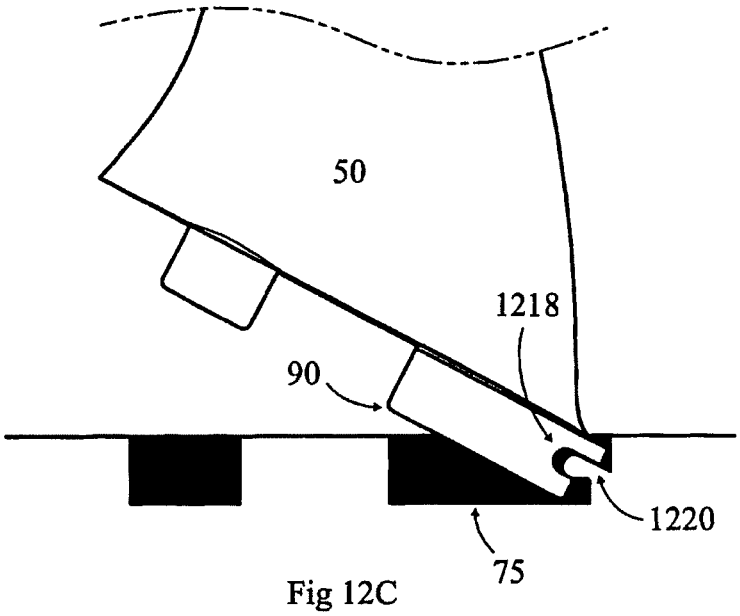

FIG. 12C shows a different concave edge 1218 on the second fin portion 90, mating with a protruding convex portion 1220 in the second cavity 75.

Figure 12D:
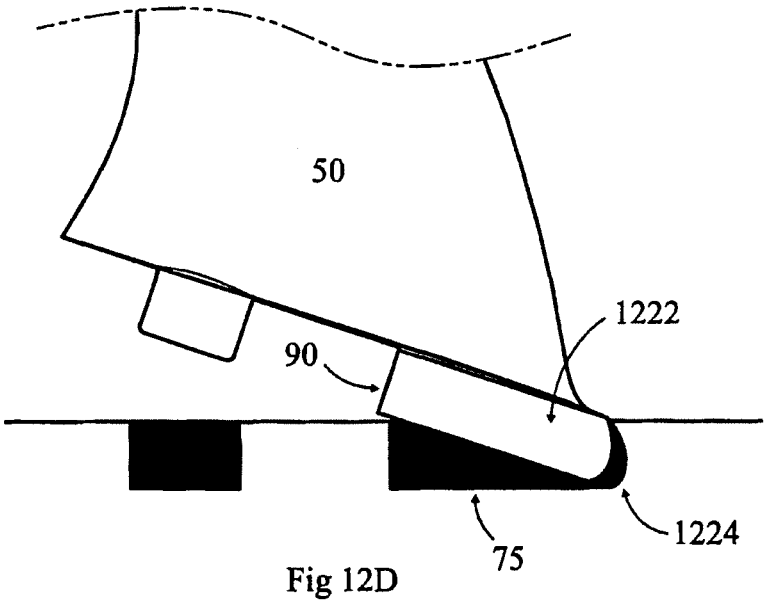

FIG. 12D shows a variation of FIG. 12A where the second fin portion 90 has a slanted convex edge 1222 with a corresponding second cavity geometry 1224.

Figure 12E:
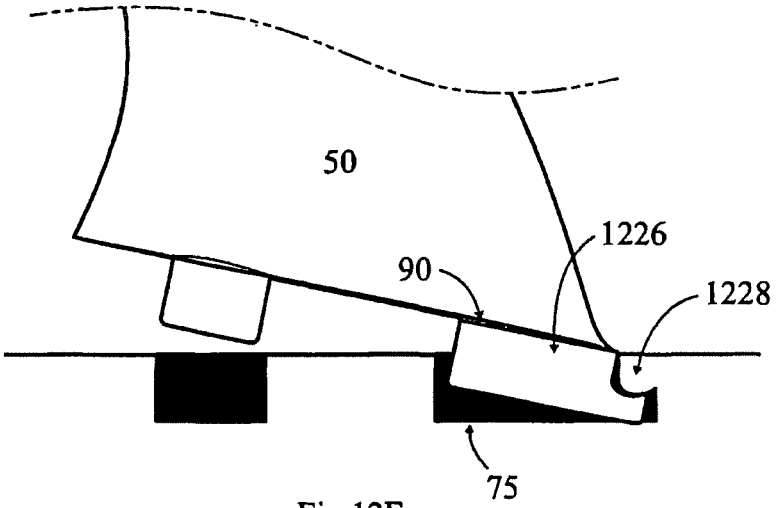

FIG. 12E shows an entire top edge of the second fin portion 90 being cut away 1226 and mating with a corresponding convex edge 1228 of the second cavity 75.

Figure 12F:
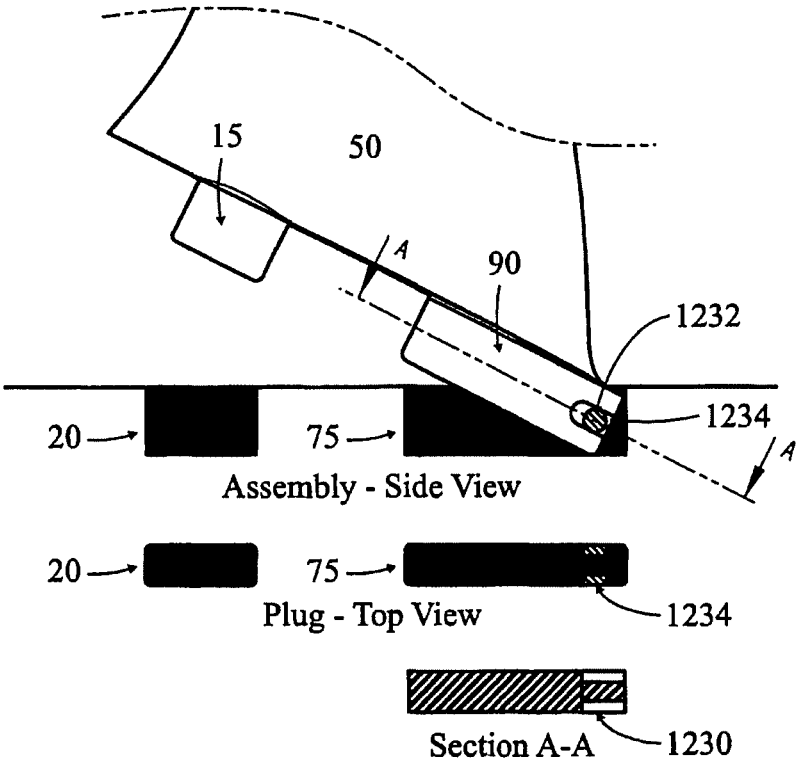

FIG. 12F shows a groove 1230 or the like cut in the sides of the fin tab nose 1232 and being configured to correspond with pins 1234 from both sides of the second cavity 75.

Figure 12G:
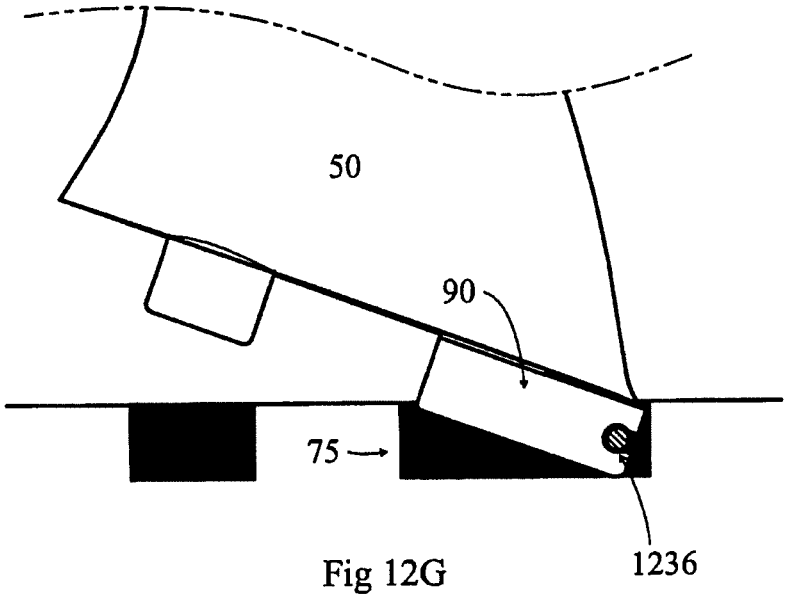

FIG. 12G shows a single pin 1236 being configured to be inserted into the second fin portion 90 to hold the fin portion 90 within the second cavity 75.

Figure 12H:
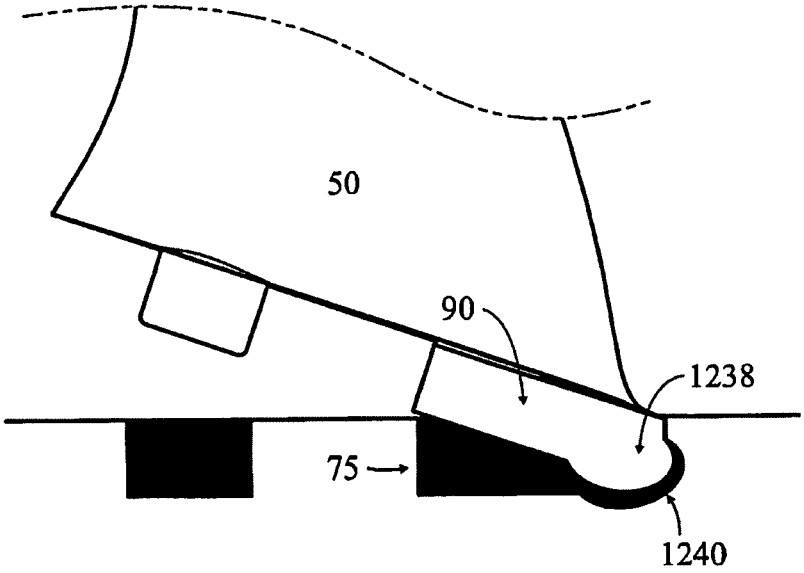

FIG. 12H shows a rounded bottom edge 1238 of the second fin portion 90, protruding and mating with a corresponding convex portion 1240 of the second cavity 75.

Figure 13A:
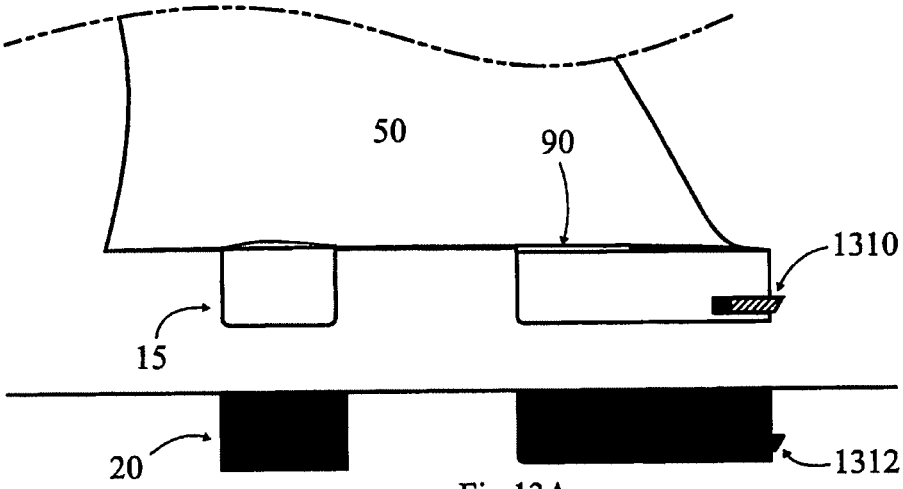
FIGS. 13A to 13C are an example fixing/engagement means to fix a second fin portion within a second cavity of the device/fin plug discussed herein.
Figure 13B:
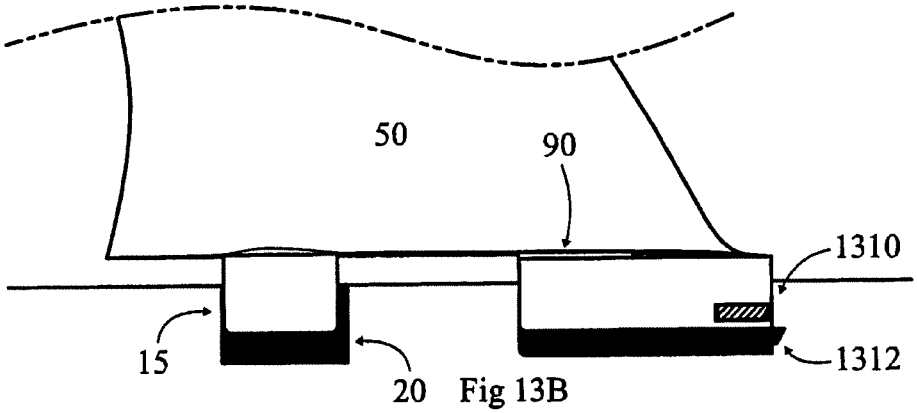
Figure 13C:
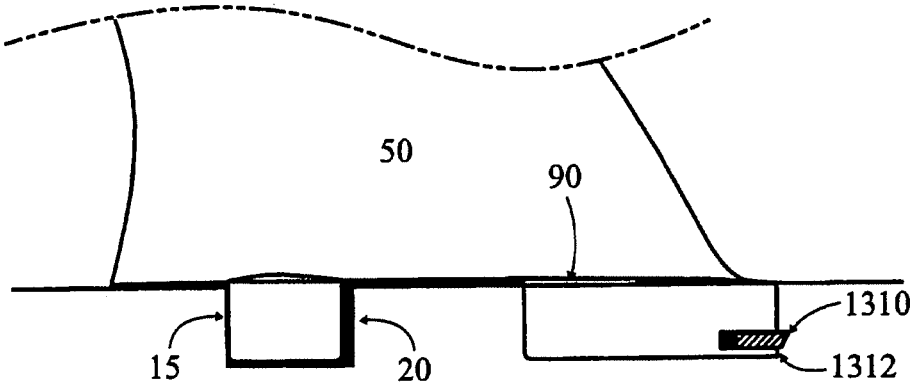

FIGS. 13A to 13C show the insertion of the second fin portion 90 into the second cavity 75, where the second fin portion 90 has a spring-loaded undercut 1310. In these examples, the undercut 1310 retracts when the second fin portion 90 is inserted into the second cavity 75 (as shown in FIG. 13B), and then springs into a corresponding recess 1312 within the second cavity 75 when the fin portion 90 is in place (as shown in FIG. 13C).

Figure 14A:
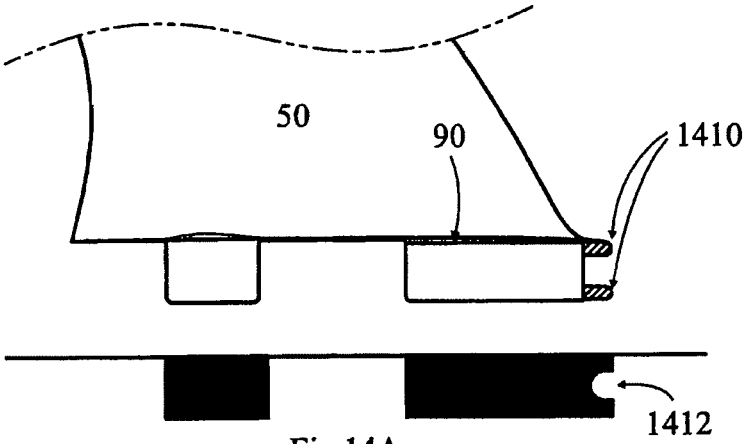
FIGS. 14A to 14C are an example fixing/engagement means to fix a second fin portion within a second cavity of the device/fin plug discussed herein.
Figure 14B:
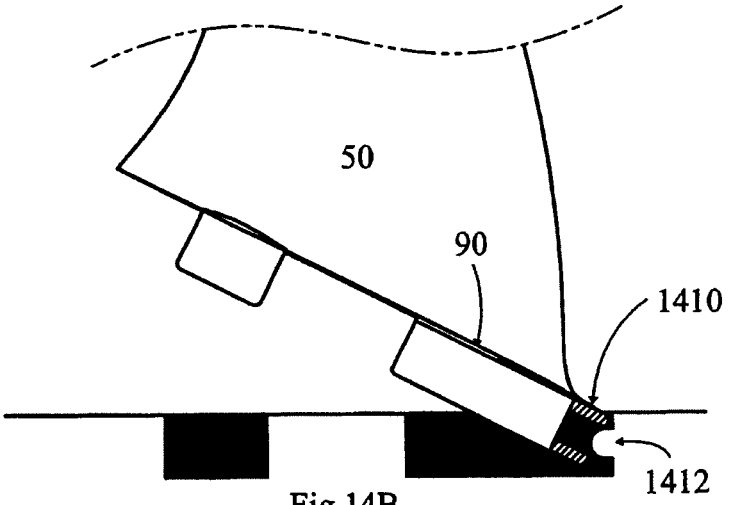
Figure 14C:
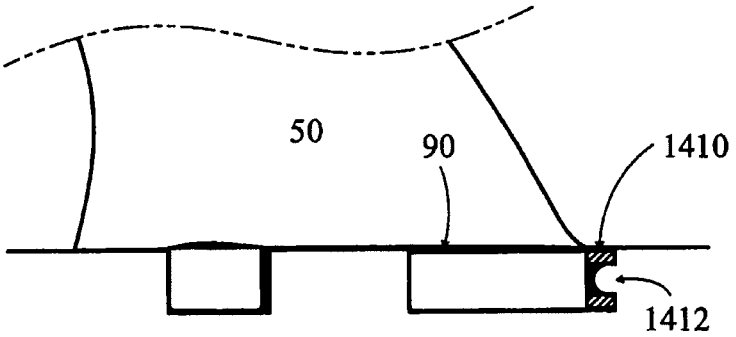

FIGS. 14A to 14C show the insertion of two pins 1410 on the second fin portion 90 into the second fin cavity 75, where the two pins surround a convex portion of the second cavity 75. The pins may also be formed from the undercutting of the fin tab nose.

Figure 15A:
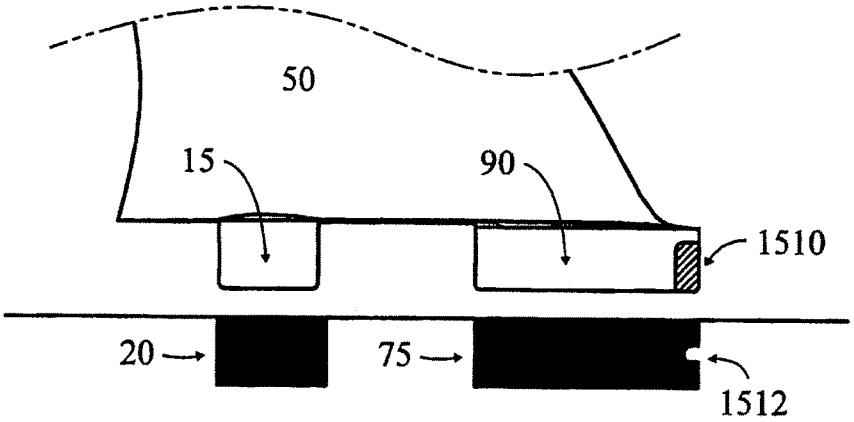
FIGS. 15A to 15C are an example fixing/engagement means to fix a second fin portion within a second cavity of the device/fin plug discussed herein.
Figure 15B:
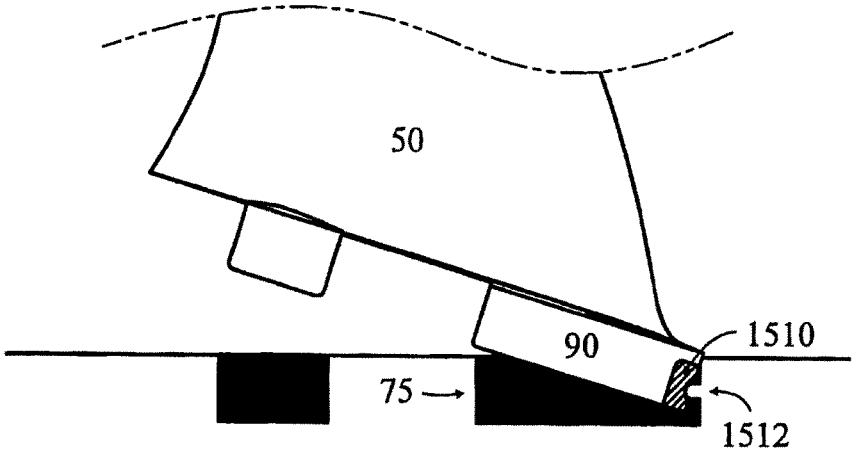
Figure 15C:
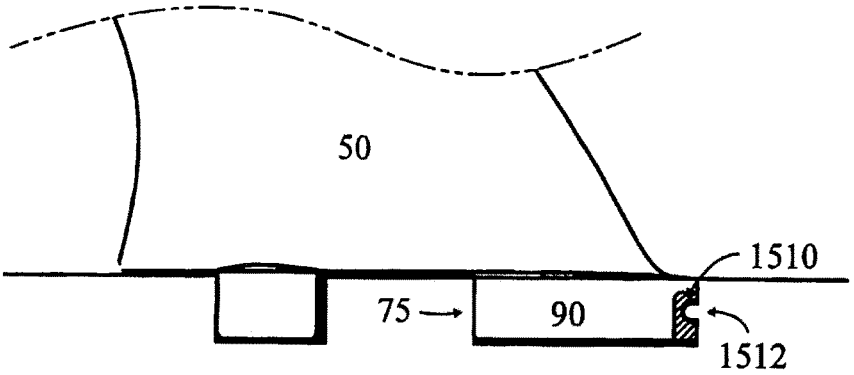

FIGS. 15A to 15C show a further example of flexes 1510 or deformable members 1510 inserted in the second fin portion 90 to create an undercut which then mates by deforming with a corresponding shape 1512 of the second cavity 75.

In FIGS. 16A to 18C the front tab 90 detail in engaging with the second cavity 75 not only uses a variation in undercut profile to secure the front tab but also has the secondary function of creating a prescribed entry and exit angle for the fin into the fin plug. This secondary function may make it more difficult for a fin to release from a fin plug unintentionally during surfing if configured as per FIGS. 16A to 18C.

Figure 16A:
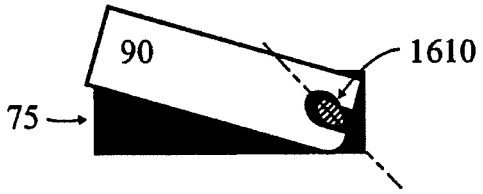
FIGS. 16A to 16C are an example fixing/engagement means to fix a second fin portion within a second cavity of the device/fin plug discussed herein.
Figure 16B:
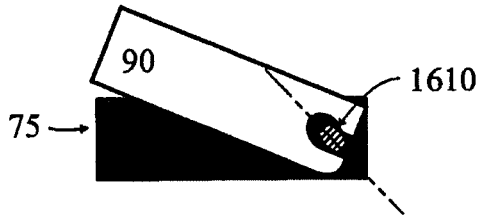
Figure 16C:
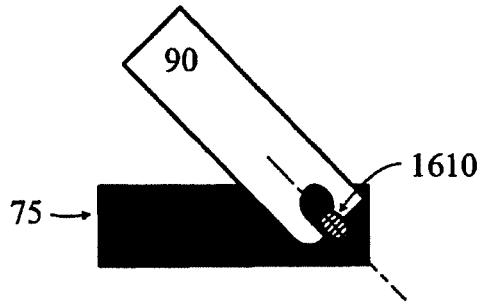
Figure 17A:
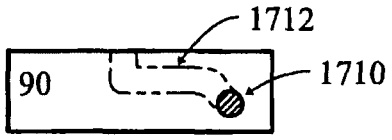
FIGS. 17A to 17D are an example fixing/engagement means to fix a second fin portion within a second cavity of the device/fin plug discussed herein.
Figure 17B:
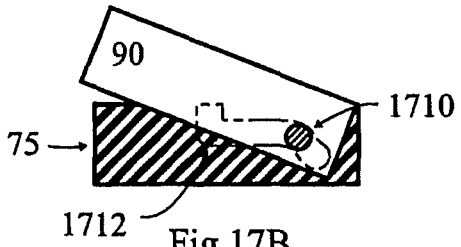
Figure 17C:
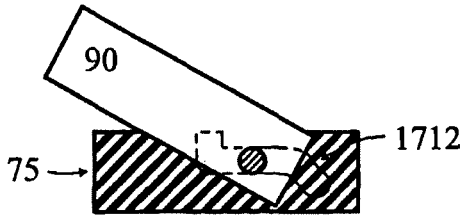
Figure 17D:
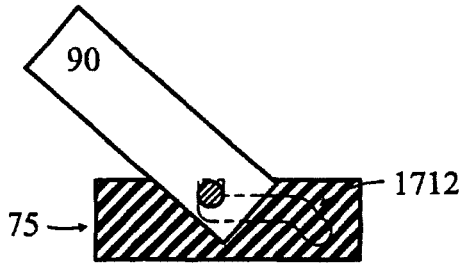

FIGS. 16A to 16C show an example sequence of inserting the second fin portion 90 into the second cavity 75 by the use of an oval pin 1610. The fin plug second cavity 75 with the oval pin 1610 that may only allow the front fin tab 90 to release when the corresponding oval shaped recess in the front fin tab 90 is aligned in the direction of intended release, as shown by way of example in FIGS. 16A to 16C.

FIGS. 17A to 17D show an example sequence of the use of a pin 1710 in the tab 90 and a track 1712 mechanism to insert the second fin portion 90 into the second cavity 75. The track 1712 can be located in the side wall of the second cavity 75.

Figure 18A:
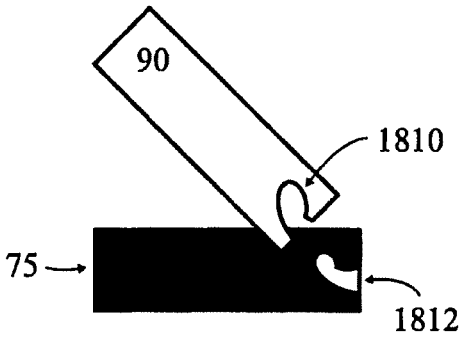
FIGS. 18A to 18C are an example fixing/engagement means to fix a second fin portion within a second cavity of the device/fin plug discussed herein.
Figure 18B:
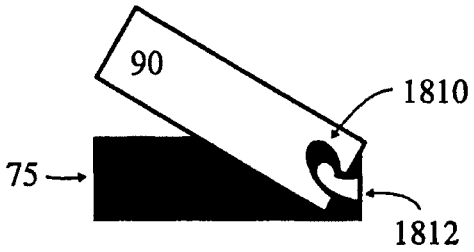
Figure 18C:
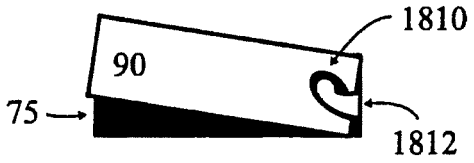

FIGS. 18A to 18C shows the use of another mating of a concave portion 1810 in the second fin portion 90 with a convex portion 1812 of the second cavity 75.

Figure 19:
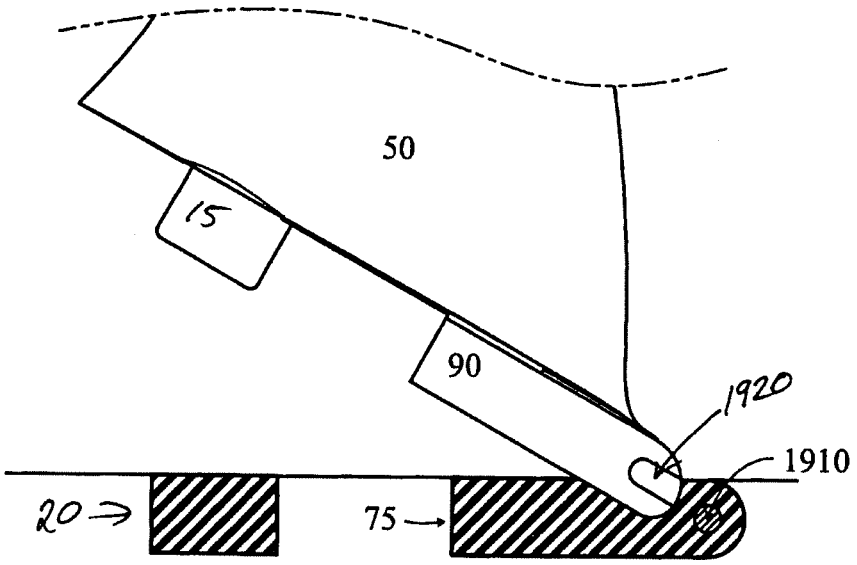
FIG. 19 is an example fixing/engagement means to fix a second fin portion within a second cavity of the device/fin plug discussed herein.

FIG. 19 is an example of the use of two shallow static pins 1910 protruding from either side of the second cavity 75 side walls . The two pins 1910 each mate with respective shallow grooves 1920 of the second fin portion 90 as shown in FIG. 19.

Figure 20:
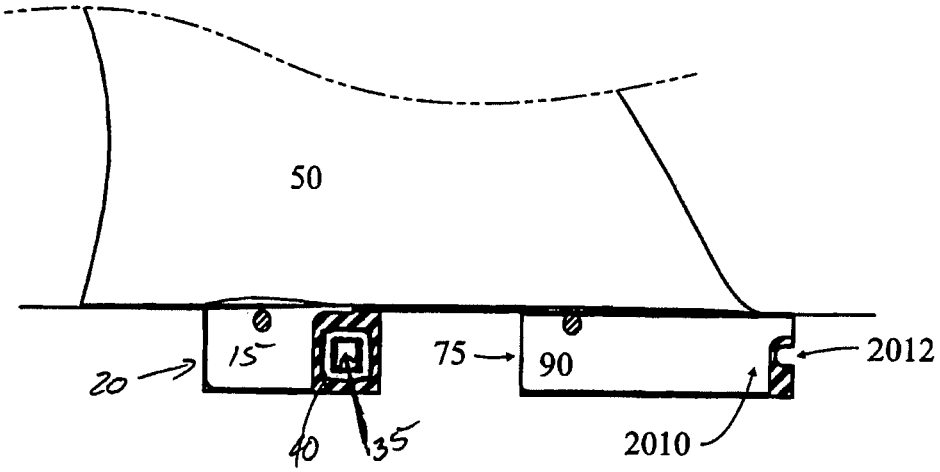
FIG. 20 is an example fixing/engagement means to fix a second fin portion within a second cavity of the device/fin plug discussed herein.

FIG. 20 shows an example where the rear fin tab 15 has a geometry or cut-out so as not to engage with the barrel 35. In this example the front tab cut out 2010 is also configured to not engage with a protrusion 2012. The fin of FIG. 20 may be fixed into the fin plug by use of fixing means such as grub screws in the fixation points 98 of the fin plug.

Figure 21:
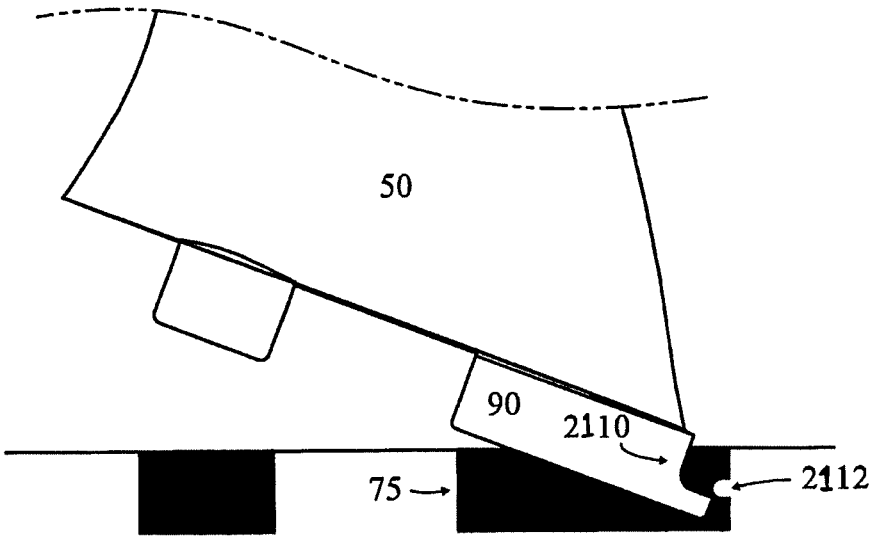
FIG. 21 is an example fixing/engagement means to fix a second fin portion within a second cavity of the device/fin plug discussed herein.
Figure 23:
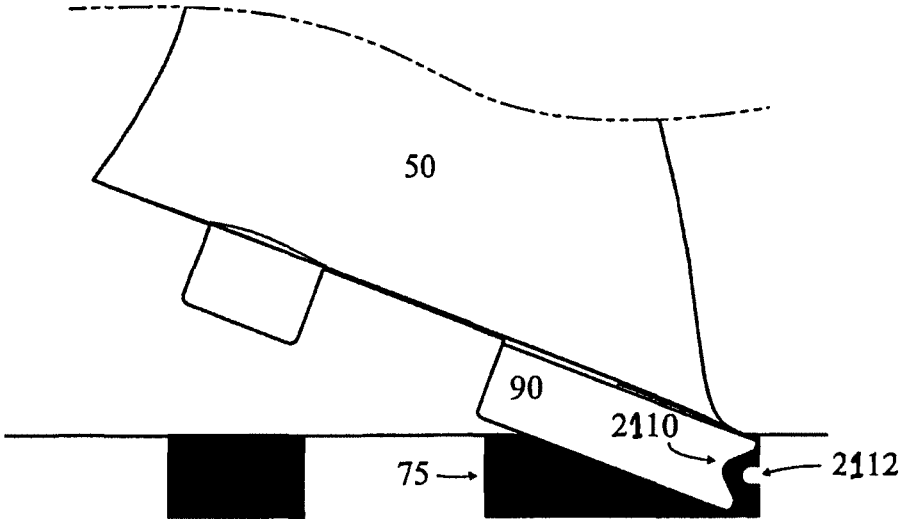
FIG. 23 is an example fixing/engagement means to fix a second fin portion within a second cavity of the device/fin plug discussed herein.
Figure 24:
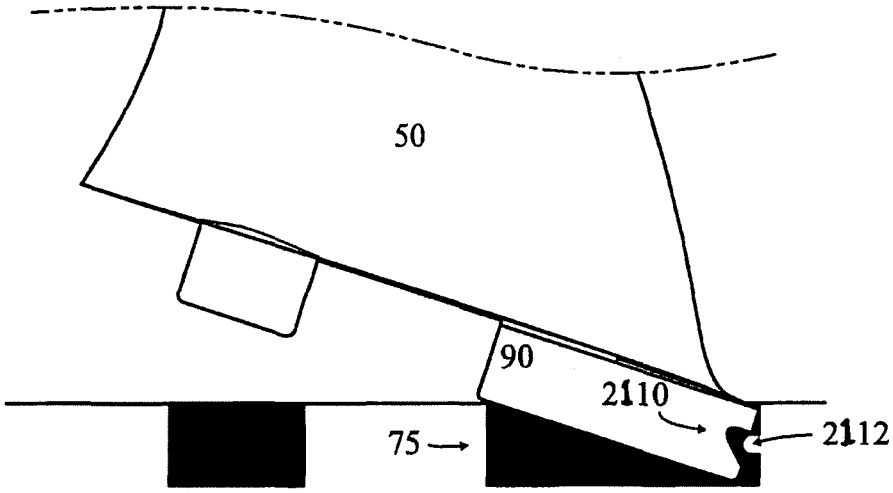
FIG. 24 is an example fixing/engagement means to fix a second fin portion within a second cavity of the device/fin plug discussed herein.

FIGS. 21, 23 and 24 show examples of various shaped cut-outs 2110 of the second fin portion 90 which then mate with corresponding shaped protrusions 2112 of the second cavity 75.

Figure 22:
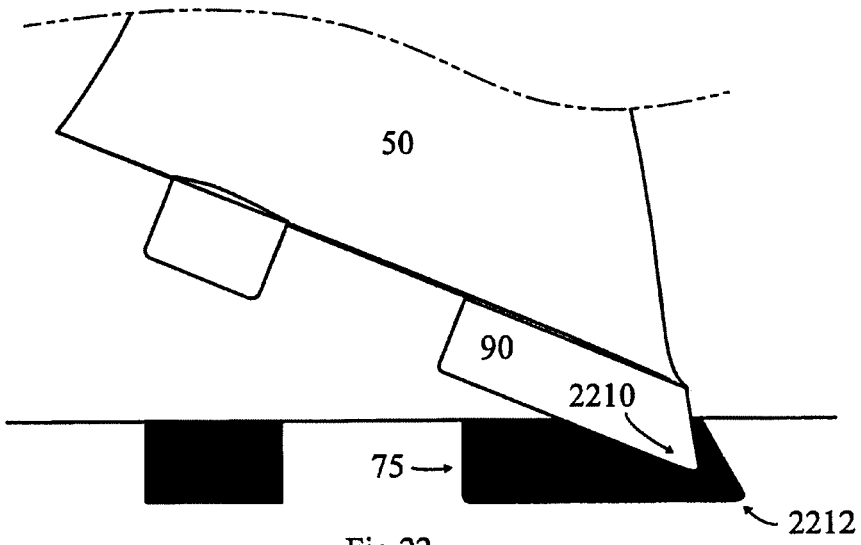
FIG. 22 is an example fixing/engagement means to fix a second fin portion within a second cavity of the device/fin plug discussed herein.

FIG. 22 shows an extension 2210 of the baseline of the second fin portion 90 to be inserted into a corresponding cutout 2212 in the second cavity 75.

Figure 25A:
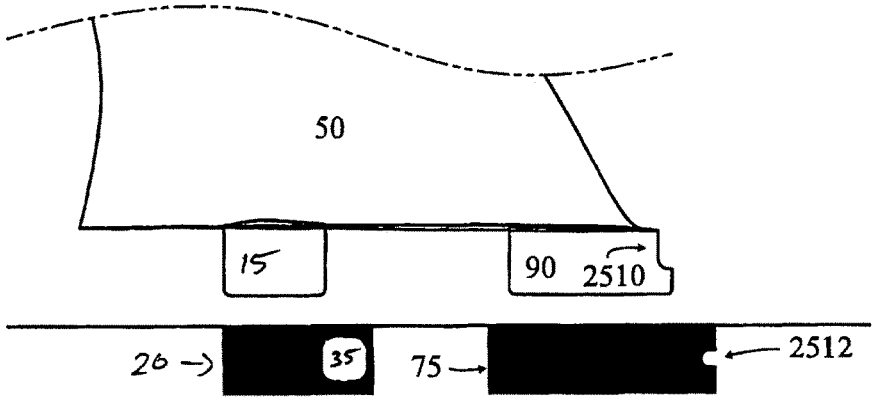
FIGS. 25A to 25C are example fixing/engagement means to fix a second fin portion within a second cavity of the device/fin plug discussed herein.
Figure 25B:
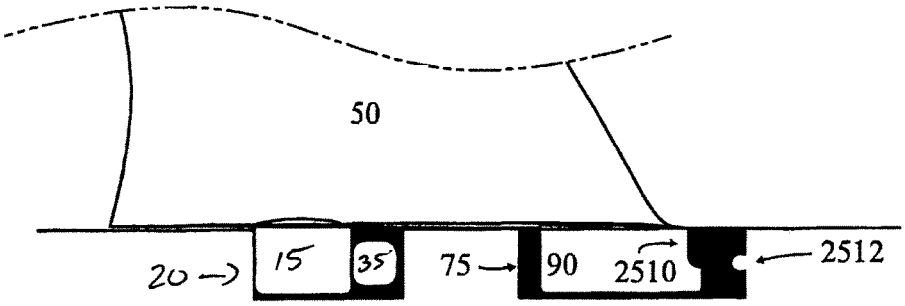
Figure 25C:
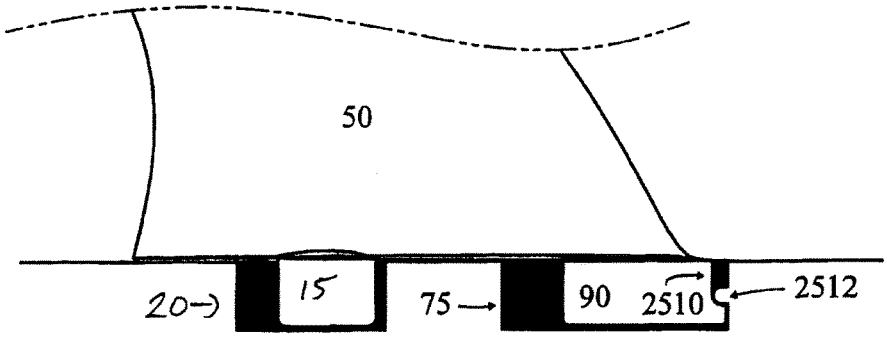

FIGS. 25A to 25C show a sequence for a rear fin tab 15 configuration that may allow the fin tabs 15, 90 to be lowered into their respective cavities 20, 75 and then the fin pushed forward so that the rear fin tab 15 engages with the barrel 35. The rear tab geometry of FIGS. 25A to 25C may be modified (not shown) to facilitate engaging with the barrel 35 in this alternate embodiment.

Figure 26A:
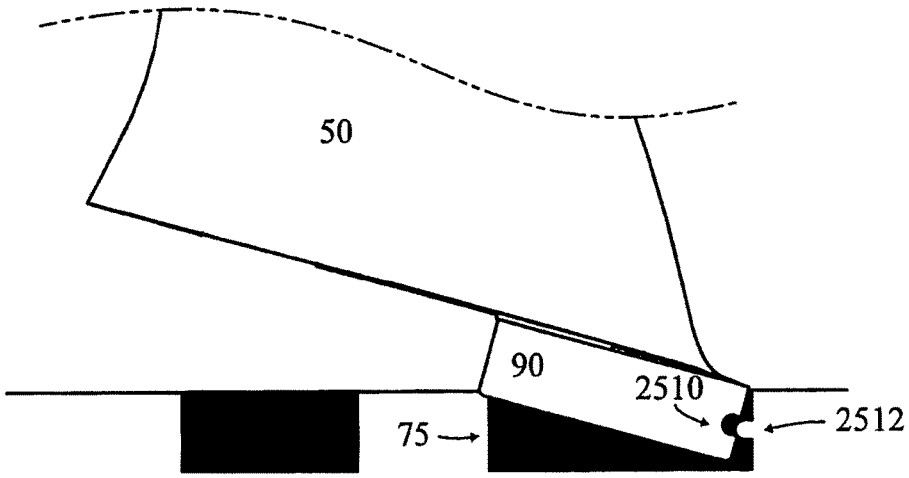
FIGS. 26A to 26B are example fixing/engagement means to fix a second fin portion within a second cavity of the device/fin plug discussed herein.
Figure 26B:
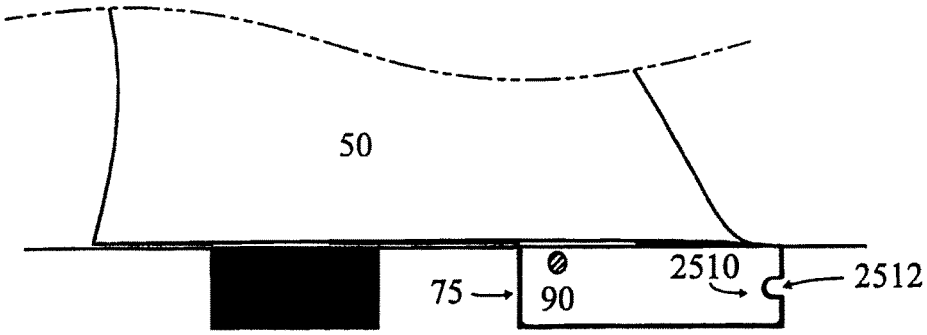

FIGS. 26A and 26B illustrate the securing of a fin to the fin plug where the fin has no rear fin tab. In this situation the front fin tab 90 may engage with the second cavity 75 as shown with protrusion 2512 and corresponding recess 2510 or the engagement may be as described herein elsewhere. In addition the fin of FIGS. 26A and 26B may be further securred into the fin plug by use of fixing means such as grub screws in the fixation points 98 of the fin plug.

Figure 27A:
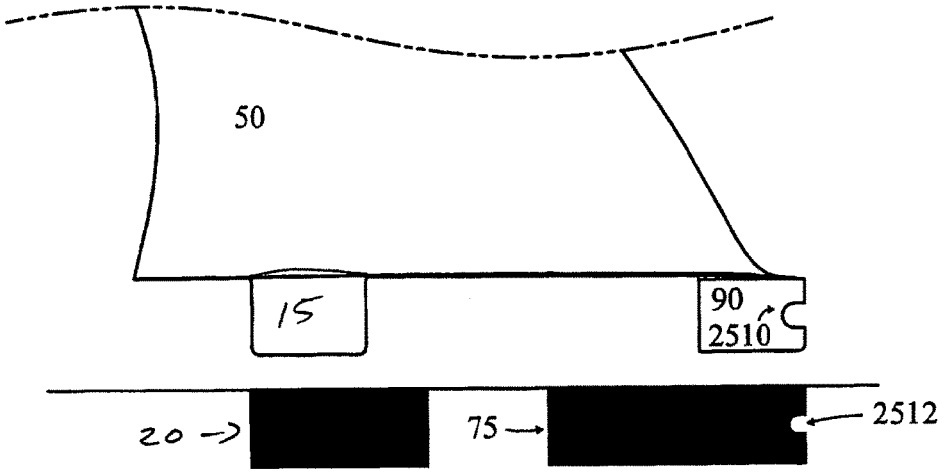
FIGS. 27A to 27B are example fixing/engagement means to fix a second fin portion within a second cavity of the device/fin plug discussed herein.
Figure 27B:
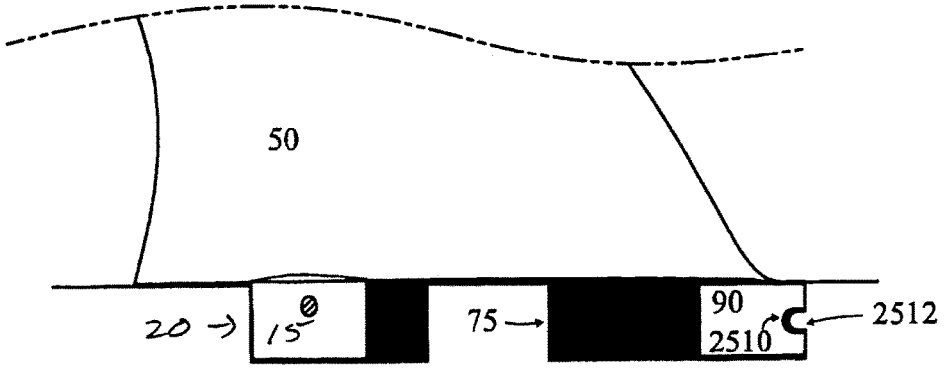
Figure 29A:
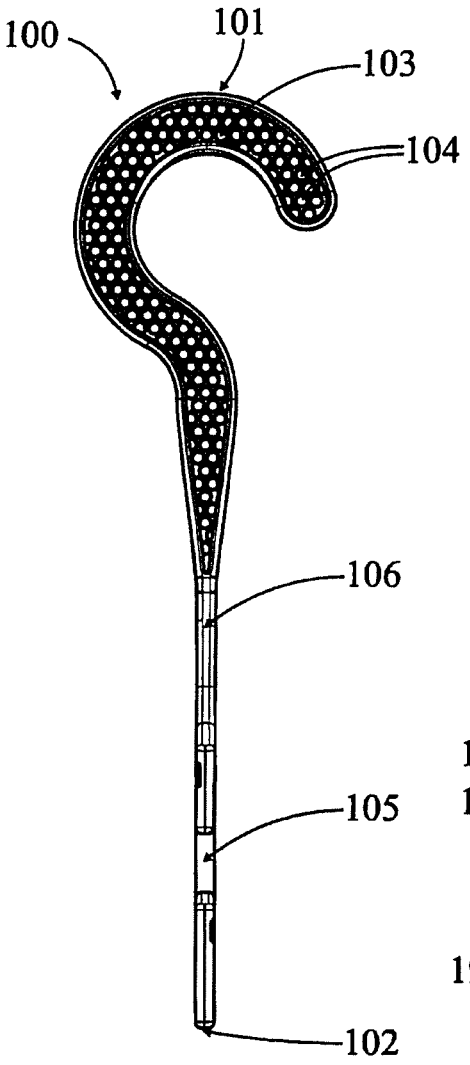
FIGS. 29A to 29H are respective views of the rear (29A), left side (29B), front (29C), right side (29D), isometric front (29E), isometric rear (29F), top (29G) and bottom (29H) of a water craft attachment device having a hook element according to preferred embodiment of the fourth aspect of this invention.
Figure 29B:
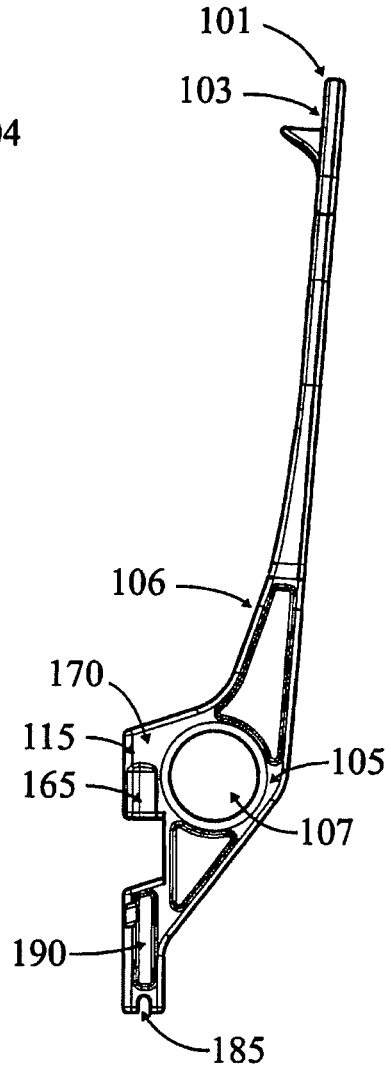
Figure 29C:
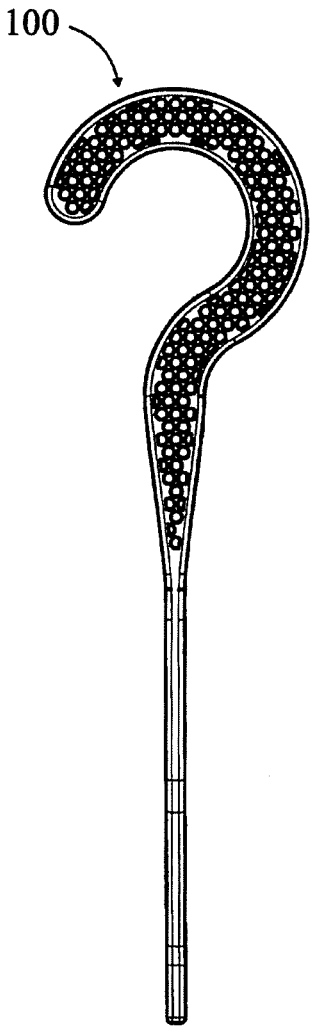
Figure 29D:
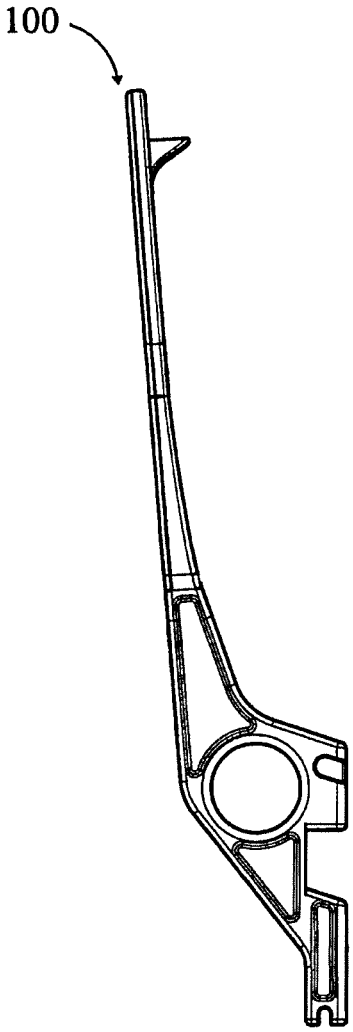
Figure 29E:
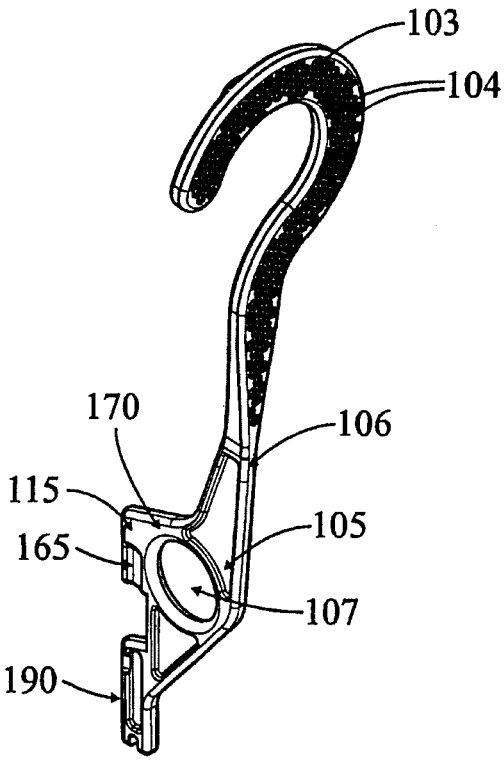
Figure 29F:
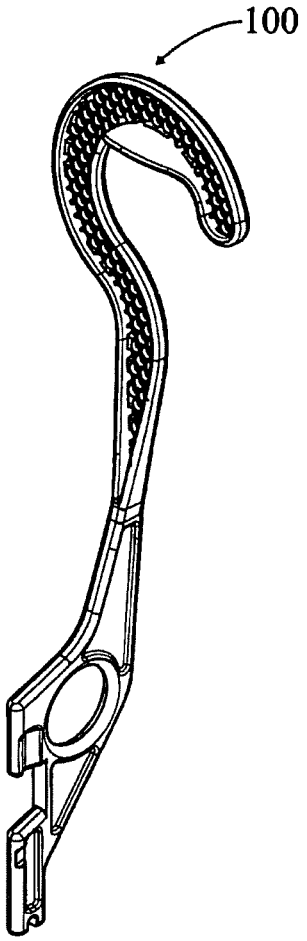
Figure 29G:
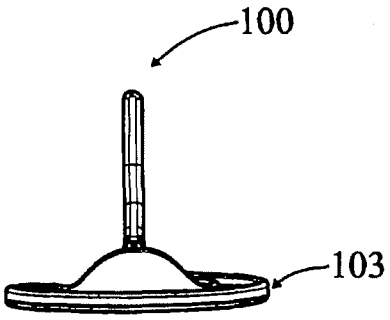
Figure 29H:
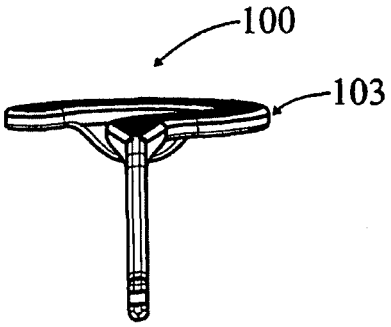
Figures 30A, 30B, 30C, 30D, 30E, 30F, 30G, 30H, 30I:
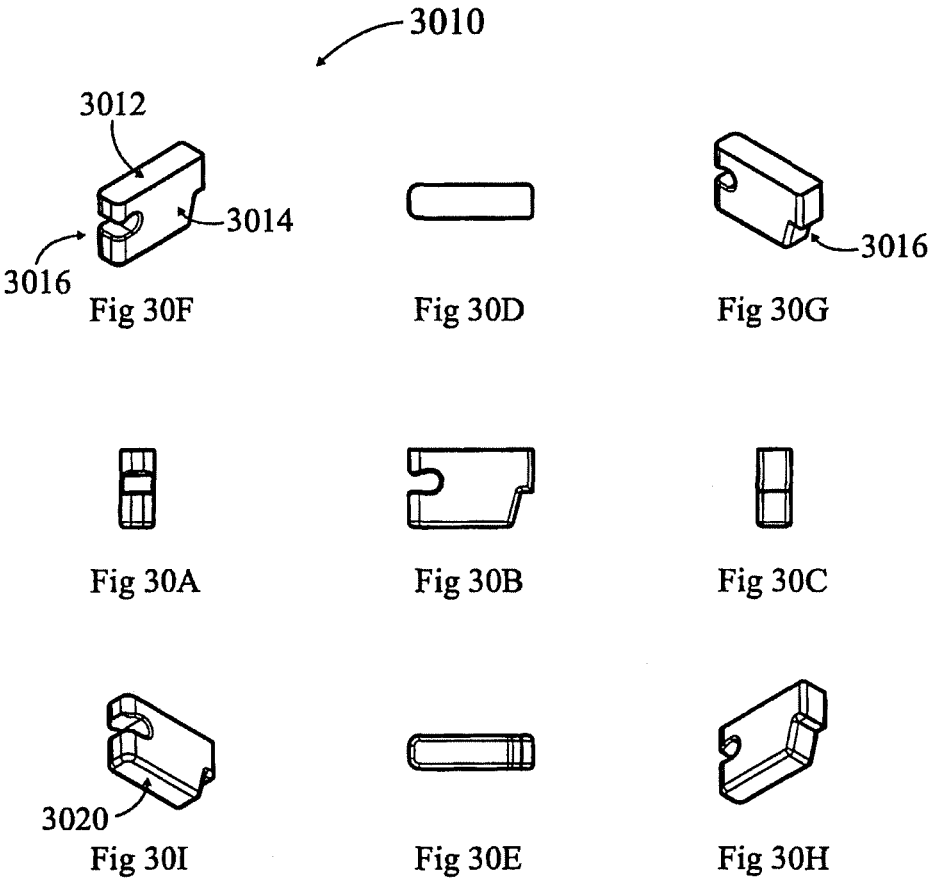
FIGS. 30A to 30I are views (including elevational views of rear, side, front, top, bottom and corresponding perspective illustrations) of compatibility infills for the fin plug of FIG. 1A in a fifth aspect of the invention.
Figures 31A, 31B, 31C, 31D, 31E, 31F, 31G, 31H, 31I:
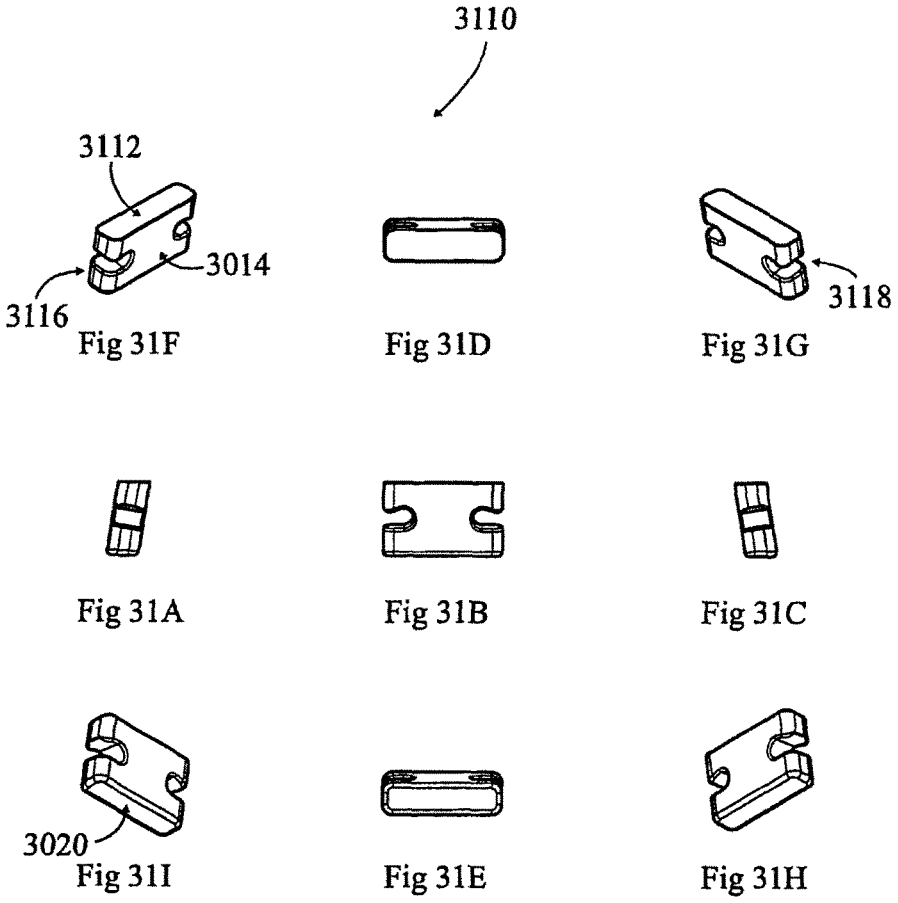
FIGS. 31A to 31I are views (including elevational views of rear, side, front, top, bottom and corresponding perspective illustrations) of compatibility infills for the fin plug of FIG. 1A in a fifth aspect of the invention.

FIGS. 27A and 27B show a further example to FIG. 20 where the rear fin tab 15 also has a geometry or cut-out so as not to engage with the barrel 35. The front fin tab 90 may engage with the second cavity 75 via different shaped cutouts 2510 in the second fin portion 90 mating with a corresponding protrusion 2512 of the second cavity 75. In addition the fin of FIGS. 27A and 27B may be further securred into the fin plug by use of fixing means such as grub screws in the fixation points 98 of the fin plug.

Accordingly, it will be appreciated that the engagement means described herein, which is typically used to hold the second tab portion within the second cavity, can be of any form and can also include any attachment means such as magnets, or even a second biasing means (such as the rod and wheel-like member of the first cavity).

In yet further examples, the device/fin plug described herein can be configured to receive an adapted fin. For example, the fin portion or base portion on the adapted fin, can be a separate element which is insertable as an adapter over a fin, in order to then be able to insert the fin into the device/fin plug as described herein. Example adaptors are shown in FIGS. 28A to 28C. In FIGS. 28A1 and 28A2, the first adaptor 2810 can be screwed in to the base of a tab-less fin. Alternatively in FIGS. 28B1 and 28B2 the first adapter piece 2810 can be screwed in to the side of the tabs on a two-tab fin. Accordingly, in both instances, the geometry of the proposed new tab configuration is added through this extension. In yet a further example, as shown in FIGS. 28C1 and 28C2, two holes can be drilled through the sides of the tabs on an existing 2-tab fin. Then, two pins (or plugs) 2812, 2814 can be screwed or press fitted in to place to form second and third adapter pieces. The result is two protruding pins from the sides of the tabs (the front pin 2814 nesting under the front undercut area of the box front slot whilst the rear pin 2812 interacts with the barrel which applies a downward and lateral force).

Although the fin plug of the first aspect of this invention is primarily intended to be used with water craft fins (e.g. surfboard fins) of the second aspect of this invention, so as to enable such fins to be easily and conveniently attached to, or detached from the fin plug (without the use of a tool), it is not limited to such use. For instance, other water craft attachment devices can be selectively attached to, or detached from, the relevant fin plug in substantially the same way as the abovementioned fins are attached or detached.

An example of such other water craft attachment devices is the hook device 100 shown in FIGS. 29A to 29H. As will readily be appreciated, this hook device is adapted to be connected to a surfboard (or other water craft) so that the surfboard (or other water craft) can be suspended from a horizontal supporting rod (or similar structure).

This hook device 100 has a first end 101 and a second end 102. A hook element 103 is located adjacent the first end 101 and a connection portion 105 is located adjacent the second end 102. An intermediate portion 106 is located between the hook element 104 and the connection portion 105.

The hook element 103 comprises a plurality of perforations 104. A benefit of the perforations is that they reduce the weight of the device and less material is required when the device is manufactured (resulting in cost savings).

The connection portion 105 comprises a first tab 115 and a second tab 190. The first tab 115 and the second tab 190 are adapted to be inserted into the first cavity 20 and the second cavity 75 (respectively) of the fin plug 10.

The first tab includes a grooved portion 165. This grooved portion 165 is located on a side surface 170 of the first tab 115. The grooved portion 165 is typically configured to engage with the extending portion 35 of the fin plug 10. Thus, in one example, a surface of the wheel-like member 35, which is typically a curved surface, is configured to site within the grooved portion 165.

It will be appreciated that although the grooved portion 165 can be formed or shaped such that it substantially conforms or mates with the curved surface of the extending portion 35 (of the fin plug 1), strict conformance or mating is not necessary. In this example, the grooved portion 165 is configured to roll over the extending portion 35 (of the fin plug 1) and the extending portion 35 can then lock the first tab 115 into the first cavity 20. It will also be appreciated that when the locking action occurs and the first tab 115 is pushed into the cavity, the rod 30 may bend and may remain slightly bent when applying the force to the extending portion 35, which subsequently applies a force to the grooved portion 165, in order to maintain the first tab 115 within the first cavity 20. In one particular example, either a lateral or a downward force, or a combination thereof can be applied to maintain the first tab 115 within the fin plug 10.

The second tab 190 includes a recess 185. This recess 185 is adapted to engage with the protrusion 80 on the device 10 (within the second cavity 75).

According to one particular example, when inserting the hook device 100 into the fin plug 10, the second tab 190 is inserted initially, where the recess 185 on the second tab 190 engages with the protrusion 80 on the fin plug 10 (within the second cavity 75). Once the second tab 190 is in place, the first tab 115 is locked into the first cavity 20 by pushing down on the hook device 100 such that the groove 165 engages with the extending portion 35 (of the fin plug 1), which is at least partially within the first cavity 20.

As can be seen from the drawings, the plane of the hook element 103 is at right angles (normal to) the plane of the connection portion 105. The effect of this is that, when a surfboard is connected to the hood device 100 (via the connection portion 105), the substantial plane of the surfboard will be substantially parallel to the plane of the hook element 103, thereby enabling a plurality of surfboards to be suspended from a supporting rod, in a sandwich-type formation (which results in improved space efficiencies).

A fifth aspect of the invention is the infills illustrated in FIGS. 30A to 35C. The infills can be of two types, compatibility infills and full plug infills. A compatibility infill as illustrated in FIGS. 30A to 32E can be used to fill in gaps or voids remaining between a fin and the first and/or second cavities 20, 75 of the fin plug 10. Such gaps can occur with the use of fins which were not originally intended for use with the fin plugs 10 as described here. For example fins as described with respect to FIGS. 28A to 28C with the use of adapters or other fins that can be used with the fin plug 10. The compatibility infill by filling a gap or a void of the fin plug 10 with the fin can improve the hydrodynamic performance about the fin and the fin plug, for example reduced hydrodynamic drag. The compatibility infill can also be used to exclude foreign matter such as sand from the fin plug 10 as well as improving the aesthetic appeal of the fin plug, the fin and the surfboard/water craft overall.

FIGS. 30A to 30E are respective elevational views of rear, side, front, top and bottom for a center fin compatibility infill 3010. FIGS. 30F to 30I are corresponding perspective illustrations of the center fin compatibility infill 3010 where an exterior surface 3012, a side surface 3014, a front surface profile 3016, a rear surface profile 3018 and a bottom surface 3020 are shown. The front surface profile 3016 is adapted to engage with a fin engagement means 80 or ledge portion 80 in the second cavity 75 of the fin plug 10, described in detail with respect to FIGS. 32A to 32E.

FIGS. 31A to 31E are respective elevational views of rear, side, front, top and bottom for a side fin compatibility infill 3110. FIGS. 31F to 31I are corresponding perspective illustrations of the side fin compatibility infill 3110 where an exterior surface 3112, a side surface 3114, a front surface profile 3116, a rear surface profile 3118 and a bottom surface 3120 are shown. The front surface profile 3116 is configured as described above for the center fin compatibility infill 3010. The rear profile 3118 exists to replicate the front profile 3116 on the alternate side fin plug, that is the "front" profile 3116 performs the same function on the left hand fin plug as the "rear" profile 3118 performs on the right hand fin plug. This allows a single moulded part 3110 to be used in either the right or left side fin plugs by simply flipping or otherwise rotating the side fin infill 3110.

Figure 32A:
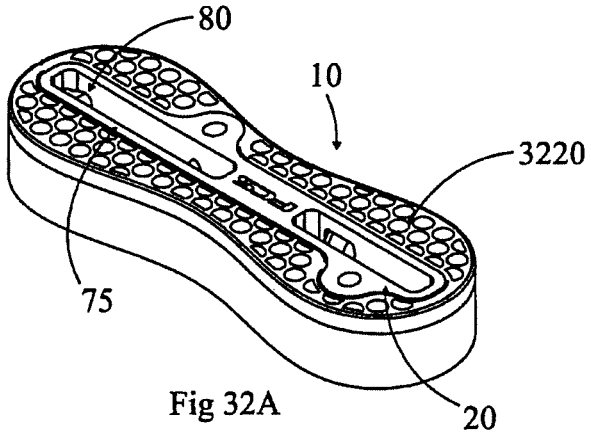
FIGS. 32A to 32E are a schematic representation of the installation of the compatibility infill of FIGS. 30A to 30I into the fin plug.
Figure 32B:
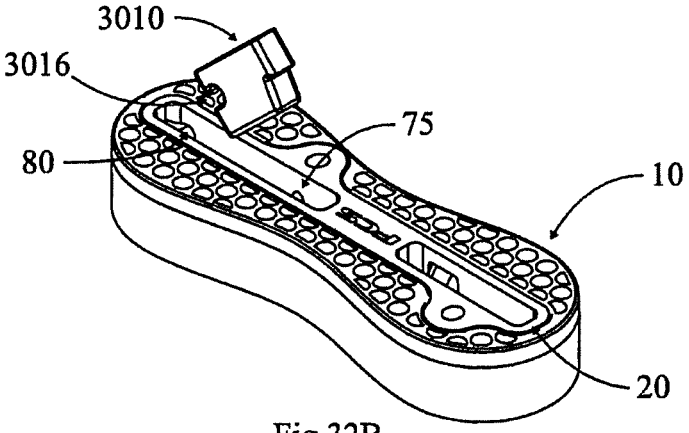
Figure 32C:
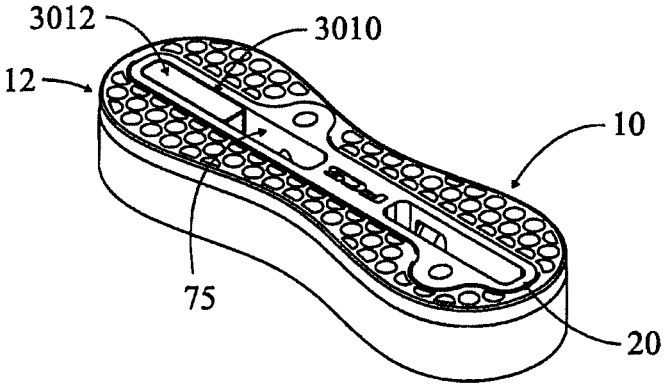
Figure 32D:
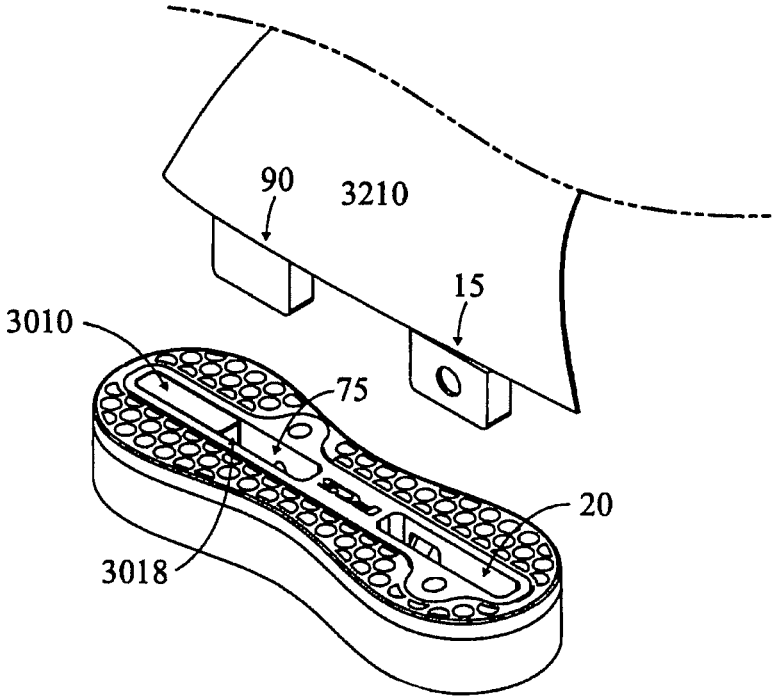
Figure 32E:
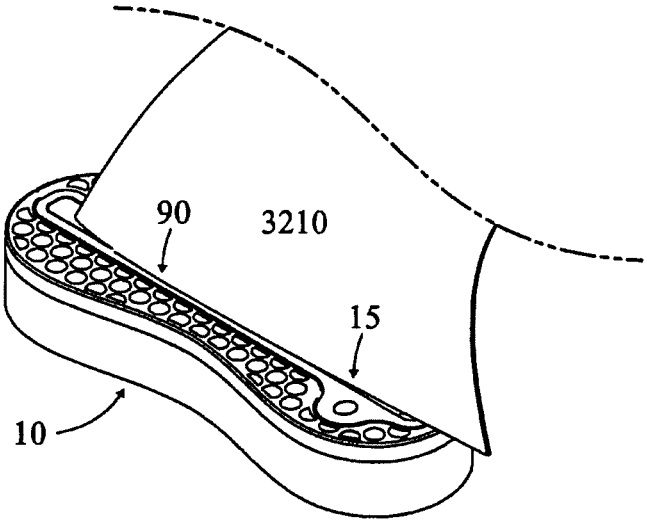
Figures 33A, 33B, 33C, 33D, 33E, 33F, 33G, 33H, 33I:
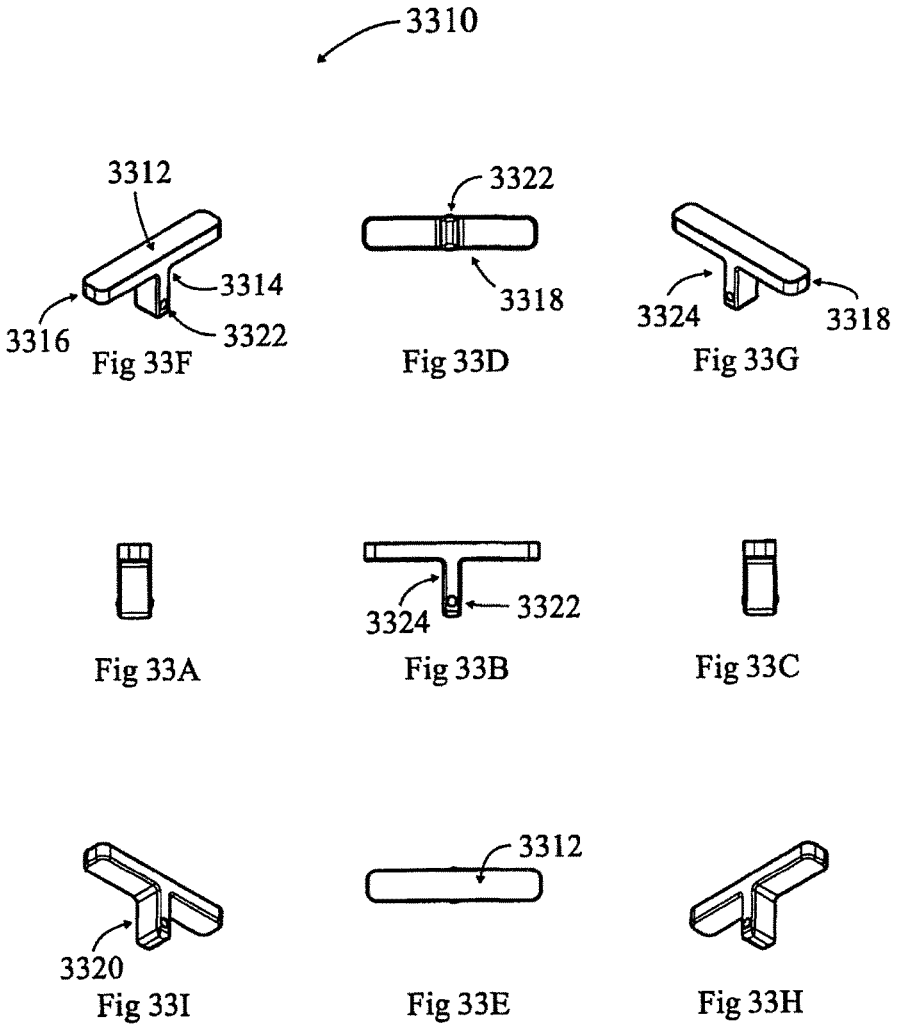
FIGS. 33A to 33I are views (including elevational views of rear, side, front, top, bottom and corresponding perspective illustrations) of full plug infills for the fin plug of FIG. 1A in a further fifth aspect of the invention.
Figures 34A, 34B, 34C, 34D, 34E, 34F, 34G, 34H, 34I:
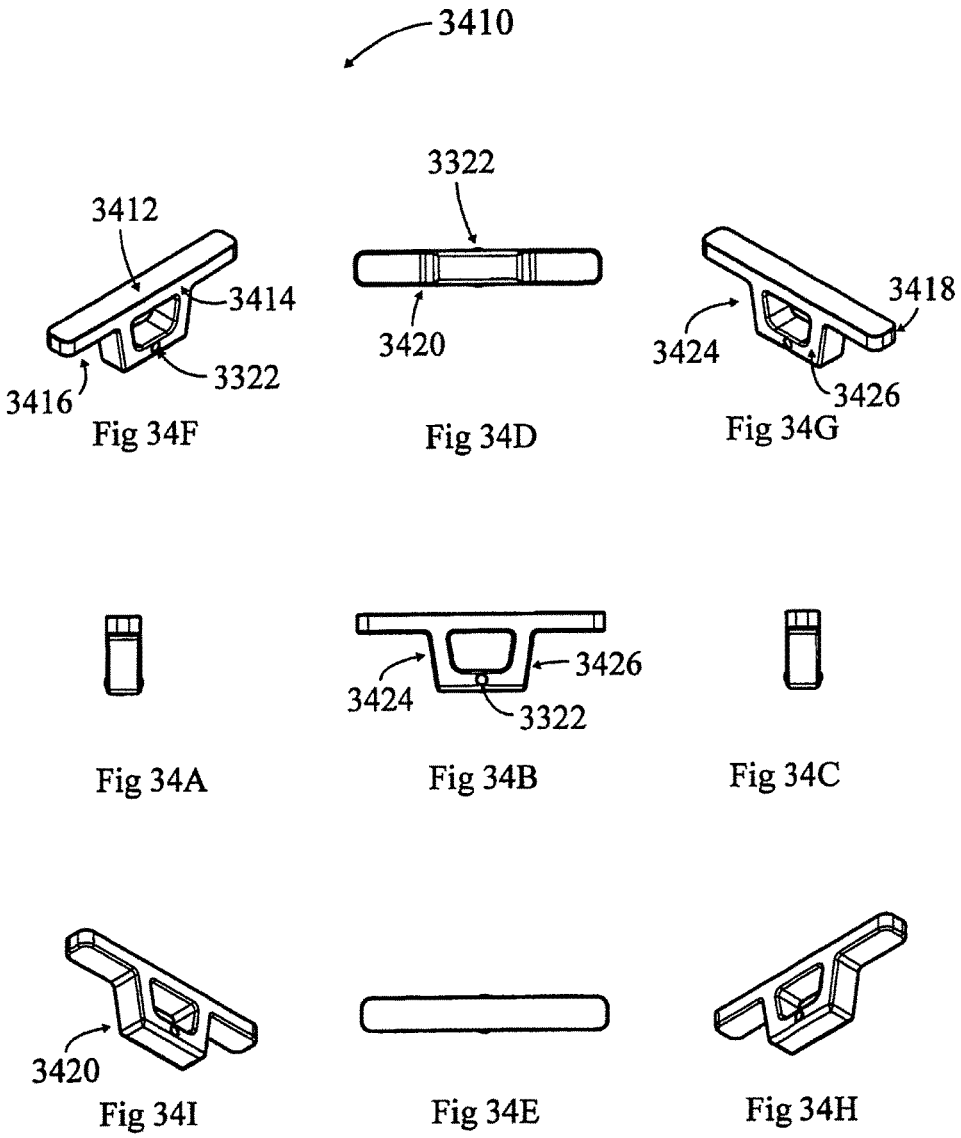
FIGS. 34A to 34I are views (including elevational views of rear, side, front, top, bottom and corresponding perspective illustrations) of full plug infills for the fin plug of FIG. 1A in a further fifth aspect of the invention.

FIGS. 32A to 32E show a sequence of fitting the center fin compatibility infill 3010 into the fin plug 10 with another fin 3210 not originally designed for the fin plug 10. The infill 3010 is inserted into the second cavity 75 as shown in FIG. 32B so that the front surface 3016 of the infill engages with the fin engagement means 80. The infill 3010 is then pressed into the second cavity 75 until the exterior surface 3012 of the infill 3010 is approximately flush with the top or exterior surface 3220 of the fin plug 10. FIG. 32C shows the infill installed into the forward region 12 of the second cavity 75. The press fitting of the infill 3010 is aided by selecting a material for the infill such as silicone rubber so that the rubber deforms for press fitting then reforms within the second cavity 75 to secure the infill 3010 within the second cavity 75. The selection of silicone rubber is also advantageous for its resistance to corrosion in the marine environment. Other suitable materials for the infill can be a thermoplastic polyurethane (TPU), a thermoplastic elastomer (TPE), a polypropylene (PP) or other suitable materials as determined by a person skilled in the art. In FIGS. 32D and 32E the front 90 and rear 15 tabs of the other fin 3210 are shown being respectively inserted into the second 75 and first 20 cavities. The front tab 90 of the fin 3210 can also engage with the rear surface profile 3018 of the infill 3010 by press fitting, deformity and reforming of the infill 3010.

It will be readily appreciated that the rear surface profile 3018 of the infill can be shaped or otherwise adapted so as to aid securing with the front tab 90. The fin 3210 can also be secured to the fin plug 10 as described previously above.

The fitting of the side fin compatibility infill 3110 together with another side fin can also be done in a similar manner to that described for the center fin compatibility infill 3010.

Figure 35A:
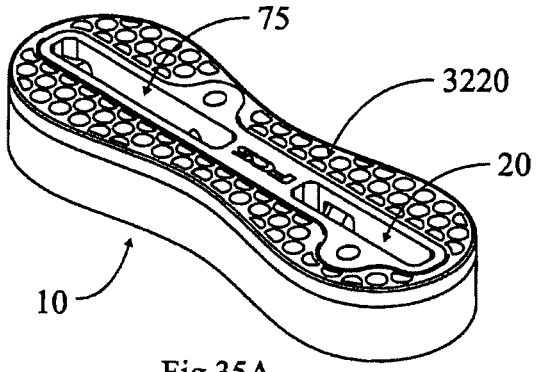
FIGS. 35A to 35C are a schematic representation of the installation of the full plug infill of FIGS. 33A to 34I into the fin plug.
Figure 35B:
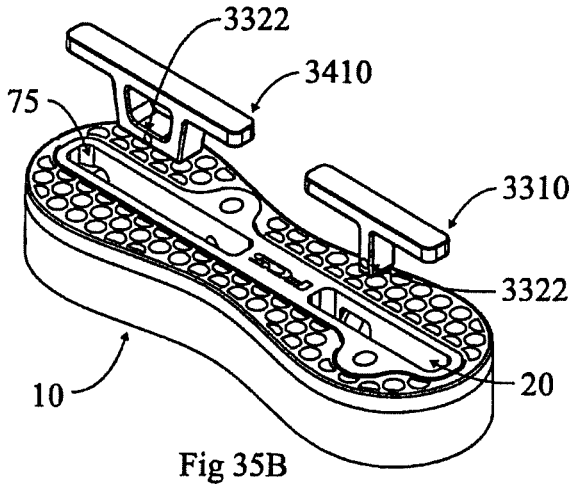
Figure 35C:
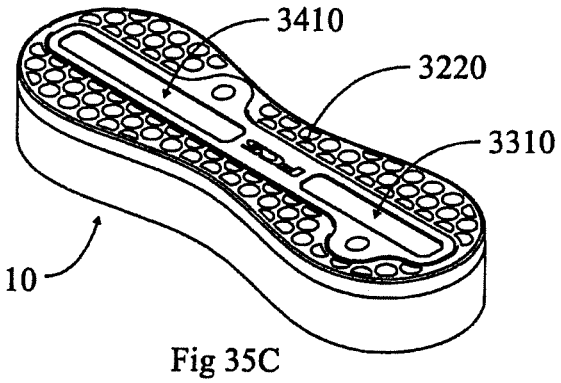

FIGS. 33 to 35 illustrate full plug infills to completely fill in the first 20 and second 75 cavities of the fin plug 10 when a fin is not present, as shown in FIG. 35C. The use of the full plug infills can be to improve the hydrodynamic performance, exclude foreign matter and improve aesthetic appeal as described above for the compatibility infills. Full plug infills can be particularly useful for surfboards that are capable of varying their multi-fin setup, for example a tri-fin and quad-fin set-ups in the one tri-quad fin surfboard. Tri-quad fin surfboards can have five fin plugs. The redundant one or two fin plugs, depending on whether a respective quad-fin or tri-fin setup is used, can be filled in with full plug infill/s. It will be readily appreciated that many multiple fin set-up surfboards can have redundant fin plug cavities for some fin set-ups.

FIGS. 33A to 33E are respective elevational views of rear, side, front, bottom and top for a center fin full plug infill 3310 for the first cavity 20 of the fin plug 10. FIGS. 33F to 33I are corresponding perspective illustrations of the center fin full plug infill 3310 where an exterior surface 3312, a side surface 3314, a front surface profile 3316, a rear surface profile 3318 and a bottom surface 3320 are shown. A small, circular boss or protuberance 3322 on the side 3314 of the full plug infill 3310 can be present to aid in securing the infill 3310 in a cavity 20 of the fin plug. The infill 3310 also features a vertical member 3324 which can aid in removing the infill 3310 from the first cavity 20 as well as aiding with the flush installation of the infill 3310, described below with respect to FIGS. 35A to 35C.

FIGS. 34A to 34E are respective elevational views of rear, side, front, bottom and top for a center fin full plug infill 3410 for the second cavity 75 of the fin plug 10. FIGS. 34F to 341 are corresponding perspective illustrations of the center fin full plug infill 3410 where an exterior surface 3412, a side surface 3414, a front surface profile 3416, a rear surface profile 3418 and a bottom surface 3420 are shown. A small, circular boss or protuberance 3322 on the side 3414 of the full plug infill 3410 can also be present to aid in securing the infill 3410 in the second cavity 75 of the fin plug 10. The infill 3410 also features two vertical members 3424, 3426 which can aid in removing the infill 3310 from the first cavity 20 as well as aiding with the flush installation of the infill 3310, described below with respect to FIGS. 35A to 35C. The two vertical members 3424, 3426 can also be joined together at their respective bottom ends as shown in the figures. The joint between the two vertical members can also be the location of the boss 3322; alternatively the boss 3322 may be placed on either of the vertical members 3424, 3426.

It will be readily appreciated that full plug infills can also be designed and made for side fin plugs.

FIGS. 35A to 35C show a sequence of fitting the two full plug infills 3310, 3410 into the fin plug 10. The full plug infills 3310, 3410 are pressed into their respective cavities 20, 75 until the exterior surfaces 3312, 3412 of both infills 3310, 3410 are approximately flush with the top or exterior surface 3220 of the fin plug 10. As described above the press fitting of the infills is aided by selecting a material for the infill such that the material deforms for press fitting then reforms within the cavities 20, 75 to secure the infills 3310, 3410. The selection of materials for the full plug infills can also be as described above for the compatibility infills. In addition the boss 3322 can also provide further securing within the cavities 20, 75. The use of the vertical members 3324, 3424, 3426 for the full plug infills 3310, 3410 allows the full plug infills to be removed from the fin plug 10 by depressing the exterior surface 3412 of the full plug infills to allow at least part of the full plug infill to rise above the exterior surface 3220 of the fin plug 10. The full plug infills can then be easily removed manually.

The full plug infills can alternatively be made in a fuller profile so as to fill the cavities more completely and more securely. In this alternative embodiment the full plug infills can be removed with the aid of a tool and/or fingernail.

Notably, it will be appreciated that although many different materials can be used for the device 10, it can be formed of ABS (Acrylonitrile Butadiene Styrene, or any other plastics) or Zytel. The side cap 57, cap 60 and end plug 55 can also be formed of the same material. The rod 30 is typically formed of any elastic material such as high grade stainless steel or titanium, which is also a robust material in watercraft as the material does not generally degrade or rust. The same robust material may also be used for the extending portion 35. It will further be appreciated that the device 10 can be injection molded.

It will also be appreciated that the hook device 100 can be formed from many different materials. Typically, this device will be formed from appropriate plastic materials which are relatively inexpensive and sufficiently strong for suspending a surfboard (or other water craft) from a supporting rod.

In this specification, terms denoting direction, such as vertical, up, down, left, right etc. or rotation, should be taken to refer to the directions or rotations relative to the corresponding drawing rather than to absolute directions or rotations unless the context require otherwise.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A water craft fin to be removably secured to a water craft fin plug having distinct front and rear open cavities and a bridge section therebetween, each of the front open cavity and the rear open cavity of the fin plug having a front end, a rear end and opposed side surfaces;

the front open cavity of the fin plug having a front cavity fin engagement means comprising a protrusion in the front end of the front open cavity and a first recess between the protrusion and a base surface of the front open cavity; and the rear open cavity of the fin plug having a resiliently protruding ring-shaped member extending into the rear open cavity from a side surface of the rear open cavity;

the water craft fin comprising:

a base portion having a front tab and a rear tab adapted to be received in the front open cavity and rear open cavity respectively;

the front tab includes a nose section at a front portion of the tab which is adapted to be received in the first recess and retained by the front cavity fin engagement means; and the rear tab includes a side surface at least partially recessed, adapted to at least partially receive the resiliently protruding ring-shaped member of the rear cavity;

the rear tab includes a beveled or radiused surface starting from a lowermost bottom of the rear tab and extending towards the side surface, wherein the beveled or radiused surface is adapted to engage with the resiliently protruding ring-shaped member before the recess of the side surface engages with the resiliently protruding ring-shaped member when the fin is inserted into the fin plug;

such that the fin is removably secured to the fin plug by the fin engagement means and the resiliently protruding ring-shaped member.

2. A fin according to claim 1, wherein the fin includes a surface between the front tab and the rear tab which is adapted to abut the bridge section of the fin plug.

3. A fin according to claim 1, wherein the front tab includes a second recess in the nose section which receives the protrusion of the front cavity fin engagement means, whereby at fin insertion the front tab engages with the front cavity fin engagement means and the fin pivots to insert the rear tab into the rear cavity.

4. A fin according to claim 1, wherein the protrusion is a ledge portion located in the front open cavity of the fin plug.

5. A fin according to claim 4, wherein a lower portion of the nose section is further adapted to underlie the ledge portion of the fin plug and to further inhibit movement of the fin when the front tab and the rear tab of the fin are received within the fin plug.

6. A fin according to claim 1, wherein the recess is forwardly located on the rear tab.

7. A fin according to claim 1, wherein the rear tab side surface recess is shaped to co-operate with and be removably retained by the resiliently protruding, ring-shaped member of the fin plug.

8. A fin according to claim 1, wherein the rear tab recess is a correspondingly shaped hollow in the side surface to receive the ring-shaped member of the fin plug when the fin rear tab is in the fin plug.

9. A fin according to claim 1, wherein the recess is located on the rear tab to abut the ring-shaped member of the fin plug when the rear tab is in the fin plug.

10. A fin according to claim 1, wherein the recess includes an inclined surface section, the inclined surface section being adapted to cooperate with the ring-shaped member mounted to a resilient rod of the fin plug, so as to cause a force, that is at least one of inwardly and laterally into the fin plug, to be applied to the rear tab when the resilient rod bends resiliently; and wherein the force being applied is such that a removal of the rear tab from the fin plug is inhibited.

11. A fin according to claim 10, wherein the recess includes a groove that includes the inclined surface section.

12. A fin according to claim 10, wherein the inclined surface section is located towards a bottom of the rear fin tab.

13. A fin according to claim 10, wherein the inclined surface section is located on the fin base portion to abut the ring-shaped member of the fin plug when the fin base portion is in the fin plug.

14. A fin according to claim 1, wherein the ring-shaped member rotates.

15. A fin according to claims 1, wherein the side surface and the recess cause:

to bend a resilient rod mounting the ring-shaped member, and at least one of the ring-shaped member and the resilient rod of the fin plug to rotate about a longitudinal axis of the resilient rod, when the fin rear tab removably engages with the fin plug.

16. A fin according to claim 1, wherein the rear tab side surface further includes the recess adapted to engage with a snap-lock actuating, resiliently bending protruding ring-shaped member.

17. A fin according to claim 1, wherein a co-operation of the recess, the ring-shaped member mounted to a resilient rod of the fin plug and a bending of a resilient rod of the fin plug cause the fin and the fin plug to snap-lock together.

18. A fin according to claim 17, wherein the recess comprises a hollow which receives the ring-shaped member.

19. A fin according to claim 1, wherein at least one of the recess and the front tab of the fin snap-lock respectively together with at least one of the ring-shaped member of the fin plug and the fin engagement means of the fin plug.

20. A fin according to claim 1, wherein the water craft is at least one of a surfboard, a surf craft, a sail board, a paddle board, a rescue board, a surf ski and a kayak.

21. The water craft fin of claim 1, further comprising a chamfer at the lower periphery of the recess of the partially recessed side surface.

22. The water craft fin of claim 1, wherein the recess of the partially recessed side surface is a groove.

23. The water craft fin of claim 1, wherein relative positioning of (i) a fin tip to the rear tab recess with respect to (ii) the pivoting nose section provides a mechanical advantage for inserting the fin rear tab into the rear cavity of the fin plug, past the resiliently protruding ring-shaped member.

24. The water craft fin of claim 2, wherein an insertion length of the front and rear tabs measured from a lowermost surface of the fin between the tabs is such that the bottom of the front and rear tabs are spaced apart from the bottom surface of the front and rear cavities when the fin base is secured in the fin plug.

25. A water craft fin to be removably secured to a water craft fin plug having distinct front and rear open cavities and a bridge section therebetween, each of the front open cavity and the rear open cavity of the fin plug having a front end, a rear end and opposed side surfaces;

the front open cavity of the fin plug having a front cavity fin engagement means comprising a protrusion in the front end of the front open cavity and a first recess between the protrusion and a base surface of the front open cavity; and the rear open cavity of the fin plug having a resiliently protruding ring-shaped member extending into the rear open cavity from a side surface of the rear open cavity;

the water craft fin comprising:

a base portion having a front tab and a rear tab adapted to be received in the front open cavity and rear open cavity respectively;

the front tab includes a nose section at a front portion of the tab which is adapted to be received in the first recess and retained by the front cavity fin engagement means; and the rear tab includes a side surface at least partially recessed, adapted to at least partially receive the resiliently protruding ring-shaped member of the rear cavity;

the rear tab, between the partially recessed side surface and a lowermost bottom, has a cross-sectional thickness that is thicker towards the side surface compared with the lowermost bottom;

such that the fin is removably secured to the fin plug by the fin engagement means and the resiliently protruding ring-shaped member.

26. A water craft fin to be removably secured to a water craft fin plug having distinct front and rear open cavities and a bridge section therebetween, each of the front open cavity and the rear open cavity of the fin plug having a front end, a rear end and opposed side surfaces;

the front open cavity of the fin plug having a front cavity fin engagement means comprising a protrusion in the front end of the front open cavity and a first recess between the protrusion and a base surface of the front open cavity; and the rear open cavity of the fin plug having a resiliently protruding ring-shaped member extending into the rear open cavity from a side surface of the rear open cavity;

the water craft fin comprising:

a base portion having a front tab and a rear tab adapted to be received in the front open cavity and rear open cavity respectively;

the front tab includes a nose section at a front portion of the tab which is adapted to be received in the first recess and retained by the front cavity fin engagement means; and the rear tab includes a side surface at least partially recessed, adapted to at least partially receive the resiliently protruding ring-shaped member of the rear cavity;

a bottom of the rear tab has a beveled or radiused surface adapted to engage with the resiliently protruding ring member before the recessed side surface engages with the resiliently protruding ring-shaped member when the fin is inserted into the fin plug;

such that the fin is removably secured to the fin plug by the fin engagement means and the resiliently protruding ring-shaped member.

* * * * *